US010916088B1

(12) United States Patent
Rye et al.

(10) Patent No.: US 10,916,088 B1
(45) Date of Patent: Feb. 9, 2021

(54) SERVICING AND MOUNTING FEATURES FOR GAMING MACHINE DISPLAY SCREENS AND TOPPERS

(71) Applicant: AGS LLC, Las Vegas, NV (US)

(72) Inventors: Ryan Patrick Rye, Suwanee, GA (US); Joel George Friedrick, San Diego, CA (US); Mark Robert Brandau, Johns Creek, GA (US)

(73) Assignee: AGS LLC, Las Vegas, NV (US)

( * ) Notice: Subject to any disclaimer, the term of this patent is extended or adjusted under 35 U.S.C. 154(b) by 0 days.

(21) Appl. No.: 16/543,492

(22) Filed: Aug. 16, 2019

Related U.S. Application Data

(63) Continuation-in-part of application No. 29/700,522, filed on Aug. 2, 2019.

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
USPC ..... 463/20
See application file for complete search history.

(56) References Cited

U.S. PATENT DOCUMENTS

| | | | | |
|---|---|---|---|---|
| 8,303,420 | B2 | 11/2012 | Chudek et al. | |
| 10,643,422 | B2 * | 5/2020 | Patel | E05D 3/16 |
| 2016/0005261 | A1 * | 1/2016 | Hirato | G07F 17/3211 463/31 |
| 2016/0005266 | A1 * | 1/2016 | Kawashima | G07F 17/3213 463/20 |
| 2016/0089607 | A1 * | 3/2016 | Ike | G07F 17/3211 463/29 |
| 2019/0096171 | A1 * | 3/2019 | Patel | E05D 5/06 |
| 2019/0352934 | A1 * | 11/2019 | Barbour | G07F 17/3216 |

* cited by examiner

*Primary Examiner* — Pierre E Elisca
(74) *Attorney, Agent, or Firm* — Wolf IP Law PLLC; Dean E. Wolf, Esq.

(57) ABSTRACT

Various gaming machine design features and functionalities are described herein relating to gaming machine display screens, access doors and toppers. In some embodiments, the gaming machine may include a main door support assembly which includes a stabilizing strut between flat components arranged into parallel planes forming a four-bar linkage, and facilitates an upward and outward movement of the main door assembly from a closed position. In some embodiments, the gaming machine may include a topper assembly which is configurable in a hands-free intermediate service position and a final installed position.

25 Claims, 31 Drawing Sheets

800

1400

1600

SERVICING AND MOUNTING FEATURES FOR GAMING MACHINE DISPLAY SCREENS AND TOPPERS

RELATED APPLICATION DATA

This application is a continuation-in-part application, pursuant to the provisions of 35 U.S.C. § 120, of prior U.S. patent application Ser. No. 29/700,522 titled "GAMING MACHINE" by Lee et al., filed on 2 Aug. 2019, the entirety of which is incorporated herein by reference for all purposes.

TECHNICAL FIELD

The present invention relates generally to gaming machines, and more particularly to gaming machines having display screens and toppers.

BACKGROUND

Electronic gaming machines ("EGMs") and other gaming machines are a popular form of gaming in casinos, bars, restaurants, stores, and other gaming establishments. Many modern slot machines and gaming machines are complex and require servicing and internal access for a variety of reasons. Gaming machine servicing and internal access can involve the manipulation of various display screens, toppers, and other components located about an outer gaming cabinet. For example, access to a region behind a primary display screen can involve removal of the display screen, or alternatively some movement of the display screen or a door assembly that includes the display screen, such as by way of a hinge or sliding component. As another example, it is often desirable to remove for servicing or replacement a topper or secondary display screen located above the primary display screen.

Newer designs and features for modern electronic gaming machines can result in issues with traditional ways of providing servicing and internal access. In some arrangements, it may be undesirable for a traditional simple upward movement of a main door assembly carrying a primary display screen in order to provide internal access to the area behind the main door. For example, a design that places a topper directly above and close to the primary display screen might prevent or discourage a simple upward movement of the primary display screen or a main door assembly that includes the primary display screen. Design and space constraints may also result in it being unfavorable to use a hinge along one side of the display screen.

In many practical deployment conditions of EGMs, there can be space and movement limitations and considerations. For example, many EGMs are deployed side-by-side in banks, such as on the floor of a casino or a retail establishment. Such EGM banks are also up against internal walls or other limiting features inside an establishment. Accordingly servicing features that may work for instances of an isolated gaming machine may not work as well for a gaming machine that is up against a wall and placed tightly between two other gaming machines. Hinged movements of display screens or doors, or any other servicing features that require there to be space beside or behind a gaming machine, may thus not be optimal in all machine deployment situations. Superior designs can account for ease of servicing while only using the space directly in front of an EGM. Alternative arrangements for display screen or main door movement could provide a wider variety of new and innovative gaming machine designs for gaming machines that can still be serviced using only the space in front of the machine.

For many gaming machine designs, a topper can be inserted or dropped into the top of a cabinet, and then the cabinet door can be opened so that any related screws, nuts, or other hardware can be tightened to secure the topper frame to the cabinet frame. Additionally, electrical wiring harnesses originating from the topper must typically be routed into the interior of the cabinet and connected to the appropriate electrical wiring harnesses located within the cabinet interior. As will readily be appreciated, this can require a service technician to move to multiple locations during the installation process in order to access the top exterior components of the cabinet and also the interior components within the cabinet. Additionally, because the interior of the cabinet needs to be accessed, for example, in order to access mounting screws and/or other hardware which secures the topper frame to the cabinet frame, the main door of the cabinet needs to be opened in order to provide access to the interior of the cabinet. Every time the main door of the cabinet is opened, however, this can present significant security issues or concerns, which is generally undesirable. Various mounting systems for gaming machine toppers and other gaming machine assemblies can be found in, for example, U.S. Pat. No. 8,303,420 to Chudek et al. While these and other arrangements for gaming machine components are adequate for mounting items to the gaming machine, there is often no consideration for awkward mounting procedures that may involve items having significant sizes and weights, as well as for alternative gaming machine designs.

A typical gaming machine topper can weigh 25-35 pounds or more and typically requires cable routing during the removal or installation process. Procedures for installing and removing a topper to or from the gaming machine cabinet can often involve a service technician standing on a ladder in front of the cabinet and trying to fish the topper wires down into the cabinet with one hand while holding the 25-35 pound topper with the other hand. Not only can this be a difficult and strenuous task, but it also presents a number of safety issues for the service technician and may also lead to equipment damage. For example, while the service technician is standing on the ladder trying to install the topper, both hands of the service technician may be occupied doing different tasks. For example, the service technician may need to fish the topper wires down into the cabinet with one hand while attempting to hold the topper with the other hand. If the service technician were to start losing his or her balance during this activity, the technician would not have a free hand to help steady himself or herself and may be more likely to fall off the ladder, resulting in personal injury and possibly damage to the equipment. Accordingly, one object of the present disclosure is to provide an improved gaming machine cabinet design to facilitate a more easy and safe installation and removal of gaming machine toppers to and from gaming machine cabinets. Additionally, another object of the present disclosure is to provide an improved gaming machine cabinet design and topper design which enables a service technician to install or remove a topper to and from the cabinet without needing to access any mounting items within the cabinet interior and/or without needing to open the main door of the gaming cabinet.

In some gaming machine designs, a primary display screen or main door carrying a display screen can open vertically instead of swinging to one side, such that the display screen or door can block the topper and prevent a service technician from easily servicing or replacing the topper when the display screen is open or raised. In a casino or other machine deployment environment, the rear of the cabinet can be inaccessible due to placement of the gaming machine, such as up against a wall. In such cases, the topper can be removed or inserted from a technician on a ladder in front of the cabinet, or may even require multiple technicians. Alternative arrangements for display screen movement and topper designs could provide a wider variety of new and innovative overall gaming machine designs. For example, it may be desirable to have a large primary display with a top that directly abuts the bottom of a topper. This type of design can be difficult to provide with simple hinged door components, however, since a significant gap or space between the display at the topper may be needed to avoid interference during the movement of a door carrying the large primary display. This can be especially true where the primary display is curved, further limiting the ways in which a main door carrying the display might be moved.

Accordingly, there is a need for various servicing and mounting features and functionalities for gaming machine components such as display screens and toppers. Although traditional servicing and mounting features for these components have worked well in the past, improvements for the designs of these display screens, toppers, and associated components are desired.

BRIEF DESCRIPTION OF THE DRAWINGS

The included drawings are for illustrative purposes and serve only to provide examples of possible structures and arrangements for the disclosed systems, apparatuses and features for gaming machines having improved servicing and mounting features for display screens and toppers. These drawings in no way limit any changes in form and detail that may be made to the disclosure by one skilled in the art without departing from the spirit and scope of the disclosure.

DETAILED DESCRIPTION OF EXAMPLE EMBODIMENTS

Overview

Figure 1A:
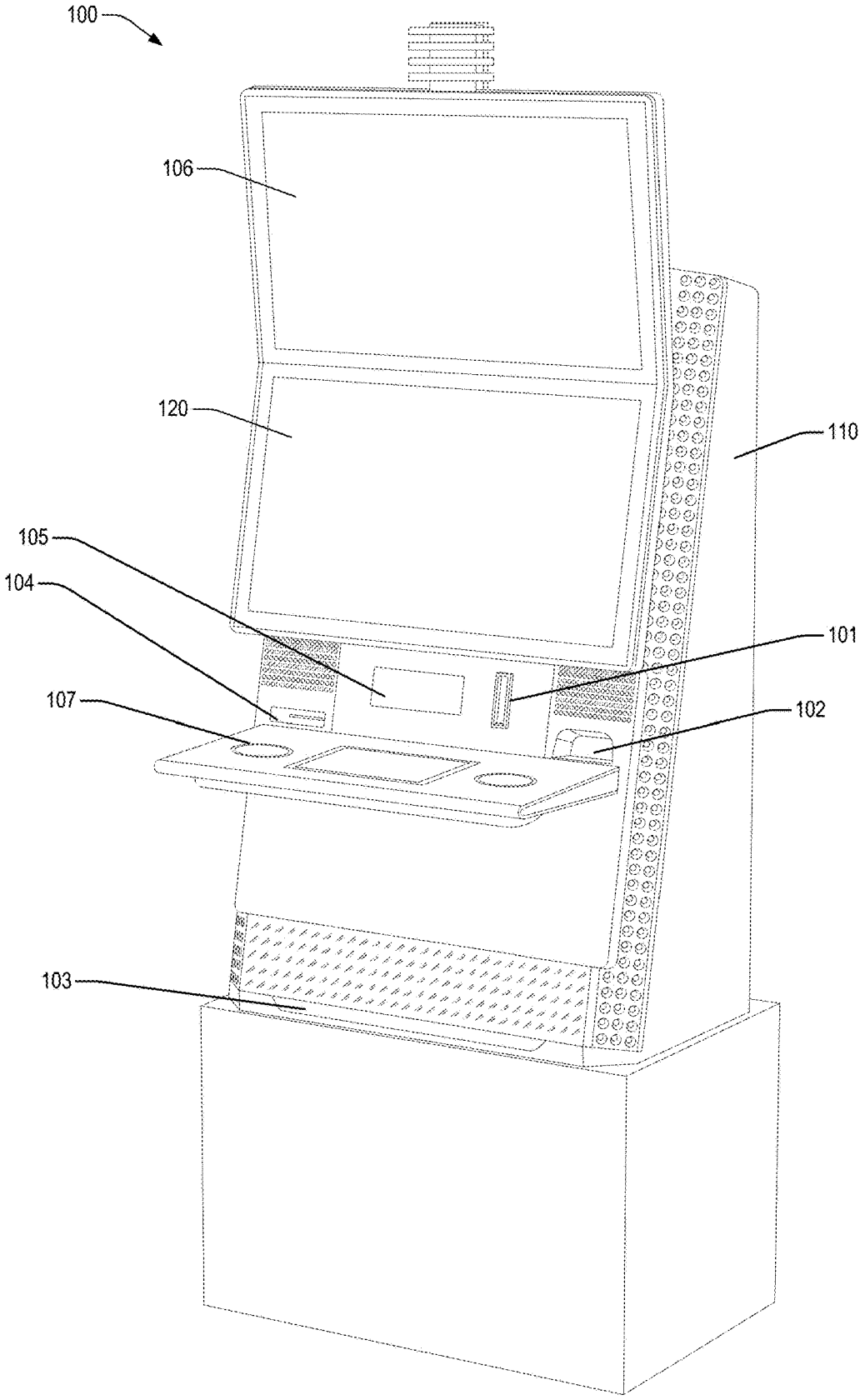
FIG. 1A illustrates in front perspective view an exemplary gaming machine.

Various aspects described or referenced herein are directed to different apparatuses, systems, and methods relating to servicing and mounting features for gaming machine display screens and toppers.

One aspect disclosed herein is directed to a gaming machine having a cabinet, a main door assembly, a display screen located on the main door assembly, and a main door support assembly. The cabinet can have an entry that provides access to an interior of the cabinet. The main door assembly can be movably coupled to the cabinet and can move from a closed position that prevents access to the interior of the cabinet through the entry to an open position that allows access to the interior of the cabinet through the entry. The main door support assembly can be coupled to the main door assembly and the cabinet, and the main door support assembly can include a four-bar linkage that facilitates an opening movement of the main door assembly that includes the main door assembly moving outward from the closed position and then upward to arrive at the open position.

Another aspect disclosed herein is directed to a modular gaming machine having a gaming cabinet and a topper assembly removably attachable to the gaming cabinet. The gaming cabinet can include a main door assembly movably attached to the gaming cabinet, the main door assembly being movable to a closed position which prevents access to an interior of the gaming cabinet, and further movable to an open position which enables access to the interior of the gaming cabinet. The gaming cabinet can also include a mounting bracket coupled to the gaming cabinet and disposed at the interior of the gaming cabinet. The topper assembly can include a topper body and at least one support leg attached to the topper body and extending away from the topper body. The gaming cabinet can also include an opening deployed at a top portion of the gaming cabinet, the opening having a size and shape which accommodates passage of the at least one support leg through the opening. The topper assembly can be removably attachable to the gaming cabinet and configurable in a stationary, intermediate service position via engagement of at least the at least one support leg with the mounting bracket, and the topper assembly can be further configurable in a stationary, final installed position via engagement of the at least one support leg with the mounting bracket.

Still another aspect disclosed herein is directed toward a gaming machine having a cabinet, a main door assembly, a display screen located on the main door assembly, a main door support assembly including a four-bar linkage and a stabilizing strut, electrical cable(s) coupling the display screen to internal component(s) of the gaming machine, a topper supported by the gaming machine cabinet, one or more topper support legs extending away from the topper, and one or more mounting brackets for the topper and topper support legs. The gaming machine cabinet can have an entry that enables access to an interior of the gaming machine. The main door assembly can be movably coupled to the cabinet such that the main door assembly is movable from a closed position that prevents access to the interior of the gaming machine to an open position that allows access to the interior of the gaming machine through the entry. The main door support assembly can be coupled to the main door assembly and the gaming machine cabinet, with the main door support assembly including multiple flat identical components arranged into parallel planes forming a four-bar linkage, and also a stabilizing strut located between at least two of the flat identical components. The stabilizing strut can define a longitudinal axis that is orthogonal to the parallel planes. The main door support assembly can facilitate an opening movement of the main door assembly, where the opening movement includes the main door assembly moving outward from the closed position and then upward to arrive at the open position. The stabilizing strut can provide a routing path for the electrical cable(s) when the main door assembly moves between the closed position and the open position. The topper can be located directly above and next to the display screen when the main door assembly is at the closed position, and the display screen can be located directly in front of the topper when the main door assembly is at the open position. The one or more mounting brackets can be coupled to the gaming machine cabinet, with each mounting bracket including one or more tabs. The one or more topper support legs can interact with the one or more mounting brackets to facilitate a final installed position of the topper and a different intermediate service position of the topper that permits servicing of the topper while the topper is still supported by the gaming machine cabinet by way of the one or more mounting bracket tabs.

In at least one embodiment, the gaming machine is an upright gaming machine. In at least one embodiment, the display screen remains in substantially the same vertical orientation throughout the opening movement of the main door assembly.

In at least one embodiment, the gaming machine further comprises: a topper supported by the cabinet, the topper being located directly above and next to the display screen when the main door assembly is at the closed position; one or more topper support legs coupled to and extending away from the topper; and one or more mounting brackets coupled to the cabinet, wherein the one or more topper support legs interact with the one or more mounting brackets to facilitate a final installed position of the topper and a different intermediate service position of the topper that permits servicing of the topper while the topper is still supported by the cabinet. In at least one embodiment, the intermediate service position is different from the final installed position.

In at least one embodiment, the gaming machine further comprises: one or more electrical cables coupling the display screen to one or more components in the interior of the cabinet, wherein the stabilizing strut provides a routing path for the one or more electrical cables when the main door assembly moves between the closed position and the open position.

In at least one embodiment, the gaming machine further comprises a first set of electrical wiring harnesses disposed within the interior of the gaming cabinet, wherein the first set of electrical wiring harnesses are positioned within the interior of the gaming cabinet in a manner which enables the first set of electrical wiring harnesses to be physically accessed from an exterior of the gaming cabinet while the main door assembly is configured in the closed position.

In at least one embodiment, each mounting bracket includes one or more tabs that support the one or more topper support legs when the topper is in the intermediate service position. In at least one embodiment, the display screen is directly in front of the topper when the main door assembly is at the open position. In at least one embodiment, the opening movement of the main door assembly is possible while the topper remains in the final installed position. In at least one embodiment, the distance between the bottom of the topper and the top of the display screen is less than about 0.5 cm when the topper is in the final installed position and the main door assembly is in the closed position.

In at least one embodiment, the ground link of the four-bar linkage is coupled to the cabinet and the output link of the four-bar linkage is coupled to the main door assembly. In at least one embodiment, the main door support assembly includes multiple flat identical components arranged into parallel planes. In at least one embodiment, the main door support assembly further includes a stabilizing strut located between at least two of the multiple flat identical components, the stabilizing strut defining a longitudinal axis that is orthogonal to the parallel planes.

In at least one embodiment, the at least one support leg is removably attachable to the first mounting bracket in accordance with a first attachment configuration and without use of fasteners; and the attachment of the at least one support leg to the first mounting bracket in accordance with the first attachment configuration results in the first topper assembly being configured in the intermediate service position.

In at least one embodiment, the at least one support leg is removably attachable to the first mounting bracket in accordance with a first attachment configuration and without use of fasteners; the attachment of the at least one support leg to the first mounting bracket in accordance with the first attachment configuration results in the first topper assembly being configured in the intermediate service position; the at least one support leg is removably attachable to the first mounting bracket in accordance with a second attachment configuration; and the attachment of the at least one support leg to the first mounting bracket in accordance with the second attachment configuration results in the first topper assembly being configured in the final installed position.

In at least one embodiment, the first topper assembly is removably attachable to the gaming cabinet and configurable in the stationary, intermediate service position while the main door assembly configured is in the closed position.

In at least one embodiment, the first topper assembly is removably attachable to the gaming cabinet and configurable in the intermediate service position while the main door assembly is configured in the closed position; and the first topper assembly is removably attachable to the gaming cabinet and configurable in the final installed position while the main door assembly is configured in the closed position.

In at least one embodiment, an interior region of the gaming machine is accessible via the first opening while the first topper assembly is configured in the intermediate service position; and the interior region of the gaming machine is not accessible via the first opening while the first topper assembly is configured in the final installed position.

In at least one embodiment, the gaming cabinet further includes a first set of electrical wiring harnesses disposed within the interior of the gaming cabinet; the topper assembly further includes a second set of electrical wiring harnesses electrically coupled to at least one electrical component of the topper assembly; the first set of electrical wiring harnesses are positioned within the interior of the gaming cabinet in a manner which enables the first set of electrical wiring harnesses to be physically accessed from an exterior of the gaming cabinet; and the second set of electrical wiring harnesses are electrically couplable to the first set of electrical wiring harnesses while the main door assembly is configured in the closed position.

In at least one embodiment, the at least one support leg has an elongated shape, the at least one support leg having a first elongated slot disposed therein, the at least one support leg further having a second slot disposed therein; the first mounting bracket includes a bracket body and a first set of tab members extending outward from the bracket body; the first topper assembly is configurable in the intermediate support position via engagement of a first tab member of the first set of tab members with the first elongated slot of the at least one support leg; and the first topper assembly is configurable in the final installed configuration via engagement of the first tab member with the second slot of the at least one support leg.

In at least one embodiment, the first mounting bracket includes a bracket body and a first set of tab members extending outward from the bracket body; and the first set of tab members support the at least one support leg of the topper assembly while the topper assembly is configured in the intermediate service position.

In at least one embodiment, the at least one support leg includes a distal end portion; the at least one support leg further includes a first elongated slot disposed therein; the at least one support leg further includes a second slot disposed therein; the first mounting bracket includes a bracket body; the first mounting bracket further includes a first set of tab members extending outward from the bracket body; the first mounting bracket further includes a second set of tab members extending outward from the bracket body; the first topper assembly is configurable in the intermediate support position via engagement of a first tab member of the first set of tab members with the first elongated slot of the at least one support leg; and the first topper assembly is configurable in the final installed configuration via engagement of the first tab member with the second slot of the at least one support leg and via engagement of a second tab of the second set of tab members with the distal end portion of the at least one support leg.

Various objects, features and advantages of the various aspects described or referenced herein will become apparent from the following descriptions of its example embodiments, which descriptions should be taken in conjunction with the accompanying drawings.

SPECIFIC EXAMPLE EMBODIMENTS

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to devices, systems, and methods for providing gaming machines having improved servicing and mounting features for display screens and toppers. In a typical EGM, display screens and toppers are common and known components having relatively simple mechanisms for moving display screens to provide internal access to the gaming machine, as well as simple mounting procedures for attaching toppers atop a gaming machine cabinet. Newer gaming machine designs can benefit from a display screen moves outward and upward, as well as a topper having multiple positions that are supported by the gaming machine cabinet. Accordingly, the present disclosure provides improved components that are specifically designed to accommodate newer or modified external gaming machine designs, particularly for upright gaming machine designs that include large curved display screens, large toppers, or both. Although the various embodiments disclosed herein involve servicing and mounting features for an upright gaming machine type, it will be understood that the arrangements, components, and features for the provided examples can also be used on other types of gaming machines.

In various detailed examples, which are merely illustrative and non-limiting in nature, a specialized movable display screen support arrangement can facilitate an outward and upward movement of a display screen, and a specialized topper support leg and bracket combination can facilitate multiple positions of the topper that are all supported by the gaming machine cabinet. In particular, the topper positions can include a stationary intermediate service position and a final installed position. Various embodiments can include gaming machines having only the movable display screen support arrangement, only the topper leg and bracket combination, or both. Such gaming machines featuring these specialized components can allow for expanded designs of a gaming machine that allow for ready servicing of the gaming machine by a single technician even in tight or restrictive environments. Other advantages will also become readily apparent upon review of the figures and detailed description set forth below.

Starting first with FIG. 1, an example gaming machine is illustrated in front perspective view. In various embodiments, methods of game play and presentation can be implemented via a gaming machine or device 100. Such a gaming machine 100 may have various configurations, and again may facilitate the play of wager-based games or other games that are not wager-based. The gaming machine 100 may be located at a casino or other gaming establishment. The gaming machine 100 may be part of a gaming system, such as a casino gaming system which links multiples of the gaming machines, one or more table games, and/or other devices such as kiosks, accounting systems, progressive systems, player tracking systems, respective servers thereof, and the like.

As illustrated, gaming machine 100 generally comprises a physical housing or cabinet 110 for supporting and/or enclosing various components required for operation of the gaming machine. Housing 110 can include openings and support components for a display screen, for a topper, or for both of these items. Configurations of the gaming machine 100 may vary. Although gaming machine 100 has an "upright" configuration as shown, alternative configurations, shapes, or dimensions can include a "slant" type, "bar-top" type, "cocktail table" type, and/or other configurations, as are well known to those of skill in the art.

Gaming machine 100 can include various output devices, such as at least one display device 120 located within or proximate the housing or gaming machine cabinet 110 and configured to display game information. The display device 120 may comprise an electronic video display such as a cathode ray tube ("CRT"), high resolution flat panel liquid crystal display ("LCD"), projection LCD, plasma display, field emission display, digital micro-mirror display ("DMD"), digital light processing display ("DLP"), LCD touchscreen, a light emitting display ("LED") or other suitable displays now known or later developed, in a variety of resolutions, sizes and formats (e.g., 4:3, widescreen. or the like). The display device 120 may be capable of projecting or displaying a wide variety of information, including images both still and moving, symbols and other indicia or information associated with game play, game promotion or other events.

In another embodiment, the gaming machine 100 may include one or more physical reels capable of displaying symbols. In such a configuration, means are provided for rotating the physical reels. In some embodiments, a player input to a spin button or a spin arm (a "pull") causes the reels to spin. In some embodiments, electronically controlled mechanisms are arranged to rotate and stop each reel, which mechanisms are well known to those of skill in the art. In such an arrangement, actuation of the spin arm or depression of the spin button can cause a controller (not shown) to signal the activation of the spin mechanism associated with one or more of the reels. The controller can be arranged to either turn off the signal to the device(s) effecting the rotation of each or all of the reels (such as one or more electrically powered stepper motors) or generate a signal for activating a braking device, whereby the reels are stopped. As is well known, the combinations of reel positions and their odds of hitting are associated with the controller, and the controller is arranged to stop the reels in a position displaying a combination of indicia as determined by the controller based on the combinations and odds. Alternatively, the reels can be actuated, controlled, and stopped through purely mechanical means. All such embodiments and details thereof are well known to those of skill in the art.

In various embodiments, gaming machine 100 can be configured to present one or more wager-based games upon a player making a monetary payment or wager. In this regard, gaming machine 100 can include means for accepting monetary value or coin in. In various embodiments, certain game outcomes may be designated as winning outcomes. Prizes or awards may be provided for winning outcomes, such as monetary payments (or representations thereof, such as prize of credits), or promotional awards. The gaming machine 100 can also include mean for returning unused monetary funds and/or dispensing winnings to a player, such as by way of physical coins, printed tickets, cash vouchers, electronically stored credits to player accounts, and the like.

Gaming machine 100 can also include one or more player input devices 107 (such as input buttons, plunger mechanisms, a touch-screen display, joystick, touch-pad, card readers, or the like) that may be located at or proximate the cabinet 110. These one or more input devices 107 may be utilized by the player to facilitate game play, such as by providing input or instruction to the gaming machine 100 per the desires of the player. For example, such input devices 107 may be utilized by a player to place a wager, cause the gaming machine 100 to initiate a game, to indicate cards to be held or discarded, to "cash out" of the gaming machine, or to provide various other inputs that may be necessary or desired.

Gaming machine 100 can include at least one microprocessor-based controller or CPU microprocessor or controller for controlling the gaming machine, including receiving player input and sending output signals for controlling the various components of the machine 100 (such as generating game information for display by the display 120). The controller may be arranged to receive information regarding funds provided by a player to the gaming machine, receive input such as a purchase/bet signal when a purchase/bet button is depressed, and receive other inputs from a player. The controller may be the primary or only game determination component configured to facilitate the result of a wager-based game played at the gaming machine. The controller may also be arranged to generate information regarding a game, such as generating game information for display by the at least one display 120 (such as information representing images of displayed cards), for determining winning or losing game outcomes and for displaying information regarding awards for winning game outcomes, among other things.

The controller or computing microprocessor may be configured to execute machine-readable code or "software" or otherwise process information, such as obtained from a remote server. Software or other instructions may be stored on a memory or data storage device. The memory may also store other information, such as pay table information. The gaming machine 100 may also include one or more random number generators for generating random numbers, such as for use in selecting cards and for presenting the game in a random fashion. This can be part of the game determination of the gaming machine.

The controller can be configured to execute machine-readable code or instructions that are configured to implement game play on the machine. For example, the controller of the gaming machine 100 may be configured to detect a wager, such as a signal from a player depressing of a "bet one" button. Upon such an event and/or the player otherwise signaling the gaming machine to present the game, the controller may be configured to cause slot reels to spin or a graphical representation of spinning slot reels to be displayed on the at least one display 120.

The gaming machine 100 may be configured to generate and present games in a stand-alone manner, or it may be configured to be in communication with one or more external devices at one or more times. For example, the gaming machine 100 may be configured as a server based device such as a "thin-client" terminal, and may obtain game code or game outcome information from a remote game server, in which event the gaming machine controller may receive game information from the server, such as game outcome information, and use that server-generated information to present the game at the gaming machine. Such server system arrangements are generally well known.

The gaming machine 100 can be configured to present one or more wagering games, and may thus be configured to accept value, such as in the form of coins, tokens, paper currency, or other elements or devices representing value such as monetary funds. For example, as illustrated in FIG. 1, the gaming machine 100 might include a coin acceptor 101 for accepting coins. Of course, associated coin reading/verifying devices and coin storage devices may be associated with the gaming machine 100 if it is configured to accept coins. Likewise, the gaming machine 100 might include a media reader 102. Such a reader may be configured to accept and read/verify paper currency and/or other media, such as tickets or cash vouchers. Gaming machine 100 may further be configured with one or more paper currency or ticket storage devices, such as cash boxes, and other paper currency or media handling devices (including transport devices).

The gaming machine 100 might also be configured to read FOBs, magnetic stripe cards or other media having data associated therewith and via which value or funds may be associated with the gaming machine 100. The gaming machine 100 might also be configured to receive information regarding funds associated with a player financial account, such as funds associated with a player casino deposit account or bank account, which account information might be stored elsewhere, such as in association with a casino accounting system.

In one embodiment, the gaming machine 100 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 100 dispensing coins to a coin tray 103. In another embodiment, funds may be issued by dispensing paper currency. In yet another embodiment, a player may be issued a media, such as a printed ticket, which ticket represents the value that was paid or cashed out of the machine. The aspects of gaming machine "ticketing" systems are well known. The gaming machine 100 may also include a player-tracking device, such as a card reader 104 and associated keypad 105. Such player tracking devices are well known and may permit the game operator to track play of players of the gaming machine. The tracked play may be utilized to offer player bonuses or awards.

Gaming machine 100 may also have a secondary display, top glass 106 or the like, which secondary feature may be configured to display a base game, bonus event or other game information. For example, a gaming machine 100 may be configured to display a base game on a main display 120 thereof and may include a top box or topper that has a top glass 106 and/or an associated display (such as a video display and/or physical reels) that is configured to display a bonus event. A casino may have numerous such gaming machines 100, such as located on a casino floor or in other locations. Of course, such gaming machines 100 might be used in other environments, such as an airport, bar, restaurant, store, tavern, or other suitable locations.

It will be appreciated that the gaming machine 100 illustrated in FIG. 1 is only exemplary of one embodiment of a gaming machine. For example, it is possible to for the gaming machine to have various other configurations, including different shapes and styles, and having different components than as just described. For example, it is possible for the game of the invention to be presented on a computing device, including at a home or office computer. In one embodiment, a player might log in to a casino server and the controller of the casino server may cause game information to be delivered to the player's computer and then be displayed on a display of the player's computer. In this regard, it will be noted that the term "controller" may comprise more than one device. For example, in a server-based environment, a controller at a server may generate game information and transmit that information to a local controller at a gaming machine. The local controller at the gaming machine may then cause game information to be displayed on the display of the gaming machine. The games of the invention could also be presented by or at hand-held devices, such as PDAs, cellular phones, tablet computing devices or the like. It is specifically contemplated that the disclosed embodiments may apply to all such alternative types of gaming machines, either directly or through routine extrapolation as will be appreciated by one of skill in the art.

Figure 1B:
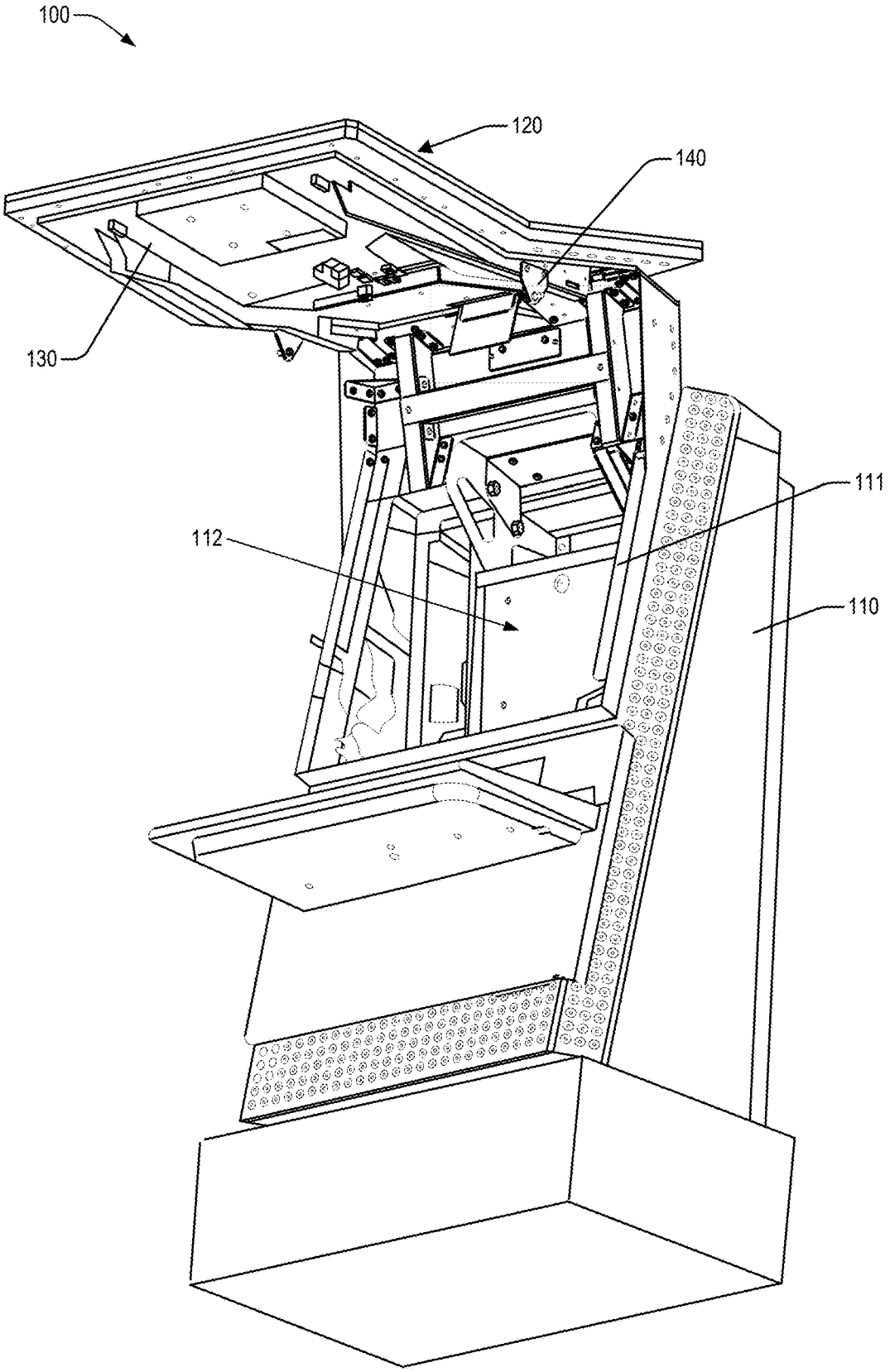
FIG. 1B illustrates in lower front perspective view an exemplary gaming machine with its main door in an open position.

Moving next to FIG. 1B, an exemplary gaming machine with its main door moved into an open position is illustrated in lower front perspective view. Again, gaming machine 100 can include a cabinet 110, a display device 120, and various other traditional EGM components. Display device 120 can be included on a main door assembly 130, which can be movable between the closed position shown in FIG. 1A and the open position shown in FIG. 1B. A hinge 140 or other similar component can be configured to facilitate movement of the main door assembly 130. Such a hinge 140 may also provide support to the main door assembly. As can be seen in FIG. 1B, cabinet 110 can have an entry 111 or other opening that provides access to an interior region 112 within the cabinet 110. This entry 111 is blocked when the main door assembly 130 is at a closed position, such as that which is shown in FIG. 1A, and is accessible when the main door assembly 130 is at the open position shown in FIG. 1B. Hinge 140 can provide a rotational movement of the main door assembly 130 about a pin or other hinge axis component, such that the main door assembly effectively pivots upward during an opening movement of the main door assembly 130. As noted above, such a relatively simple pivoting upward movement of a gaming machine door assembly can have drawbacks that may limit the design potentials for the gaming machine.

Figure 1C:
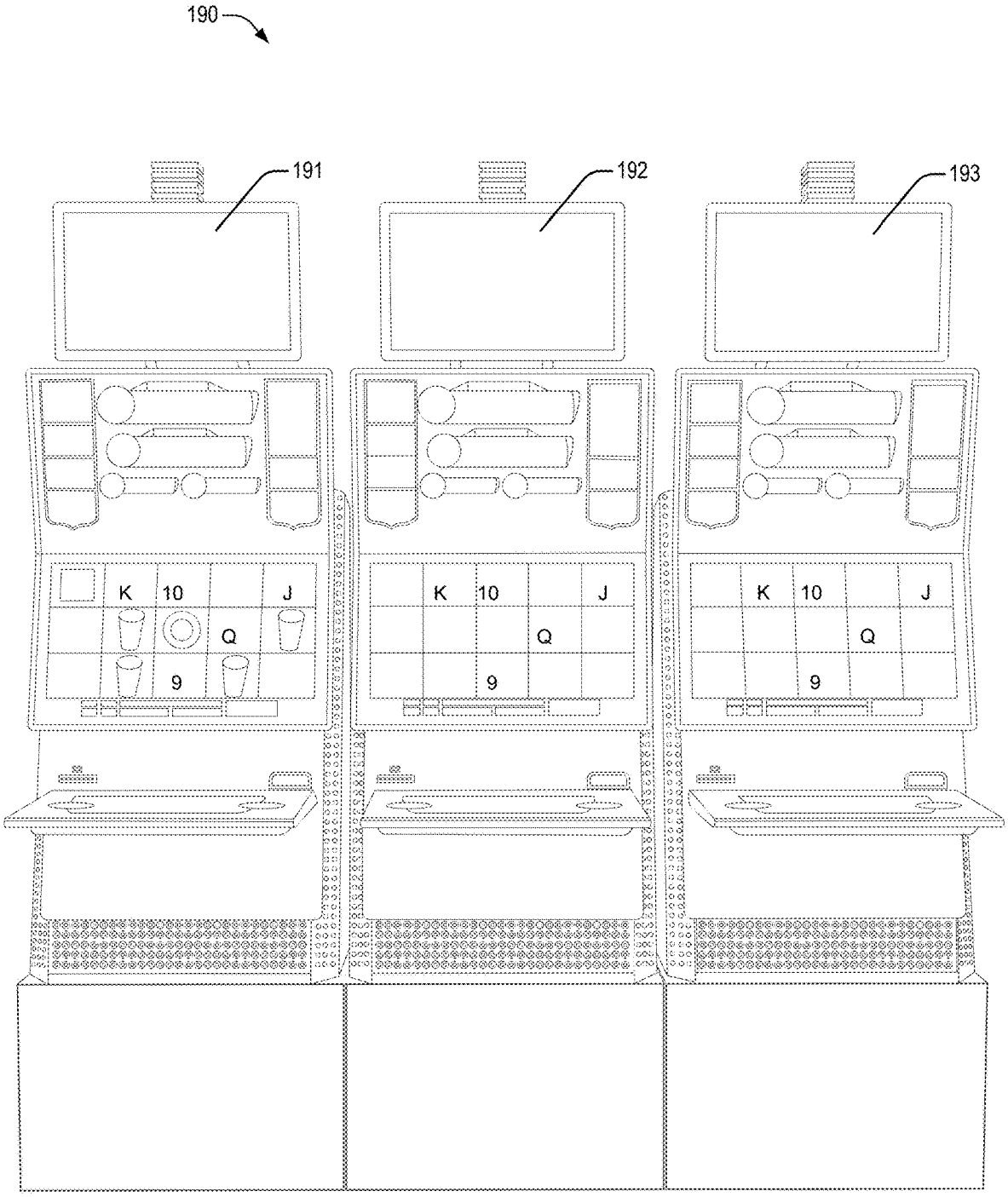
FIG. 1C illustrates in front elevation view a bank of multiple gaming machines deployed at a gaming establishment.

FIG. 1C illustrates in front elevation view a bank of multiple gaming machines deployed at a gaming establishment. Exemplary gaming machine bank 190 can include multiple gaming machines, such as gaming machines 191, 192, 193, as shown. Additional gaming machines may also be included in a gaming machine bank 190, which may be located on the gaming floor of a casino, within a retail establishment, or any other place that provides gaming machines for play. Gaming machine bank 190 may be arranged such that each of gaming machines 191, 192, 193 is up against a wall of the casino or other establishment, such that only the front of the gaming machine is readily accessible to players, operators of the establishment, or maintenance technicians. As noted above, gaming machines that are arranged in a manner such as for gaming machine bank 190 can be particularly difficult to service if there is any need to access either side of the gaming machine, the back of the gaming machine, or the general space at the sides or back of the gaming machine. Accordingly, superior gaming machine designs will allow for the servicing of gaming machines without moving the gaming machines, even when such gaming machines are arranged such as in gaming machine bank 190.

Figure 2A:
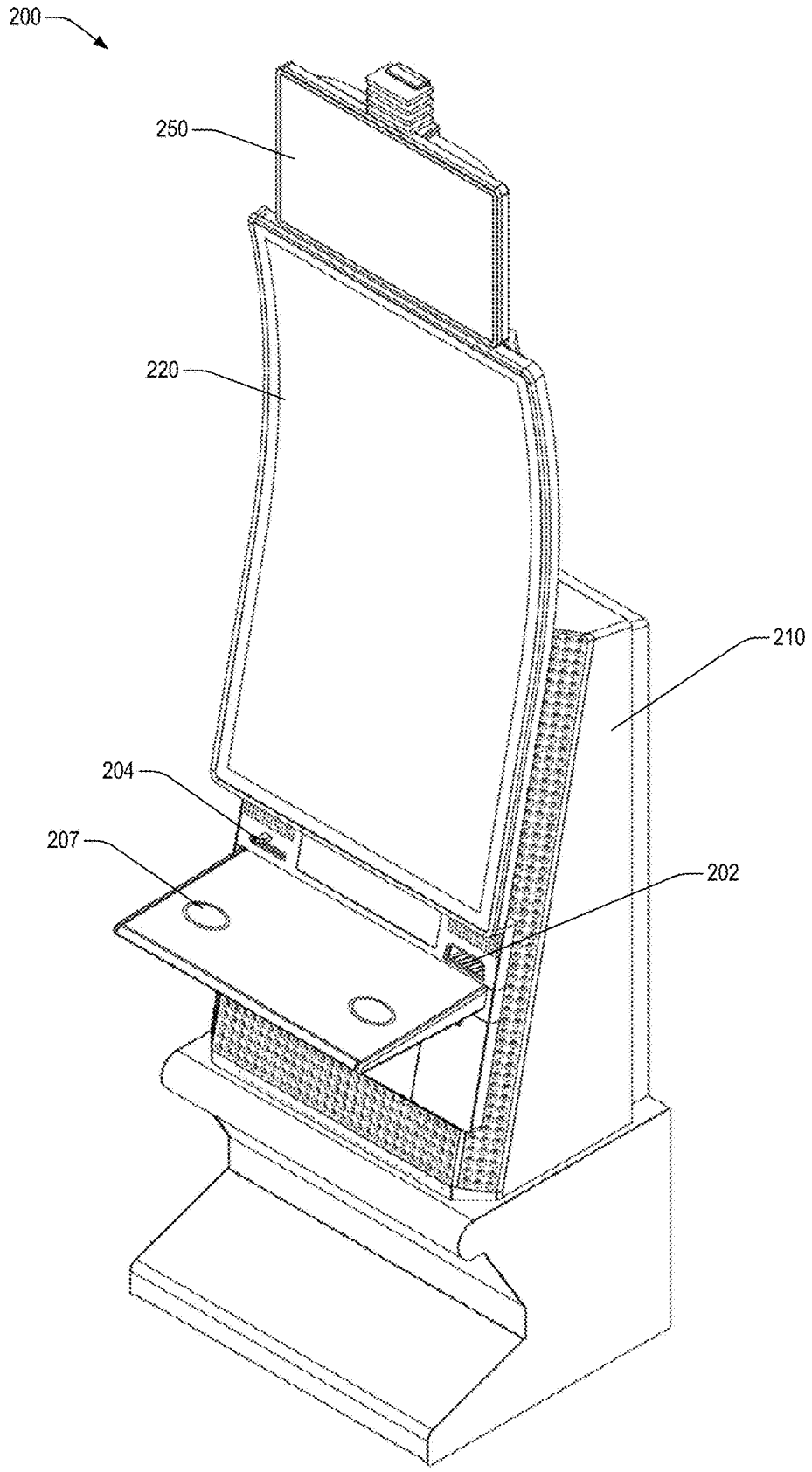
FIG. 2A illustrates in front perspective view an exemplary gaming machine having improved servicing and mounting features for display screens and toppers according to one embodiment of the present disclosure.

Turning now to FIG. 2A an exemplary gaming machine having improved servicing and mounting features for display screens and toppers is illustrated in front perspective view. Gaming machine 200 can be similar in function and appearance with respect to gaming machine 100 of the foregoing example. For example, gaming machine 200 can similarly include a currency/media input reader 202, printer 204, input devices 207, cabinet 210, and a curved display device 220, among other same or similar features. As in the foregoing example of gaming machine 100, gaming machine 200 can similarly include at least one microprocessor-based controller or CPU microprocessor or controller for controlling the gaming machine 200, including receiving player input and sending output signals for controlling the various components of the gaming machine 200. The controller may be the primary or only game determination component configured to facilitate the result of a wager-based game played at the gaming machine 200. Other details regarding the processor and control of the gaming machine 200 can be the same or substantially similar to the foregoing details for gaming machine 100.

In addition to the foregoing, gaming machine 200 can also include a topper 250 located directly above and next to the curved display device 220. As can be seen, the location of the topper 250 directly next to the upper edge of the curved display device 220 can effectively frustrate traditionally simple mechanisms used to hinge or otherwise move the display device to provide internal access. For example, the hinged upward movement of the main door assembly for gaming machine 100 shown in FIG. 1B would not work for gaming machine 200 due to the close proximity between the upper edge of the curved display device 220 and the lower edge of the topper 250. This particular design arrangement can also frustrate traditional methods of servicing the topper 250. Accordingly, gaming machine 200 can also include a specialized main door support assembly (not shown) located behind the curved display device 220, as well as a specialized topper support leg and bracket combination (not shown) that is used to mount the topper 250 to the cabinet 210. As noted above, the main door support assembly can facilitate an outward and then upward movement of curved display device 220, while the topper support leg and bracket combination can facilitate multiple different positions for the topper 250 that are all supported by the cabinet 210. It is contemplated that these specialized components may be used separately for a given gaming machine, or in combination such as for gaming machine 200. Various details for both of these specialized components are provided in separate sections below.

Figure 2B:
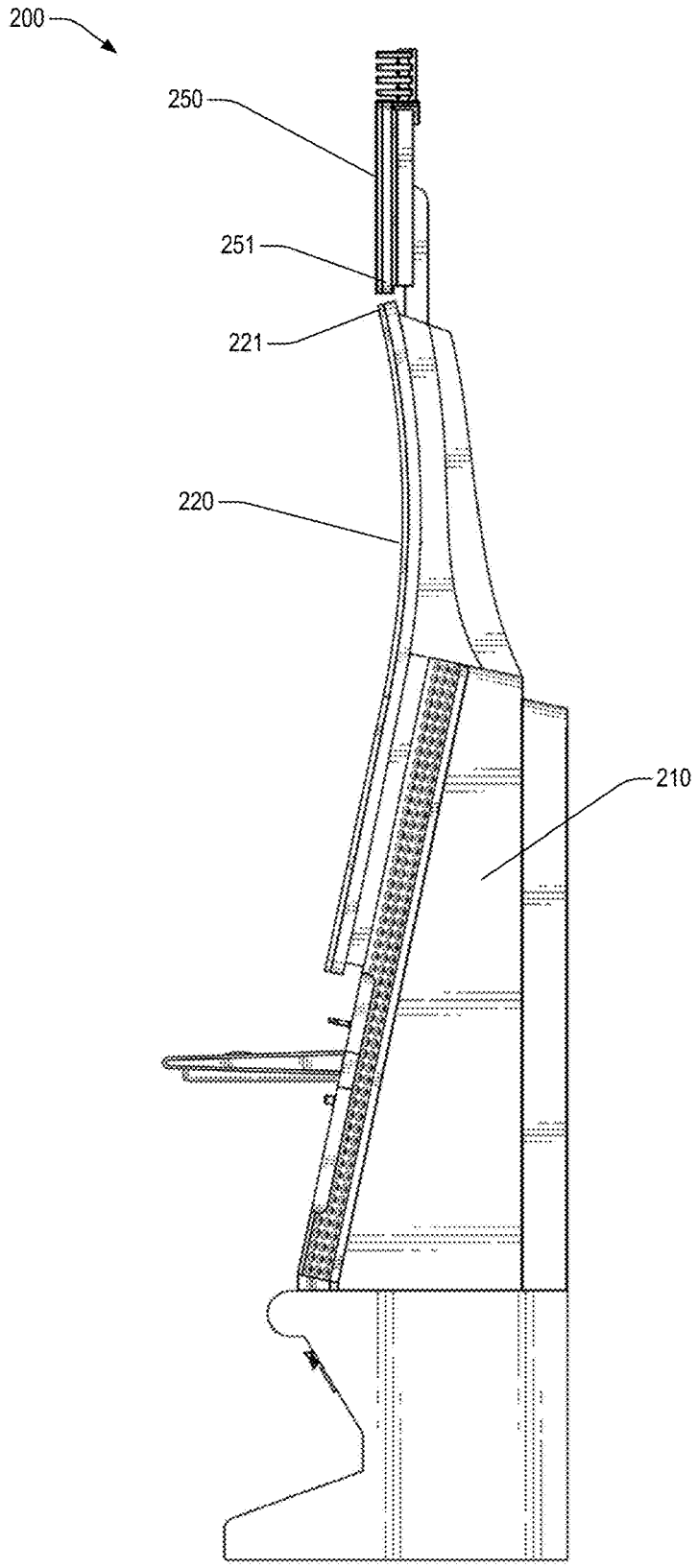
FIG. 2B illustrates in side elevation view an exemplary gaming machine having improved servicing and mounting features for display screens and toppers according to one embodiment of the present disclosure.

FIG. 2B illustrates in side elevation view an exemplary gaming machine having improved servicing and mounting features for display screens and toppers. Gaming machine 200 is depicted here in a different view, and again includes a cabinet 210, a curved display device 220, a topper 250, and other identical components. Curved display device 220, which can include the primary display screen of gaming machine 200, can be part of a main door assembly that is movably coupled to the cabinet 210. As shown, the main door assembly including curved display device 220 is in a closed position such that access to an interior of cabinet 210 is not available. When in the closed position as shown, the main door assembly can be locked or otherwise secured to prevent unauthorized access to the interior of the gaming machine behind the main door assembly, as will be readily appreciated. As can be seen from this side elevation view, the entire top edge 221 of the curved display device 220 is in very close proximity to the entire bottom edge 251 of the topper 250 when the main door assembly is closed. In some embodiments, the space between this curved display top edge 221 and topper bottom edge 251 can be about 0.5 cm or less. In some embodiments, the topper may even contact the curved display along these edges. With such a tight spacing in this particular gaming machine design, it will be readily appreciated that a simple hinged upward motion of the main door assembly is not possible due to interference between the topper and the curved display. Another type of movement for the main door assembly is thus necessary.

Figure 2C:
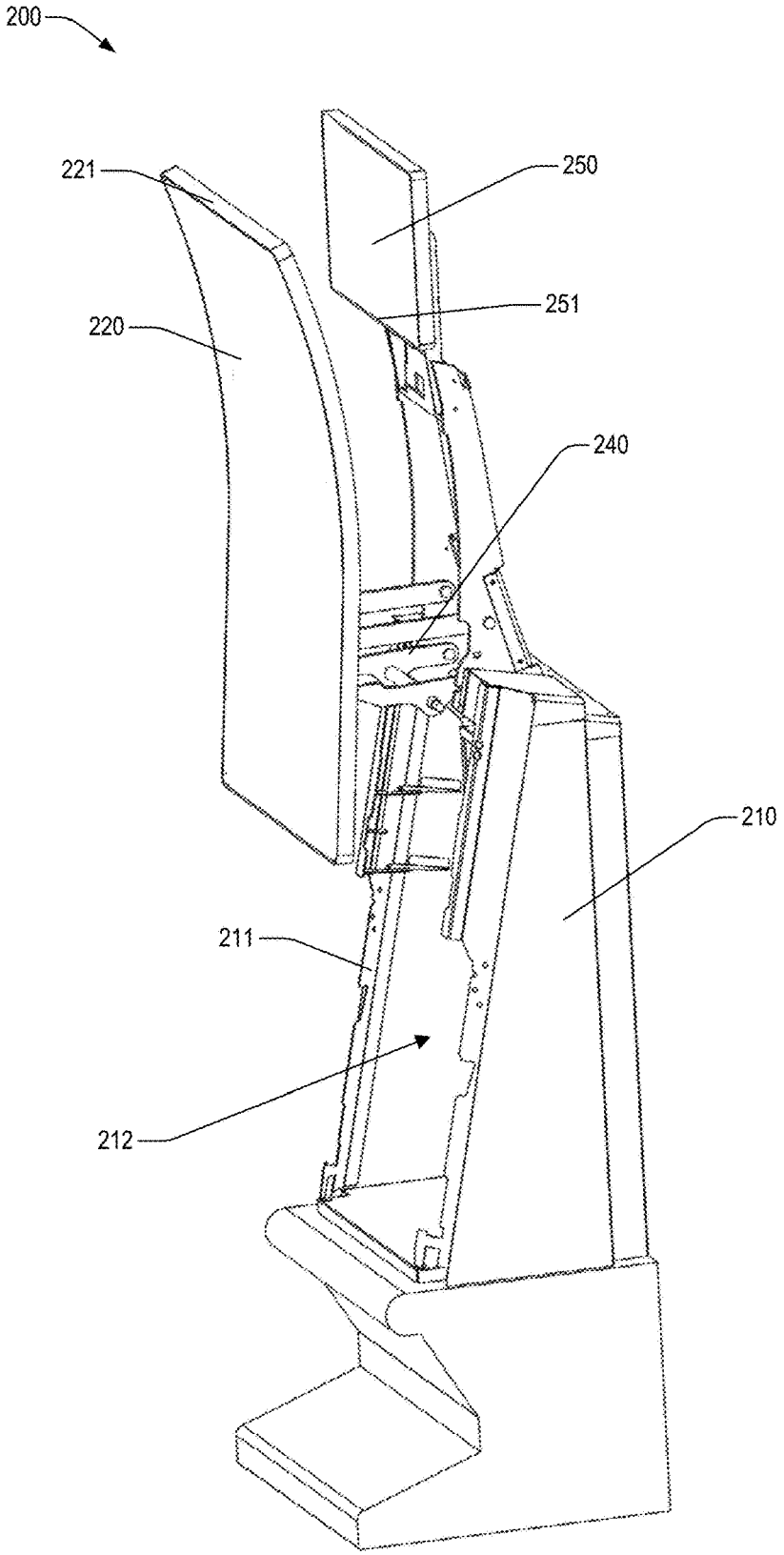
FIG. 2C illustrates in side perspective view an exemplary gaming machine having improved servicing and mounting features for display screens and toppers with its main door in an open position according to one embodiment of the present disclosure.
Figure 2D:
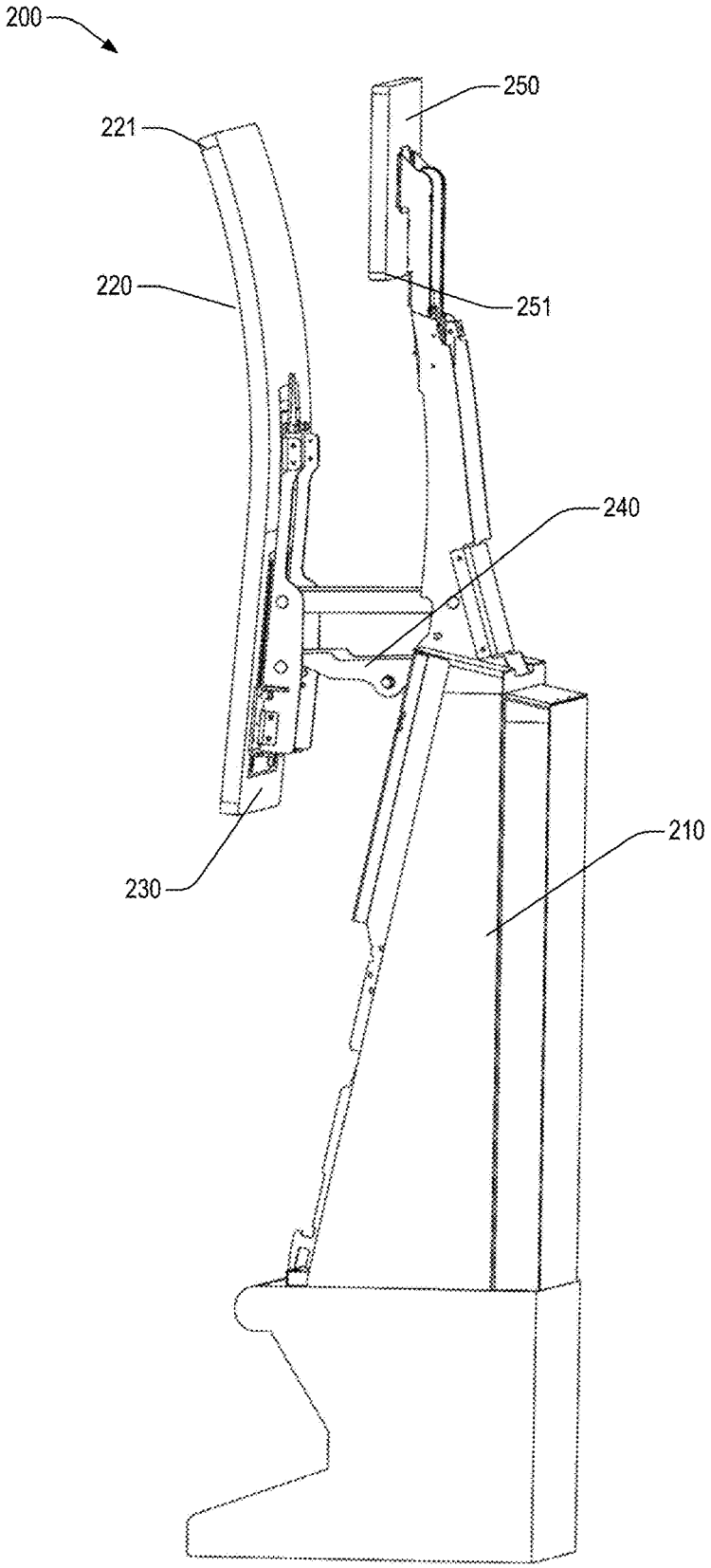
FIG. 2D illustrates in rear perspective view an exemplary gaming machine having improved servicing and mounting features for display screens and toppers with its main door in an open position according to one embodiment of the present disclosure.

Continuing with FIGS. 2C and 2D, an exemplary gaming machine having improved servicing and mounting features for display screens and toppers with its main door in an open position is shown in side perspective view in FIG. 2C and in rear perspective view in FIG. 2D. Gaming machine 200 includes a cabinet 210, a curved display device 220 that is part of a main door assembly 230, a main door support assembly 240, and a topper 250, among other components. As noted above, main door assembly 230 is movably coupled to the cabinet 210. Movement of the main door assembly 230, which includes curved display device 220 having a display screen, can be facilitated by the main door support assembly 240. As shown in FIGS. 2C and 2D, the main door assembly 230 including curved display device 220 is in a fully open position such that access to an interior 212 of cabinet 210 is available through an exposed entry 211 in cabinet 210.

While the curved display top edge 221 and the topper bottom edge 251 were in close proximity or even in contact when the main door assembly 230 was closed in the foregoing figures, it can be seen that this top edge 221 has moved outward and upward away from the bottom edge 251. Unlike the hinge 140 in gaming machine 100 above, main door support assembly 240 is a more complex component that facilitates a specialized movement of the main door assembly 230. In particular, the main door support assembly 240 can include a four-bar linkage that facilitates an opening movement of the main door assembly 230, where the opening movement includes the main door assembly 230 moving outward from the closed position of FIGS. 2A and 2B, and then upward to arrive at the open position of FIGS. 2C and 2D. A closing movement of the main door assembly can simple be the reverse of the opening movement. Specific details regarding the specialized main door support assembly 240 are provided in a separate section below.

In addition to the specialized main door support assembly 240, gaming machine 200 can also include a specialized topper 250 having multiple positions that are all supported by the cabinet. These multiple positions can include at least a final installed position, as shown in FIGS. 2A-2D, as well as an intermediate service position. Although gaming machine 200 includes both the specialized main door support assembly 240 and the specialized topper 250, it is contemplated that various embodiments may include only one or the other of these specialized components. Specific details regarding the specialized topper 250 having an intermediate service position are provided in a separate section below after the main door support assembly section.

Main Door Support Assembly

Figure 3:
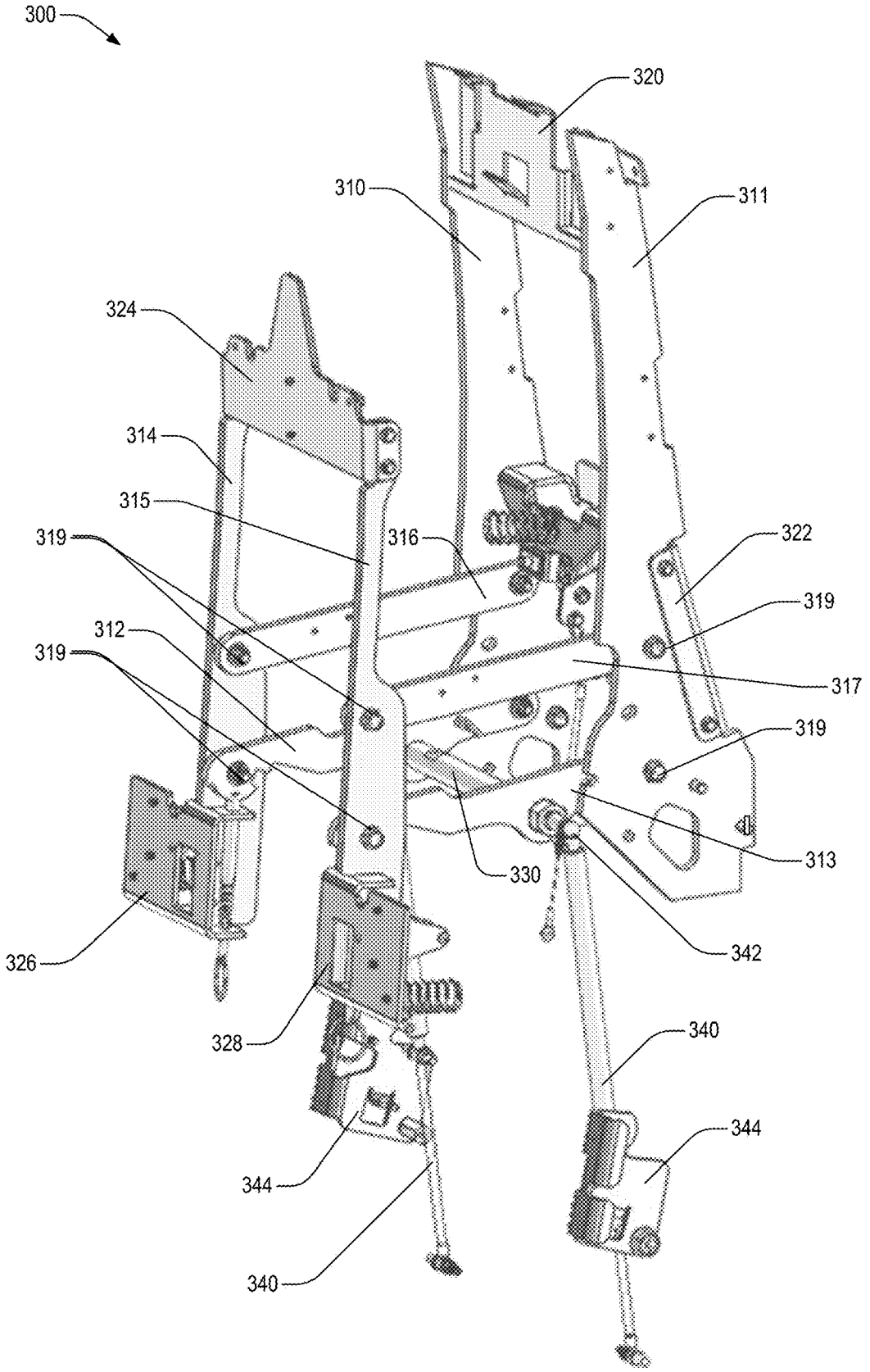
FIG. 3 illustrates in side perspective view an exemplary main door support assembly for a gaming machine according to one embodiment of the present disclosure.

Focusing first on the specialized movement of the main door assembly that includes a curved display screen, FIG. 3 illustrates in side perspective view an exemplary main door support assembly for a gaming machine according to one embodiment of the present disclosure. For a gaming machine design that includes a topper directly above and abutting or close to the primary display screen, such as in the design of gaming machine 200 above, it can be desirable to have a mechanism that moves a door assembly including the display screen outward and then upward, such that the display screen does not hit or interfere with the topper as it is moved. It is also desirable that this mechanism be stable and not induce wobble, but rather provides smooth movement of the door assembly including display screen. Further, it can be preferable to account for the various internal cables to be held out of the way as the assembly including the display screen moves from a closed position to open position. These objectives can all be achieved using the specialized main door support assembly 300 shown in FIG. 3.

In various embodiments of the present disclosure, main door support assembly 300 can comprise a four-bar linkage that functions to move a main door assembly including a display screen outward first, so as to not interfere with a topper mounted above the display screen, and then upward to open the main door assembly for servicing within an interior of the cabinet behind the main door assembly. A stabilizing strut 330 or similar member can pass through two of the components in the four-bar linkage in order to facilitate smooth movements of the main door support assembly 300 by preventing wobble and other unstable activity. The stabilizing strut 330 can also provide mounting locations for components that supply force in order to move the main door support assembly 300, and can also provide a routing path for electrical cables coupled to the display screen during movement of the main door support assembly.

Various components of the main door support assembly 300 can combine to form a crank-rocker four-bar linkage. As is generally known, a four-bar linkage can include an A-link, a B-link, a C-link, and a D-link In the case of a crank-rocker linkage, these A-D links correspond to a ground link, an input (i.e., "rocker") link, an output (i.e., "crank") link, and a float link. For the main door support assembly 300 shown in FIG. 3, each of the four links is formed by multiple components. In particular, each link is formed by multiple flat identical components arrangement into parallel planes. For example, identical flat link components 310 and 311 are arranged into parallel planes and combine to form the ground link (i.e., A-link) of the crank-rocker four-bar linkage. Similarly, identical flat link components 312 and 313 are arranged into the same parallel planes and combine to form the input link (i.e., B-link) Identical flat link components 314 and 315 then form the output link (i.e., C-link), and identical flat link components 316 and 317 form the float link (i.e., D-link) As shown, flat link components 310, 312, 314, and 316 are all arranged into a first plane, while flat link components 311, 313, 315, and 317 are all arranged into a second plane that is parallel to the first plane. Various pins, bolts, or other connectors 319 couple all of these flat link components 310-317 together in a manner that allows rotational movement about the connectors 319 during movement of the four-bar linkage, as will be readily appreciated.

Various mounting and stabilizing brackets or components can be coupled to and positioned between identical flat link component pairs to provide offset distances and structural stability, and to allow for the mounting of other components to the main door support assembly 300. For example, mounting brackets 320 and 322 couple to and provide stability to the identical flat link component pair 310 and 311 forming the ground link of the four-bar linkage. As shown, mounting brackets 320 and 322 can be somewhat flat as well, and are aligned in planes that are effectively orthogonal to the parallel first and second places defined by the flat link components 310-317. Similarly, mounting brackets 324, 326, and 328 can couple to the identical flat link component pair 314 and 315 forming the output link of the four-bar linkage. While mounting bracket 324 provides an offset distance and structural stability to flat link component pair 314, 315, mounting brackets 326 and 328 only provide for the mounting of another component to the output link of the four-bar linkage. Stabilizing strut 330 can also provide structural stability to the four-bar linkage during movement, particularly with respect to the input link (i.e., flat link component pair 312 and 313).

In various embodiments, the ground link (i.e., flat link component pair 310 and 311) can be mounted to the cabinet of the gaming machine, such as by way of mounting brackets 320 and 322, while the output link (i.e., flat link component pair 314 and 315) can be mounted to the main door assembly of the gaming machine, such as by way of mounting brackets 324, 326, and 328. As will be appreciated, this can result in the ground link, which is mounted to the cabinet, remaining stationary while the output link, which is mounted to the main door assembly, moves during operation of the four-bar linkage. The specific range of motion for the output link, and thus the main door assembly, can be controlled through consideration of the various dimensions of the flat link components 310-317. For example, setting the length of the output link to be less than the length of the ground link can result in the output link rotating in a manner that results in the output link initially moving outward and then moving upward. As will be readily appreciated by those of skill in the art, the effective length for each link is the distance between the connectors 319 located on the link. For example, this distance between connectors 319 on the ground link is relatively short, while this distance between connectors on the input link is relatively long. Similarly, the distance between connectors 319 on the output link is relatively short, while the distance between connectors 319 on the float link is relatively long.

While there are different types of four-bar linkages, the crank-rocker four-bar linkage with the links having the relative lengths shown in FIG. 3 can result in an output (i.e., crank) link that is able to rotate a full 360 degrees and an input (i.e., rocker) link that can rotate through a limited range of angles that does not include 0 degrees or 180 degrees as measured from a vertical datum. Although such a range of angles is theoretically possible for a typical crank-rocker four-bar linkage, the specific arrangement shown for the main door support assembly 300 of FIG. 3 does not allow such a full range of movement. Rather, the various gaming machine components, such as the cabinet and the main door assembly to which the main door support assembly are mounted, are dimensioned such that the range of motion for this specific arrangement is from about 24 degrees to about 155 degrees as measured from a vertical datum with respect to the overall gaming machine. The various dimensioned components of gaming machine 200 depicted above then results in a smooth overall trajectory of the main door assembly from a fully closed position (i.e., 24 degrees) to a fully open position (i.e., 155 degrees). In addition, the disclosed arrangement results in the main door assembly, and thus the curved display screen, remaining in a substantially vertical orientation during the entire range of motion from open to closed.

Gas springs 340 can be mounted proximate the distal ends of the stabilizing strut 330 at mounting locations 342, with each gas spring 340 being configured to deliver an input force at a distal end of the stabilizing strut 330. Mounting brackets 344 located proximate the opposite ends of each gas spring 340 can mount the gas springs 340 to the gaming machine cabinet or another stable gaming machine component. The input forces delivered by the gas springs 340 to the stabilizing strut 330 then drive the movement of the input link, such that the corresponding movements of the entire four-bar linkage, the main door support assembly, and the main door assembly having the display screen then follow.

Figure 4A:
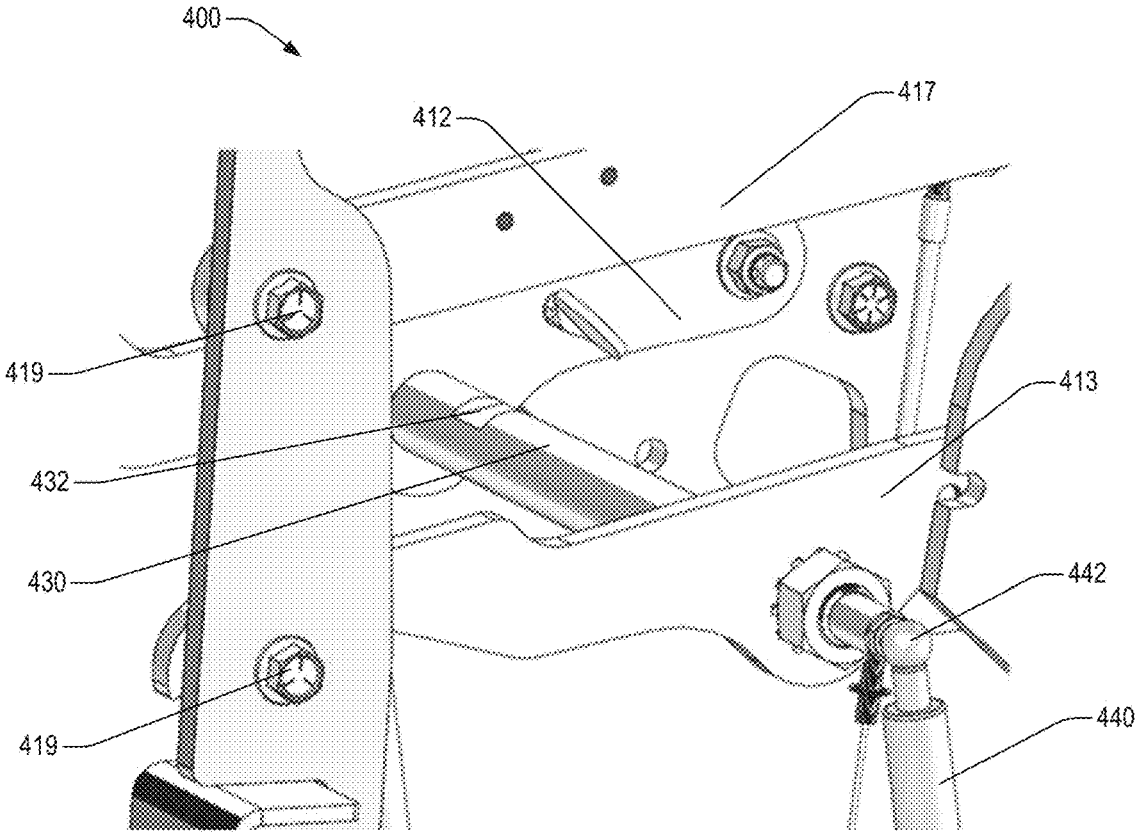
FIG. 4A illustrates in side perspective view a close-up of a region of an exemplary main door support assembly including a stabilizing strut according to one embodiment of the present disclosure.

Turning next to FIG. 4A, a close-up of a region of an exemplary main door support assembly including a stabilizing strut is shown in side perspective view. Only a close-up portion of main door support assembly 400 is shown in FIG. 4A, with the same components as noted above. For example, flat link components 412, 413 and 417 form portions of an input link and a float link for a crank-rocker four-bar linkage. Connectors 419 rotationally couple different links in the four-bar linkage, while gas springs 440 are mounted to stabilizing strut 430 at mounting locations 442 to provide an input force to the input link 412, 413 of the four-bar linkage. As shown, stabilizing strut 430 can be an elongated member having distal ends and defining a longitudinal axis. The longitudinal axis of stabilizing strut 430 can be orthogonal to the two parallel planes defined by the flat link components 412, 413, 417, and the mounting locations 442 can be located at the distal ends of stabilizing strut. As noted above, stabilizing strut 430 provides stability to the overall four-bar linkage, particularly with respect to the input link 412, 413. As such, stabilizing strut 430 can be formed of a strong rigid material, such as a metal bar. Stabilizing strut 430 also includes a notch 432 or other similar feature to provide a routing path for one or more electrical cables (not shown) coupled to the display screen during movements of the main door support assembly.

Figure 4B:
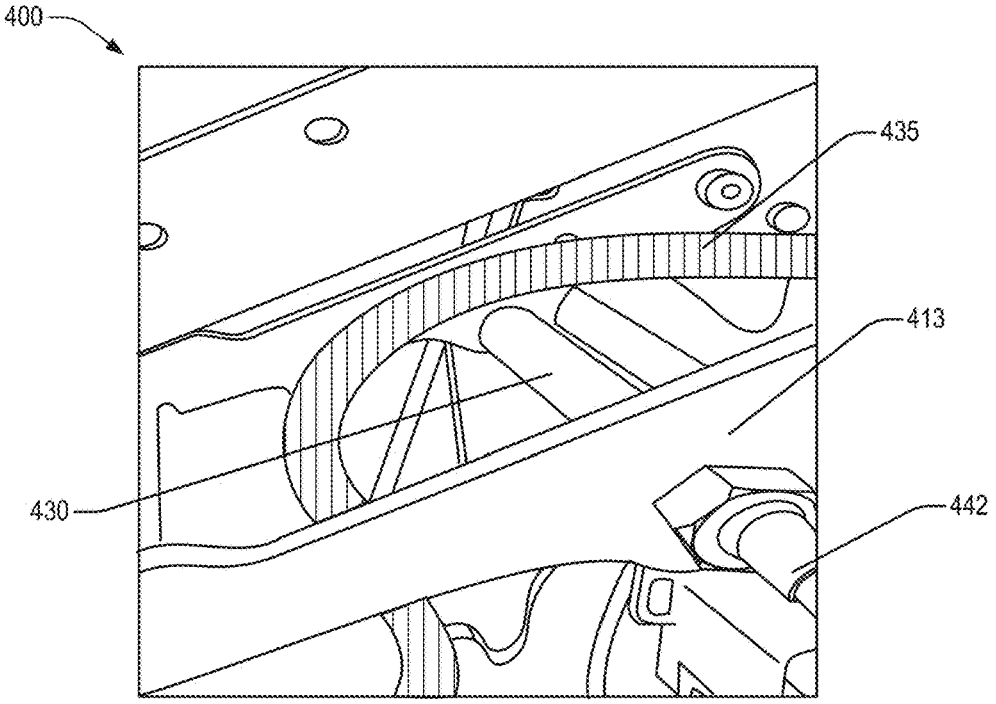
FIG. 4B illustrates in side perspective view an electrical cable routed over the stabilizing strut of FIG. 4A according to one embodiment of the present disclosure.

As will be appreciated, a display screen will typically have wired connections from the display screen to processing components at an interior of a gaming machine. Accounting for such electrical cables can be a nuisance or cumbersome during servicing of a gaming machine. Even movement of a main door assembly having a display screen can involve a need to manage the electrical cables running from the screen to the main door a to the gaming machine interior. Failure to adequately manage such cables can result in damage or other unwanted problems. FIG. 4B shows in side perspective view an electrical cable routed over the stabilizing strut of FIG. 4A. Electrical cable 435 can be one or more electrical cables, such as in a common cover or harness, that are used for power and communications between the curved display and processing components within the interior of the gaming machine. Electrical cable 435 follows the routing path provided by notch 432 in stabilizing strut 430. When the stabilizing strut 430 moves with the entire main door assembly during opening and closing movements, the stabilizing strut 430 lifts the electrical cable 435, which then moves with the stabilizing strut and does not dangle into an open space or otherwise get in the way of a technician providing maintenance with the main door assembly open.

Figure 5:
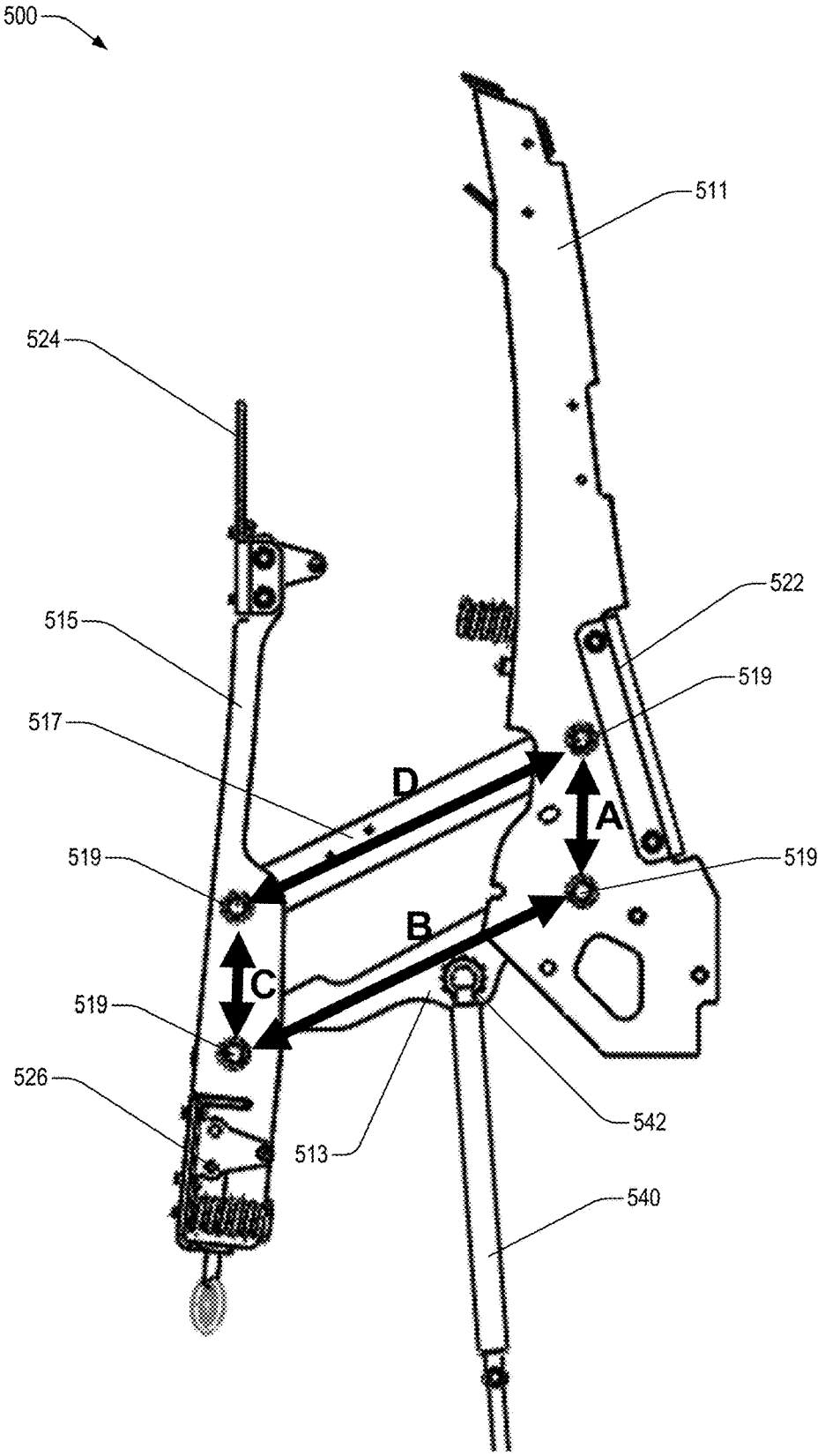
FIG. 5 illustrates in side elevation view an exemplary main door support assembly for a gaming machine according to one embodiment of the present disclosure.

Continuing with FIG. 5, an exemplary main door support assembly for a gaming machine is illustrated in side elevation view. Main door support assembly 500 includes the same components as for main door support assembly 300 above. Flat link components 511, 513, 515, and 517 are all arranged into the same plane, which is parallel to a plane having corresponding flat link components directly behind these. Links A, B, C, and D of the formed four-bar linkage are emphasized in FIG. 5, and correspond to flat link components 511, 513, 515, and 517 respectively. Flat link components 511, 513, 515, and 517 are rotationally coupled by connectors 519, which effectively form the end points for the links of the four-bar linkage. For example, the effective length of link A is the distance between both connectors 519 located on link A (i.e. flat link component 511). Mounting brackets 519 can be used to mount the main door support assembly 500 to the cabinet or another firm component of the gaming machine, while mounting brackets 524, 526 can be used to mount the main door support assembly 500 to the main door assembly of the gaming machine. Gas springs 540 provide an input force to drive the four-bar assembly at gas spring mounting locations 542.

It will be readily appreciated that adjusting the lengths of the A, B, C, and D links controls the range of motion for the output link C (i.e., flat link component 515) while the ground link A (i.e., flat link component 511) remains in place. For example, when the effective length of output link C is set to be shorter than the effective length of ground link A, then the range of motion of output link C (i.e., the coupled main door assembly and display screen) is initially outward and then upward. Varying the relative effective lengths of each of the A, B, C, D links in different ways can control the range of motion of the output link C to move between closed and open positions in exactly the manner desired.

FIGS. 6A-6E illustrate in side elevation view various positions of an exemplary main door support assembly for a gaming machine during an opening movement of the main door support assembly. For reference, the main door support assembly shown in these different positions is the same main door support assembly as that which is shown in FIGS. 3 and 5 above. The five different positions shown in FIGS. 6A-6E simply represent a starting point, three midway points, and an endpoint for the full range of motion of the main door assembly according to the specific designation of link lengths and arrangement of components in the exemplary gaming machines disclosed herein. It will be readily appreciated that there are many more midway points in this full range of motion that are not shown here. Again, the main door assembly, including the curved display screen, is mounted to the output link (i.e., C-link), such that the position and angle of this link component effectively represents the position and angle of the curved display screen during the range of movement.

Figure 6E:
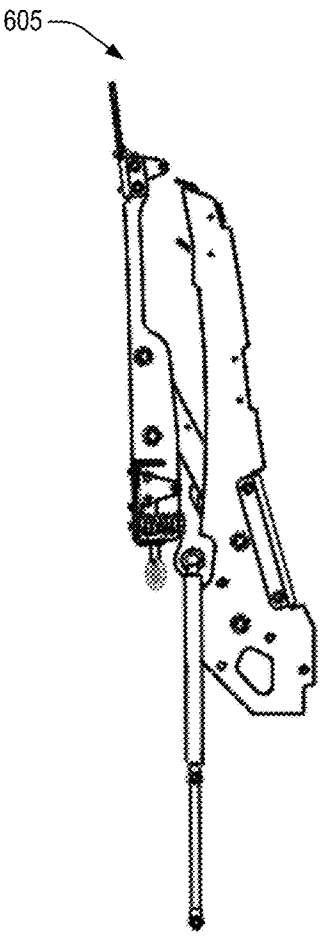
FIGS. 6A-6E illustrate in side elevation view various positions of an exemplary main door support assembly for a gaming machine during an opening movement of the main door support assembly components according to one embodiment of the present disclosure.
Figure 6D:
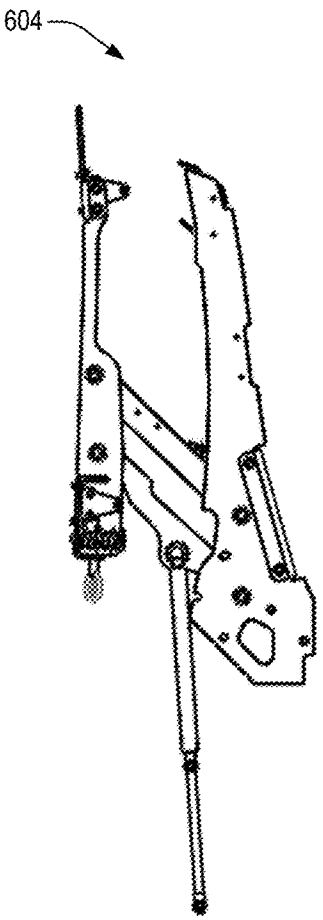
Figure 6C:
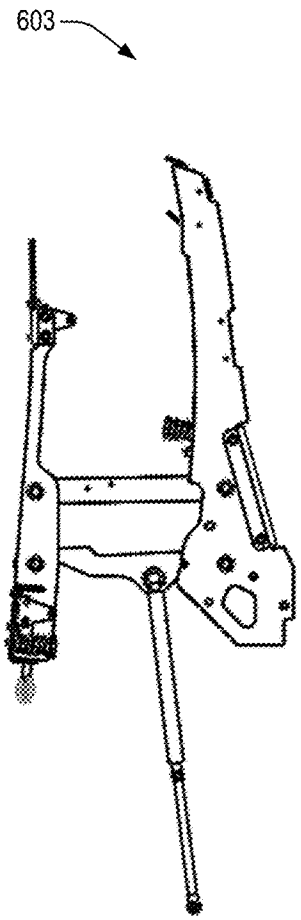
Figure 6B:
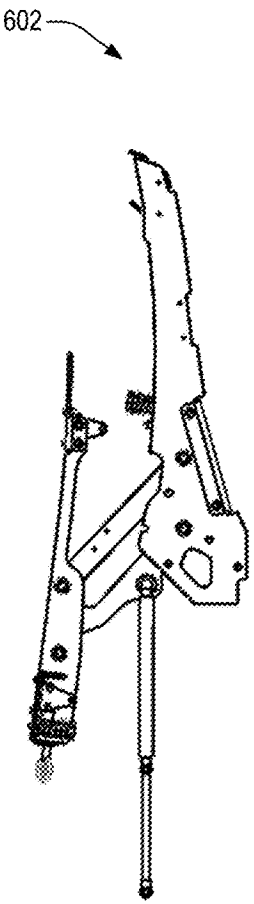
Figure 6A:
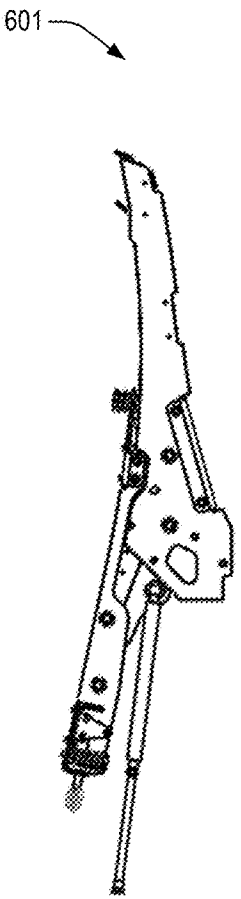

FIG. 6A depicts position 601 of the main door support assembly when the main door assembly is in a closed position. As shown, the angle of the input link (i.e., B-link) with respect to a vertical datum is about 24 degrees. FIG. 6B depicts position 602 of the main door support assembly after the main door assembly has begun to open, and the angle of the input link with respect to the vertical datum is now about 45 degrees. FIG. 6C depicts position 603 of the main door support assembly after the main door assembly has continued to open, and the angle of the input link with respect to the vertical datum is now about 90 degrees. FIG. 6D depicts position 604 of the main door support assembly after the main door assembly is almost fully open, and the angle of the input link with respect to the vertical datum is now about 135 degrees. Finally, FIG. 6E depicts position 605 of the main door support assembly after the main door assembly is fully open, and the angle of the input link with respect to the vertical datum is now about 155 degrees. Of course, many other ranges of motion and input link angles are also possible, and it will be understood that the figures here represent just one illustrative example of many possible start points, ranges of motion, and end points for a main door support assembly as disclosed herein.

Figure 7C:
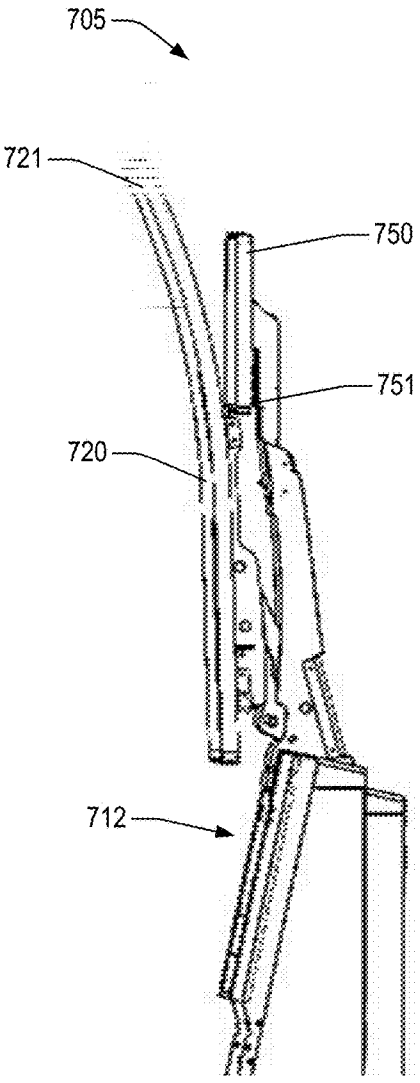
FIGS. 7A-7C illustrate in side elevation view various relative positions of an exemplary topper and movable main door assembly having a display screen for a gaming machine during an opening movement of a main door support assembly according to one embodiment of the present disclosure.
Figure 7B:
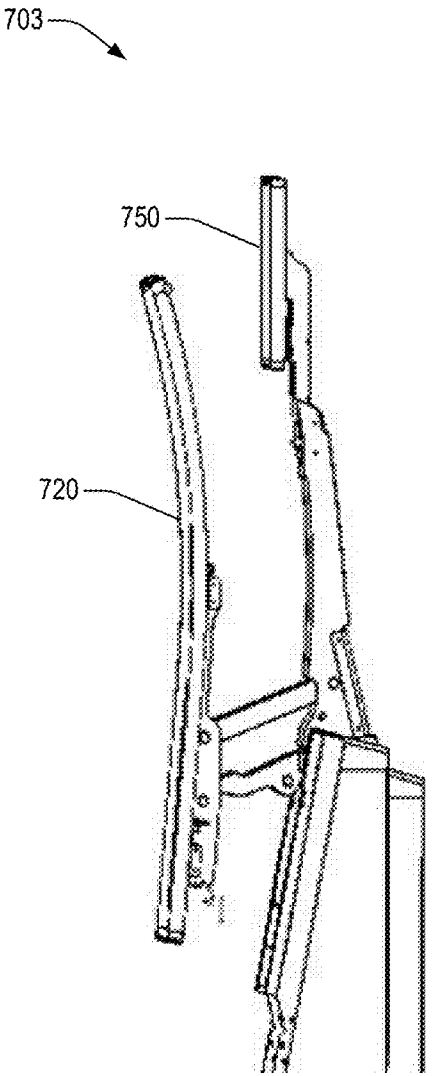
Figure 7A:
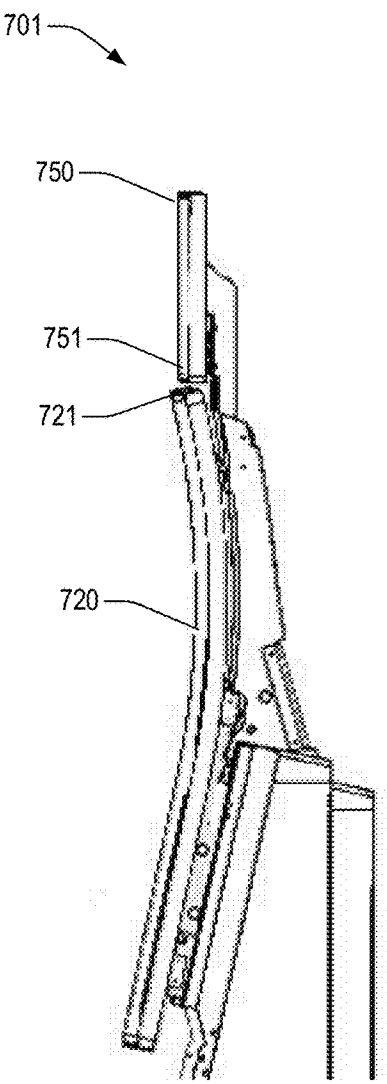

Continuing with FIGS. 7A-7C, various relative positions of an exemplary topper and movable main door assembly having a display screen for a gaming machine during an opening movement of a main door support assembly are shown in side elevation view. FIGS. 7A-7C are similar to FIGS. 6A-6E, except that these figures show what the outside of the gaming machine looks like during a main door opening process, while the previous figures only show what the underlying main door support arrangement looks like during a main door opening process. FIG. 7A depicts position 701 of a gaming machine when the main door assembly is in a closed position, and this figure generally corresponds to FIG. 6A of the foregoing example. As shown, when the main door is in the closed position, the curved display 720 is directly below the topper 750, and there is very little space (<1 cm) between the top edge 721 of the curved display 720 and the bottom edge 751 of the topper. FIG. 7B depicts position 703 of a gaming machine when the main door assembly is being opened. Here, the main door assembly with curved display 720 has initially come outward and is now starting to move upward. The edges of the curved display and the topper have cleared each other with no interference during the first part of the door opening movement. As shown, the screen of the curved display 720 generally remains substantially vertical at a closed position, open position, and all positions in between during movement of the main door assembly. FIG. 7C depicts position 705 of a gaming machine when the main door assembly is in a fully open position, and this figure generally corresponds to FIG. 6E of the foregoing example. As shown, when the main door is in the fully open position, the top edge 721 of the curved display 720 has cleared and is far away from the bottom edge 751 of the topper 750. In fact, the curved display moves from directly below the topper when the main door is closed to directly in front of the topper when the main door is fully open.

Topper 750 can remain in place during an opening or closing of the main door assembly. In fact, it is an advantage of the present disclosure that the topper 750 need not be removed or adjusted in any way while curved display 720 and the rest of the main door assembly are moving either for opening or closing. Not only then does the disclosed main door support assembly allow for a large curved display screen that directly abuts a topper, but it is also possible to service the gaming machine behind the main door assembly without having to do anything with the topper. While the descriptions herein focus on and provide details for an opening movement of the main door assembly having a curved display, it will be readily appreciated that a closing movement of the main door assembly is simply the reverse of the opening movement. Accordingly, the trajectory or arc of movement for the main door assembly is reversed during a closing movement of the main door assembly.

Figure 8:
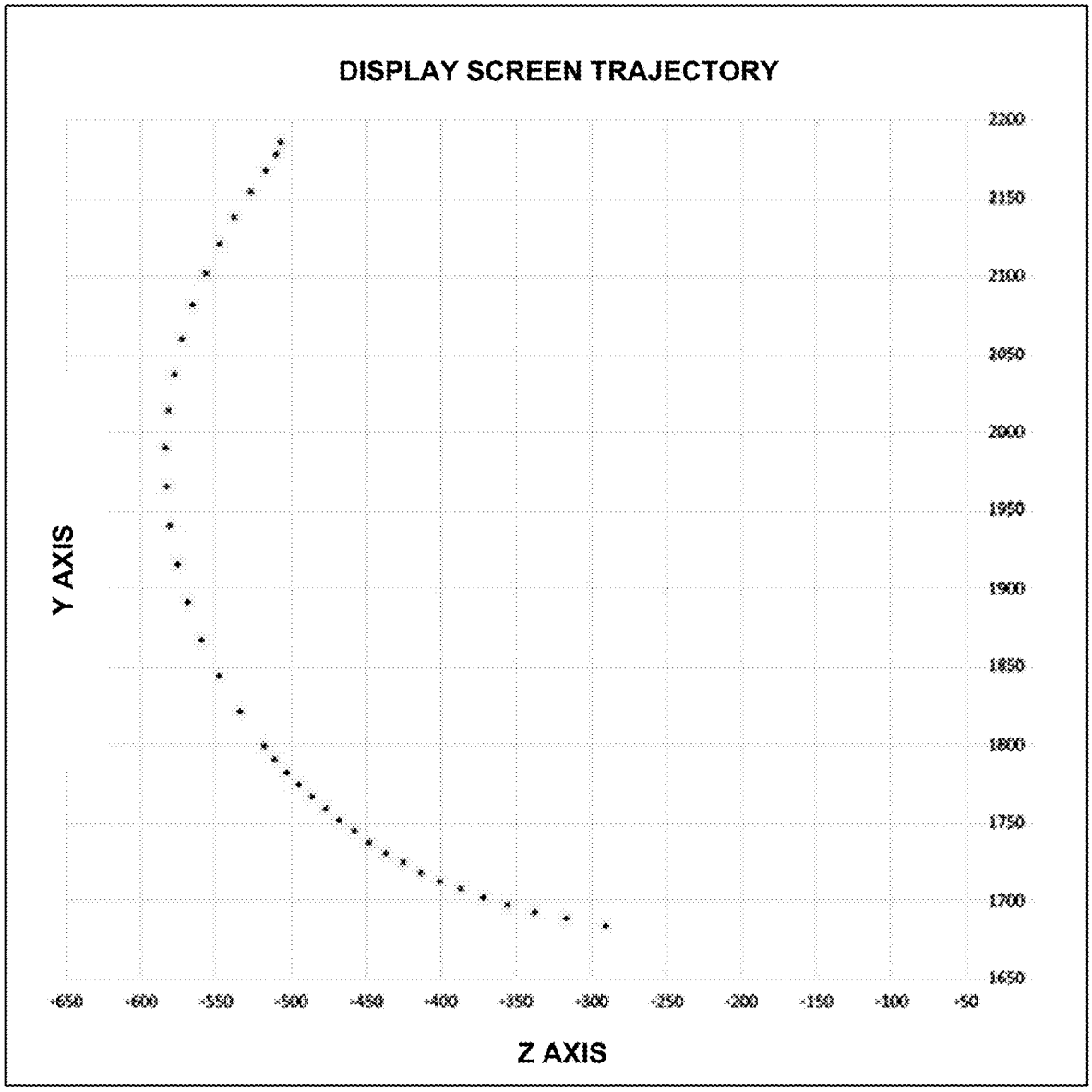
FIG. 8 provides a side profile graph of an exemplary arc of movement for a movable main door assembly having a display screen for a gaming machine according to one embodiment of the present disclosure.

A more detailed representation of the opening movement of the main door assembly is shown in FIG. 8, which provides a side profile graph of an exemplary arc of movement for a movable main door assembly having a display screen. The dots in graph 800 represent the position of the top edge of the curved display screen while the main door assembly moves between closed and open positions. At the bottom of the graph, the lowest dot represents the position of the display screen top edge when the main door assembly is closed. As shown, this position is located at about 280 mm (−280 Z axis) from the back side of the gaming machine cabinet, and about 1680 mm (1680 Y axis) above the floor. As the main door assembly opens, the display screen top edge initially moves forward, and then moves upward in a smooth arc of movement, as shown by the dots in the graph. When the main door assembly is at a fully open position, the top edge of the display screen is then located at about 500 mm from the back side of the gaming machine cabinet and about 2200 mm above the floor.

In addition to providing a unique trajectory for the opening and closing movement of a main door assembly of a gaming machine using a four-bar linkage, other provided components also ensure that this opening and closing movement is smooth, stable, and not overly strenuous for a maintenance person. As noted above, strength and stability are provided by using mounting brackets, a stabilizing strut, and other rigid members between flat link components that form the four-bar linkage. A specific type of force input and shock absorbance is also desirable for a smooth and supported movement of the main door assembly. This force input should provide an initial amount of lift to initiate the movement and raising of the main door assembly, but not so much that the door flies upwards when it first moves. Rather, it should be easy for an operator or maintenance person to pull up or pull down the main door assembly through the full ranges of opening and closing movements of the main door.

This can be accomplished by using gas springs installed in the manner illustrated above. As shown above, two gas springs can be mounted on opposing distal ends of a stabilizing strut that provides stability and rigidity to the input link of the disclosed four-bar linkage. These gas springs can generate a varying amount of lift torque during the opening and closing movements of the main door assembly, with the amount of lift torque generated generally corresponding to the amount of torque generated by the mass and movement of the main door assembly. Although a variety of different gas springs might be successfully used for the main door assembly support system disclosed herein, a specific suitable example is gas spring part no. 4138T57 available commercially from McMaster-Carr.

Figure 9:
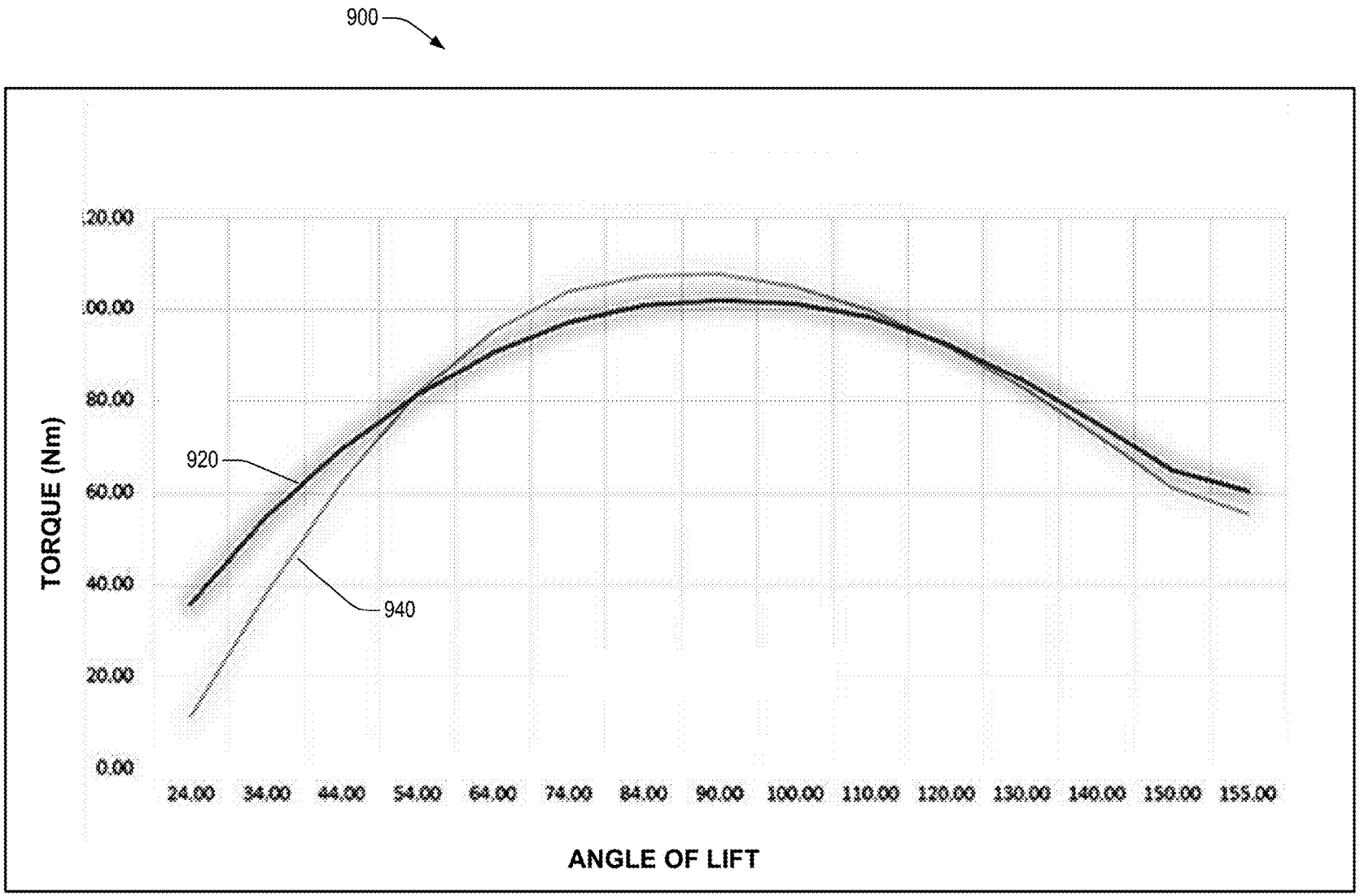
FIG. 9 provides a comparative graph of exemplary amounts of torque versus angle of lift during an opening movement of a main door support assembly for a gaming machine according to one embodiment of the present disclosure.

FIG. 9 provides a comparative graph of exemplary amounts of torque versus angle of lift during an opening movement of the main door assembly for a gaming machine. Graph 900 depicts the amount of torque in Newton-meters across the full range of lift angles for the input link of the subject four-bar linkage, starting at 24 degrees from a vertical datum (i.e., when the main door assembly is closed) and ending at 155 degrees from the vertical datum (i.e., when the main door assembly is fully open). Line 920 shows the amount of torque generated by the mass and movement of the main door assembly at the full range of main door positions, while line 940 shows the amount of torque force generated by the gas springs across the same full range of main door positions. While the amounts of torque are generally similar across all positions of the door, there are a few places where the amounts differ. Areas where line 920 is significantly greater than line 940 generally means that the difference in torques at these graphed locations is the amount of torque or force required by a user to move the main door assembly upward or downward. Areas where line 940 is greater than line 920 generally means that the main door assembly will continue to move in its present direction on its own, assuming little friction from joints and connections. Areas where line 920 and line 940 are about equal generally means that the system is in equilibrium, such that a user can let go of the main door assembly and the main door assembly would neither rise nor fall on its own. Overall, the torque provided by the gas springs allows for a smooth and convenient operation with respect to opening and closing the main door assembly disclosed herein.

Figure 10A:
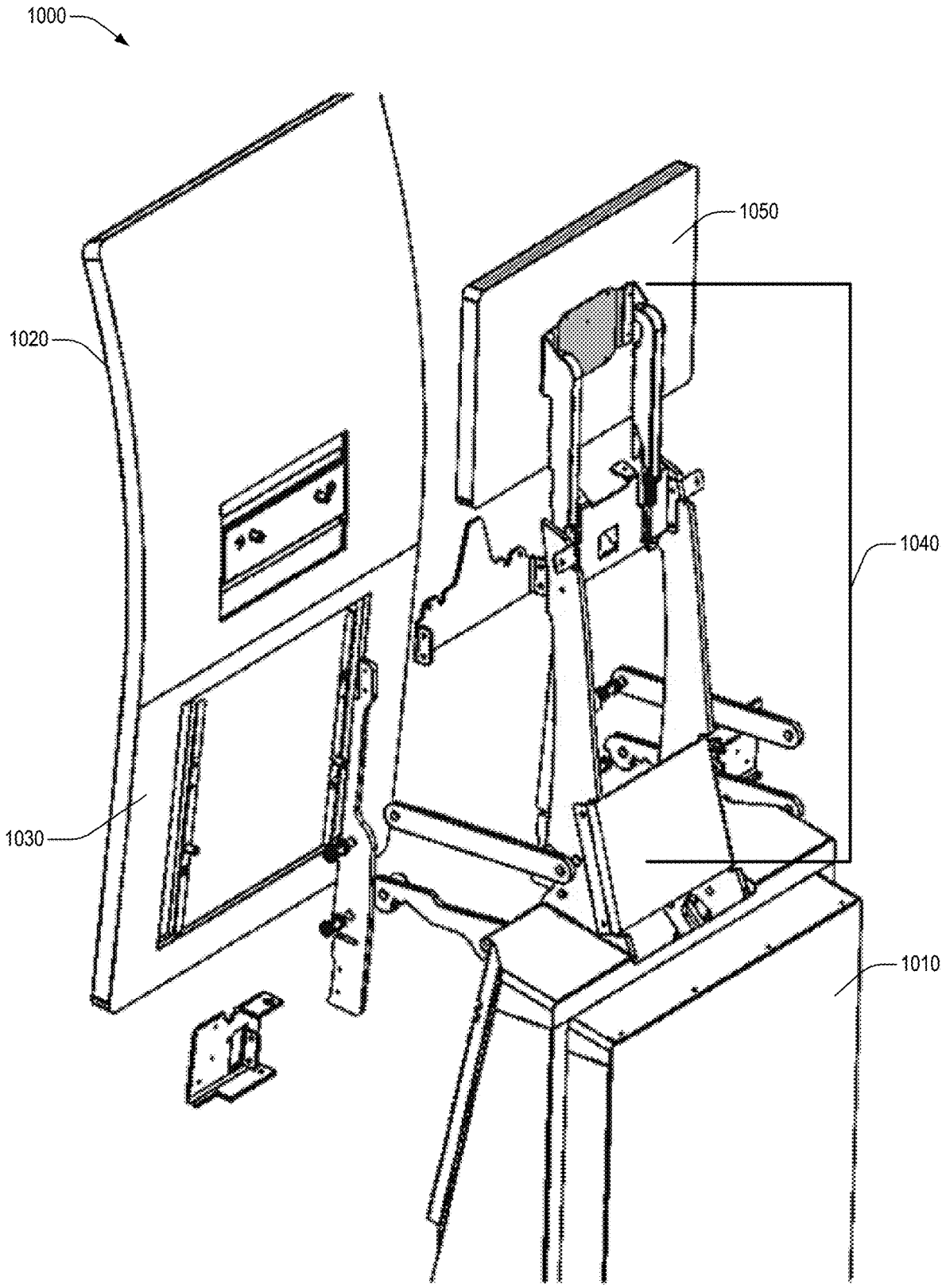
FIGS. 10A-10C illustrate in different exploded perspective views portions of an exemplary gaming machine having a main door support assembly according to one embodiment of the present disclosure.
Figure 10B:
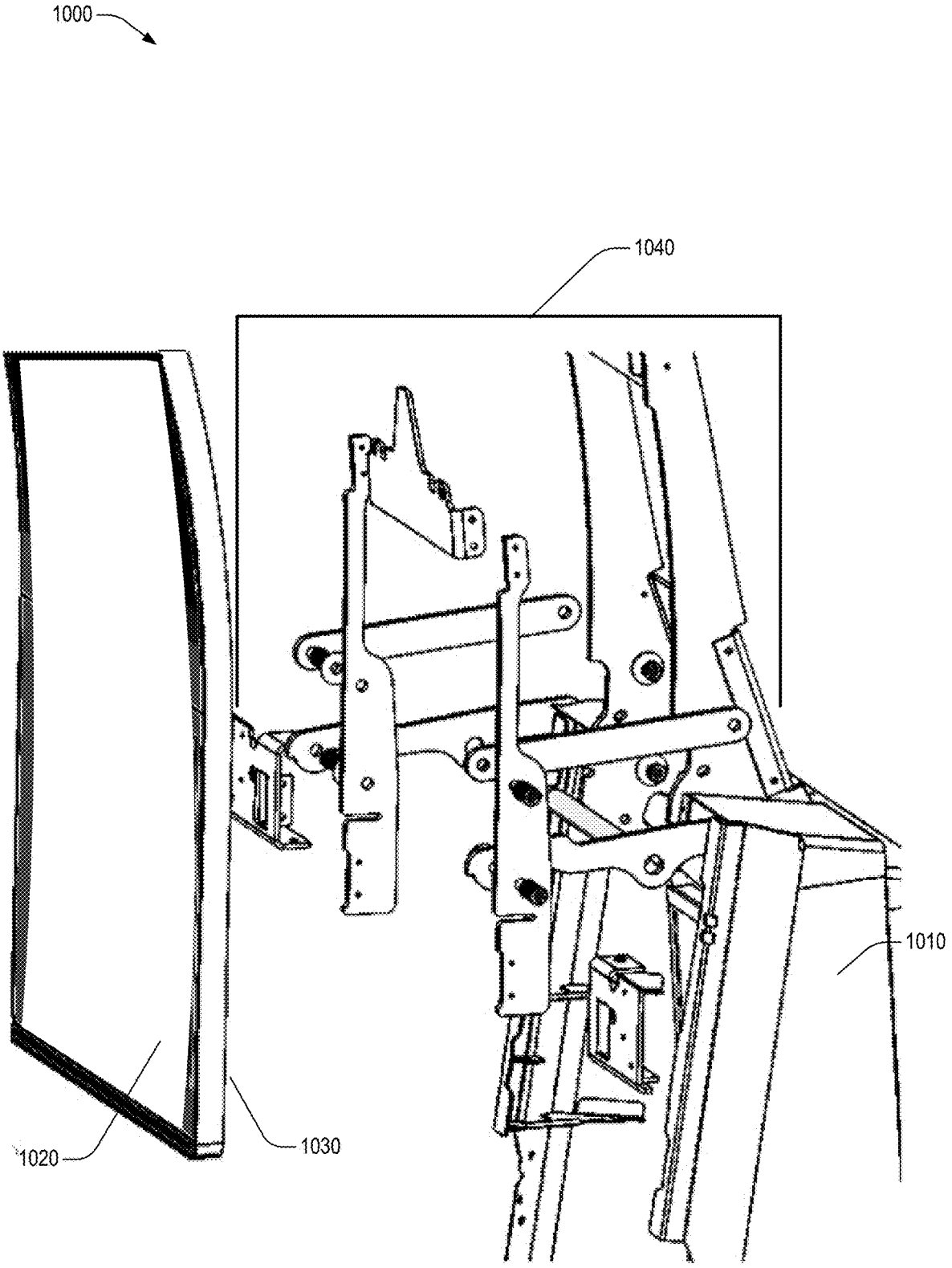
Figure 10C:
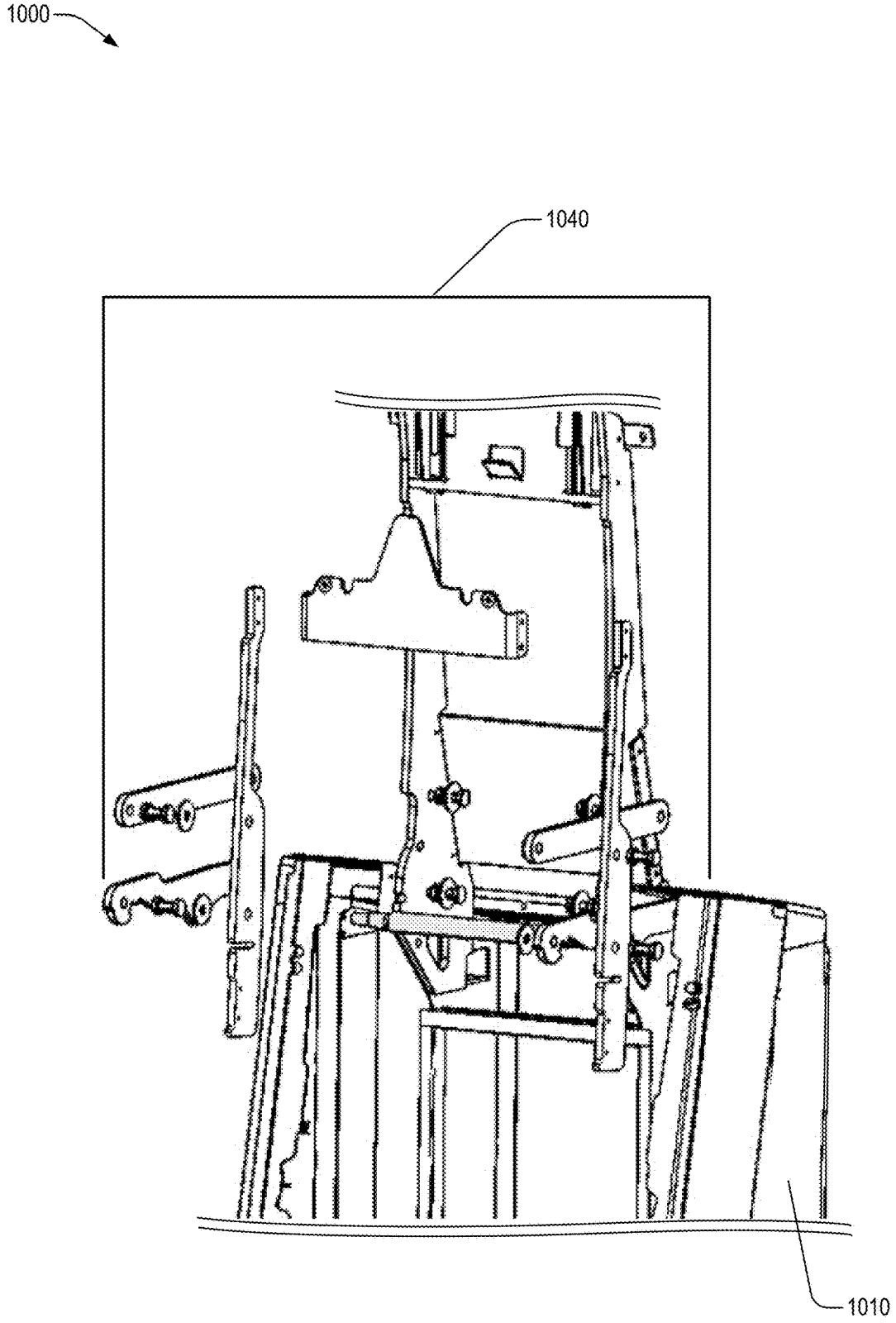

Referencing FIGS. 10A-10C, portions of an exemplary gaming machine having a main door support assembly are shown in different exploded perspective views. FIG. 10A shows gaming machine 1000 from a rear perspective exploded view, while FIG. 10B shows gaming machine 1000 from a side perspective exploded view, and FIG. 10C shows gaming machine 1000 from a front perspective exploded view. The various parts of the gaming machine 1000 can be the same as the parts described above with respect to previous examples, and FIGS. 10A-10C are merely provided to illustrate several of these parts in different ways from different angles. For example, gaming machine 1000 can include a cabinet 1010, and a curved display device 1020, a main door assembly 1030, a main door support assembly 1040, and aa topper 1050.

Topper with Intermediate Service Position

In the heavily regulated field of wager-based gaming, electronic gaming machines or electronic gaming devices ("EGDs") and their associated peripheral devices are required to be compliant with current wager-based gaming regulatory standards such as, for example, the well-known GLI standards, which have already been approved in various gaming jurisdictions. One example of a GLI standard is the GLI-11 standard version 3.0, Published Sep. 21, 2016 by Gaming Laboratories International, LLC, the entirety of which is herein incorporated by reference for all purposes.

One important consideration for casino operators relates to the ability of EGD service technicians to quickly access and service EGDs deployed in "the field" (e.g., EGDs deployed on a casino floor) while also maintaining proper levels of security. For example, if a component of an EGD needs to be inspected, serviced, and/or tested, a service technician may be dispatched to the EGD's location in order to perform the desired service/testing/inspection in the field.

Traditionally, many gaming machine manufactures design their EGD cabinets to conform with established industry standards, such as, for example, not exceeding a total width of 28 inches. EGDs which are configured or designed to confirm with industry standards allow for casino establishments to more efficiently utilize and maximize available floorspace, for example, by deploying banks of adjacent EGDs as illustrated, for example, in FIG. 1C. However, EGDs which are deployed in banked configurations offer little, if any, serviceability from the sides. Additionally, if the bank of gaming machines this deployed adjacent to a wall or back-to-back with other banks of gaming machines, such configurations offer little, if any, serviceability from the rear of the gaming machine.

Figure 20:
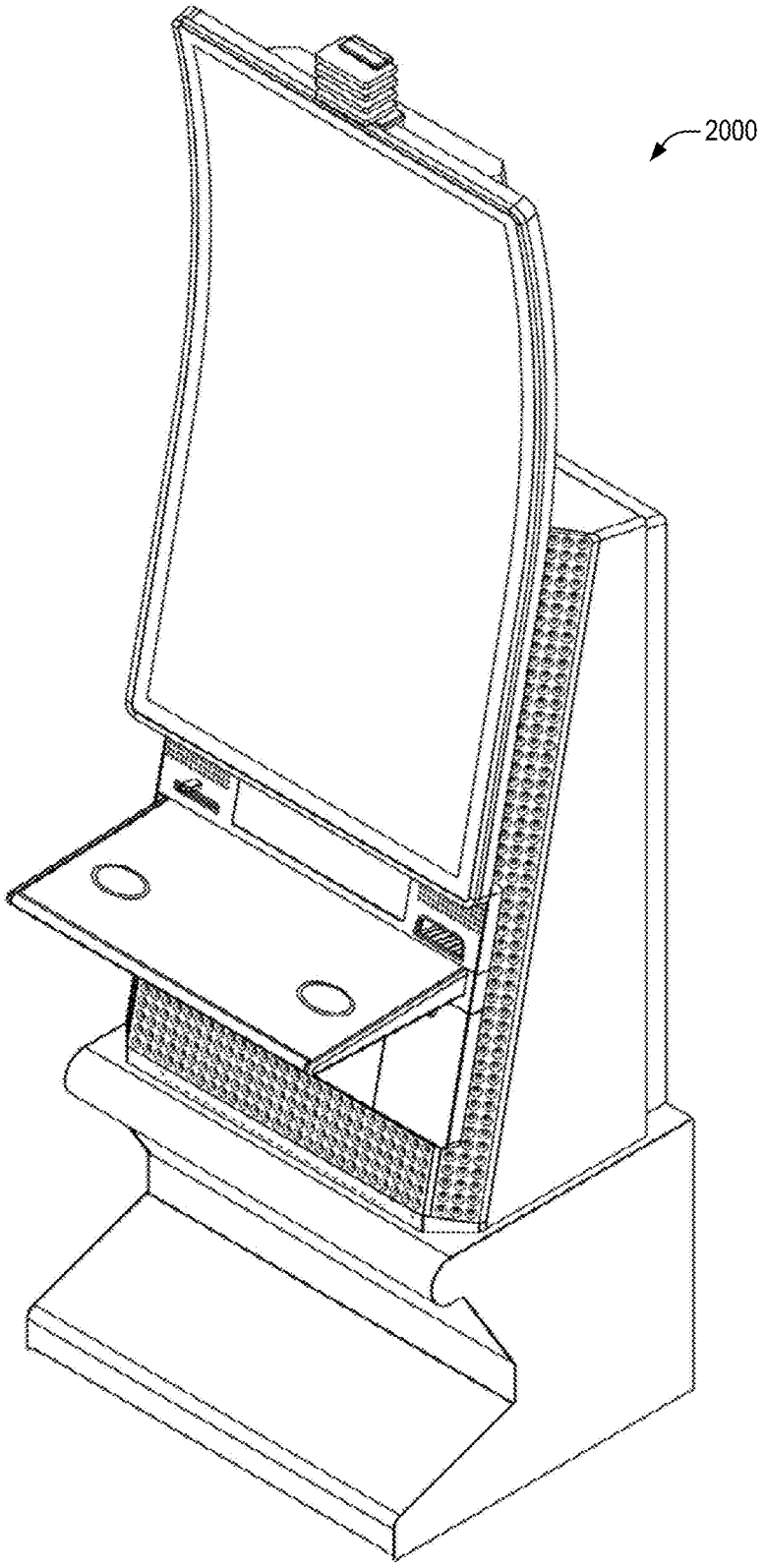
FIG. 20 illustrates a front perspective view a topperless gaming machine 2000.

In many situations, casino operators may need to install, remove, change, or otherwise service gaming machine peripheral devices such as, for example, gaming machine toppers (and/or components associated therewith) such as, for example, topper 250 of FIG. 2A. For example, many gaming machine cabinets are designed to support both topper configuration and topperless configurations. An example of a topper gaming machine configuration is illustrated in FIG. 2A. An example of a topper list gaming machine configuration is illustrated in FIG. 20.

Various embodiments of the gaming machines disclosed herein are designed to support reconfiguration of the gaming machine "in the field", meaning that a gaming machine deployed in a live casino environment may be reconfigured at its deployed location, without having to remove the machine from the live casino environment. For example, a casino operator may desire to reconfigure a gaming machine from a topperless configuration to a topper configuration. In order to perform this task, a service technician would need to install a topper assembly (e.g., 1110, FIG. 11) at the gaming machine, which would require the service technician to obtain access to various internal and external components of the gaming machine.

Typically, a topper is inserted/dropped into the top of a gaming cabinet, then the cabinet door is opened and any related hardware/screws/nuts are tightened to secure the topper frame/legs to the cabinet frame. Additionally, electrical wiring harnesses originating from the topper must be routed into the interior of the gaming cabinet and connected to the appropriate electrical wiring harnesses located at the interior of the gaming cabinet. As will readily be appreciated, this requires the service technician to move to multiple locations during the installation process in order to access the top exterior components of the gaming cabinet and the interior components of the gaming cabinet. Additionally, because the interior of the cabinet needs to be accessed, for example, in order to access the mounting screws and/or other hardware which secures the topper frame/legs to the cabinet frame, the main door of the gaming cabinet needs to be opened in order to provide access to the interior of the cabinet. However, each time the main door of the cabinet is opened, it presents significant security issues/concerns, which is generally undesirable.

A typical gaming machine topper can weigh 25-35 pounds or more and typically requires cable routing during the removal or installation process. The procedure for installing and/or removing a topper to/from the gaming cabinet typically involves a service technician standing on a ladder in front of the cabinet and trying to fish the topper's wires down into the cabinet with one hand while holding the 25-35 lb topper with the other hand. Not only is this a difficult and strenuous task, but it also presents a number of safety issues service technician, and may also lead to damage of the equipment. For example, while the service technician is standing on the ladder trying to install the topper, both of the service technician's hands may be occupied doing different tasks (such as, for example, trying to fish the topper's wires down into the cabinet with one hand while attempting to hold the topper with the other hand). If the service technician were to start losing his balance during this activity, he would not have a free hand to help steady himself, and may be more likely to fall off the ladder, resulting in injury to himself and possibly injury to the equipment as well. Accordingly, one object of the present disclosure is to provide an improved gaming machine cabinet design to facilitate a more easy and safe installation and removal of gaming machine toppers to/from gaming machine cabinets. Additionally, another object of the present disclosure is to provide an improved gaming machine cabinet design and topper design which enables a service technician to install or remove a topper to/from the gaming cabinet without needing to access any mounting screws within the cabinet interior and/or without needing to open the main door of the gaming cabinet. As described in greater detail herein, one or more gaming cabinet embodiments are disclosed which have been specifically designed to fulfill these objectives.

For example, in at least one embodiment, the gaming machine 200 of FIG. 2A may be configured or designed to provide an improved gaming machine cabinet design to: (i) facilitate a more easy and safe installation and removal of gaming machine toppers to/from the gaming machine cabinet; and (ii) enable a service technician to install or remove a topper to/from the gaming cabinet without needing to access any mounting screws within the cabinet interior and/or without needing to open the main door of the gaming cabinet. At least a portion of these gaming cabinet design and topper design improvements are illustrated, for example, in FIGS. 11A-C, 12A-B, 13-14, 15A-B, and 16-21.

Figure 11A:
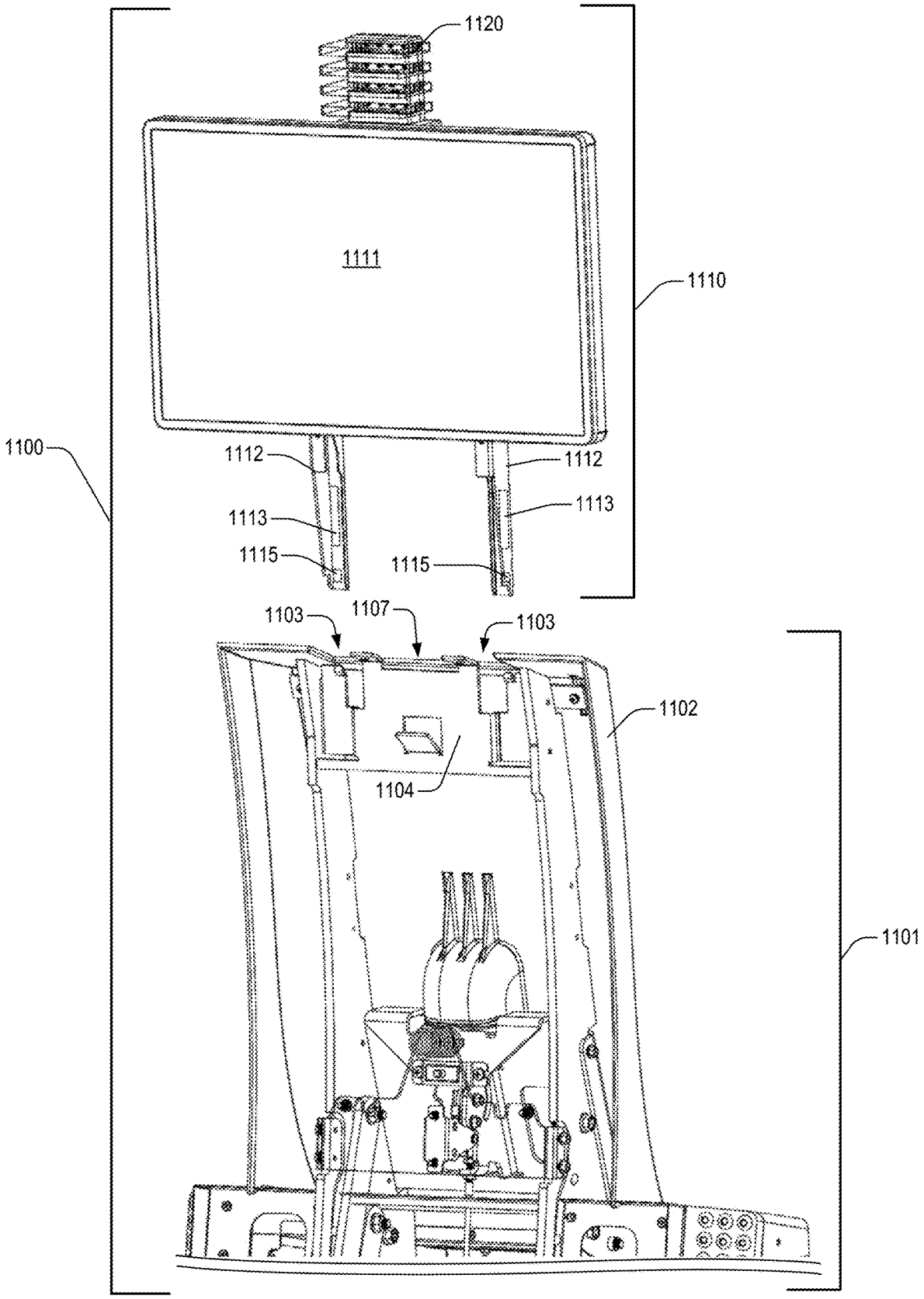
FIG. 11A illustrates a front perspective view of a portion 1100 of the gaming machine 200 of FIG. 2A.

FIG. 11A illustrates a front perspective view of a portion 1100 of the gaming machine 200 (FIG. 2A), illustrating various components of the gaming cabinet portion 1101 as well as various components of the gaming machine topper assembly 1110. For purposes of simplification, and in order to avoid confusion, various internal and external components of the gaming cabinet are not shown in FIG. 11A, including, for example, portions of the main door assembly (e.g., illustrated in FIG. 2C).

As illustrated in the example embodiment of FIG. 11A, topper assembly 1110 includes:

- a topper support frame which includes support legs 1112;
- a monitor 1111 mounted to the topper support frame; and
- (optional) a service light assembly 1120.

As illustrated in the example embodiment of FIG. 11A, gaming cabinet portion 1101 includes:

- Gaming cabinet housing 1102. In at least one embodiment, the gaming cabinet housing 1102 includes openings 1103 located at the top of the gaming cabinet which are designed to receive topper assembly support legs 1112. Gaming cabinet housing 1102 also includes opening 1107 (located at the top of the gaming cabinet) which is designed to interface with one or more cover plates such as, for example, topper compatible cover plate 1510 (FIG. 15A), non-topper compatible cover plate 2101 (FIG. 21), and/or other types of cover plates.
- Mounting bracket 1104. In at least one embodiment, mounting bracket 1104 is securely mounted to the interior frame of the gaming cabinet, and includes various features designed to interface with features of the topper assembly support legs 1112. Additionally, mounting bracket 1104 may also include features designed to provide mounting surfaces and apertures for enabling one or more different cover plates to be securely fastened to the gaming cabinet.

Figure 11B:
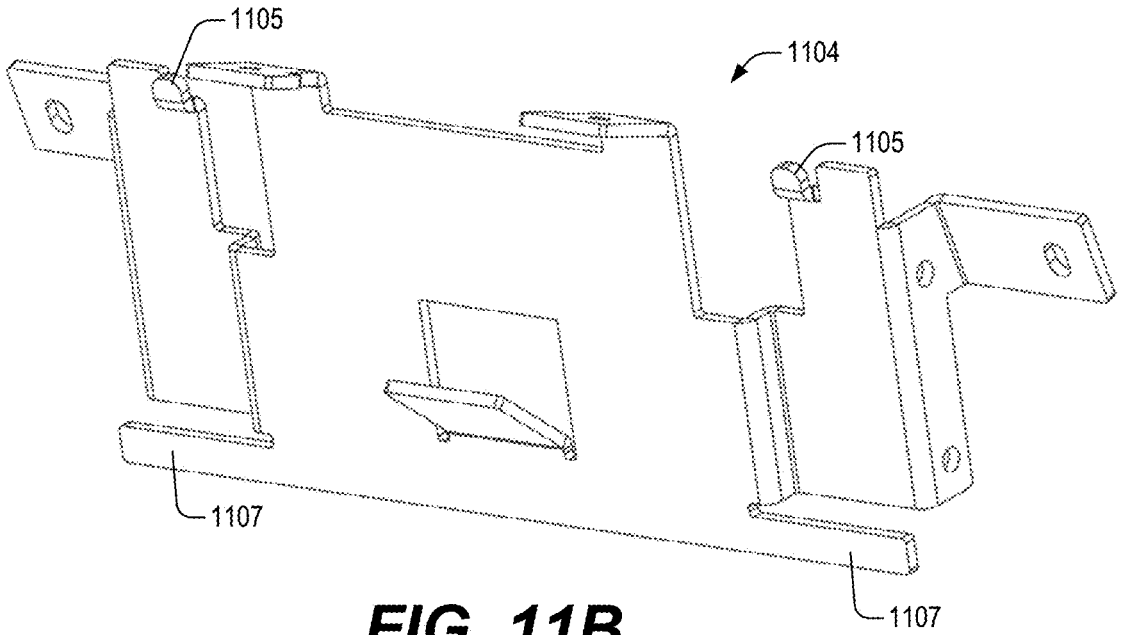
FIG. 11B illustrates a front perspective view of mounting bracket 1104.
Figure 11C:
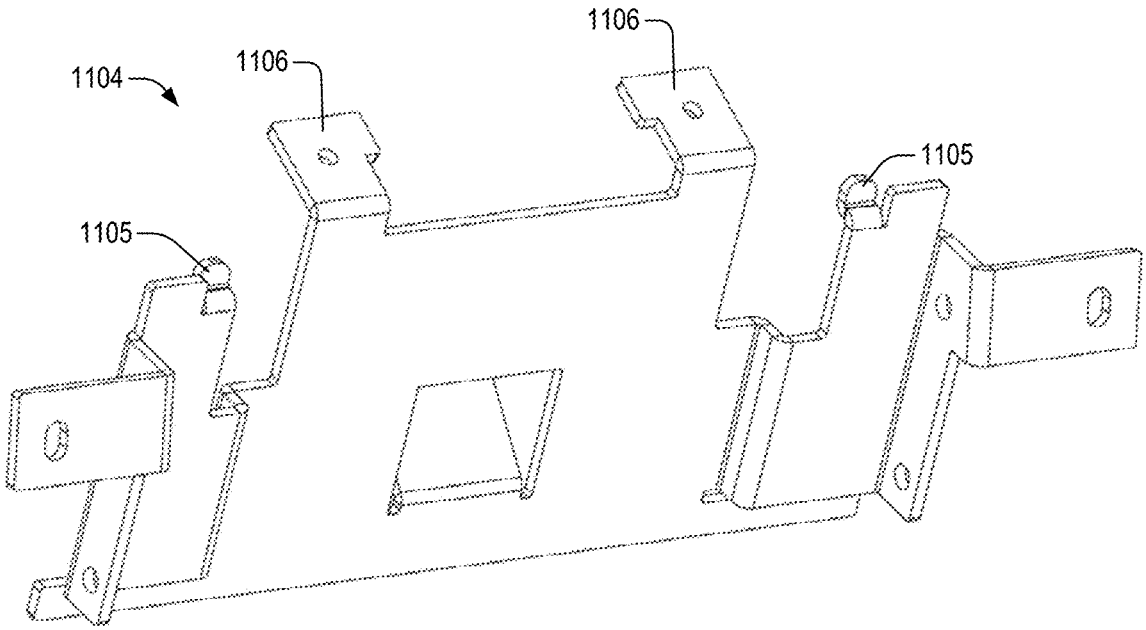
FIG. 11C illustrates a rear perspective view of mounting bracket 1104.

FIG. 11B illustrates a front perspective view of mounting bracket 1104. FIG. 11C illustrates a rear perspective view of mounting bracket 1104. As illustrated in the example embodiment of FIG. 11B, mounting bracket includes various features designed to interface with features of the topper assembly support legs 1112, including, for example, tab portions 1105 and 1107. In at least one embodiment, tab portions 1105 are designed to interface with slot portions 1113 and 1115 of the topper assembly support legs. As illustrated in the example embodiment of FIG. 11B, the end portions of tabs 1105 are bent upwards to facilitate engagement (e.g., hooking/retaining) of the slot portions 1113, 1115 of the topper assembly support legs 1112, as illustrated, for example, in FIGS. 14, 17, and 18. In at least one embodiment, tab portions 1107 are designed to interface with the notched distal end portions (e.g., 1117, FIG. 18) of the topper assembly support legs, as illustrated, for example, in FIG. 18.

Figure 12A:
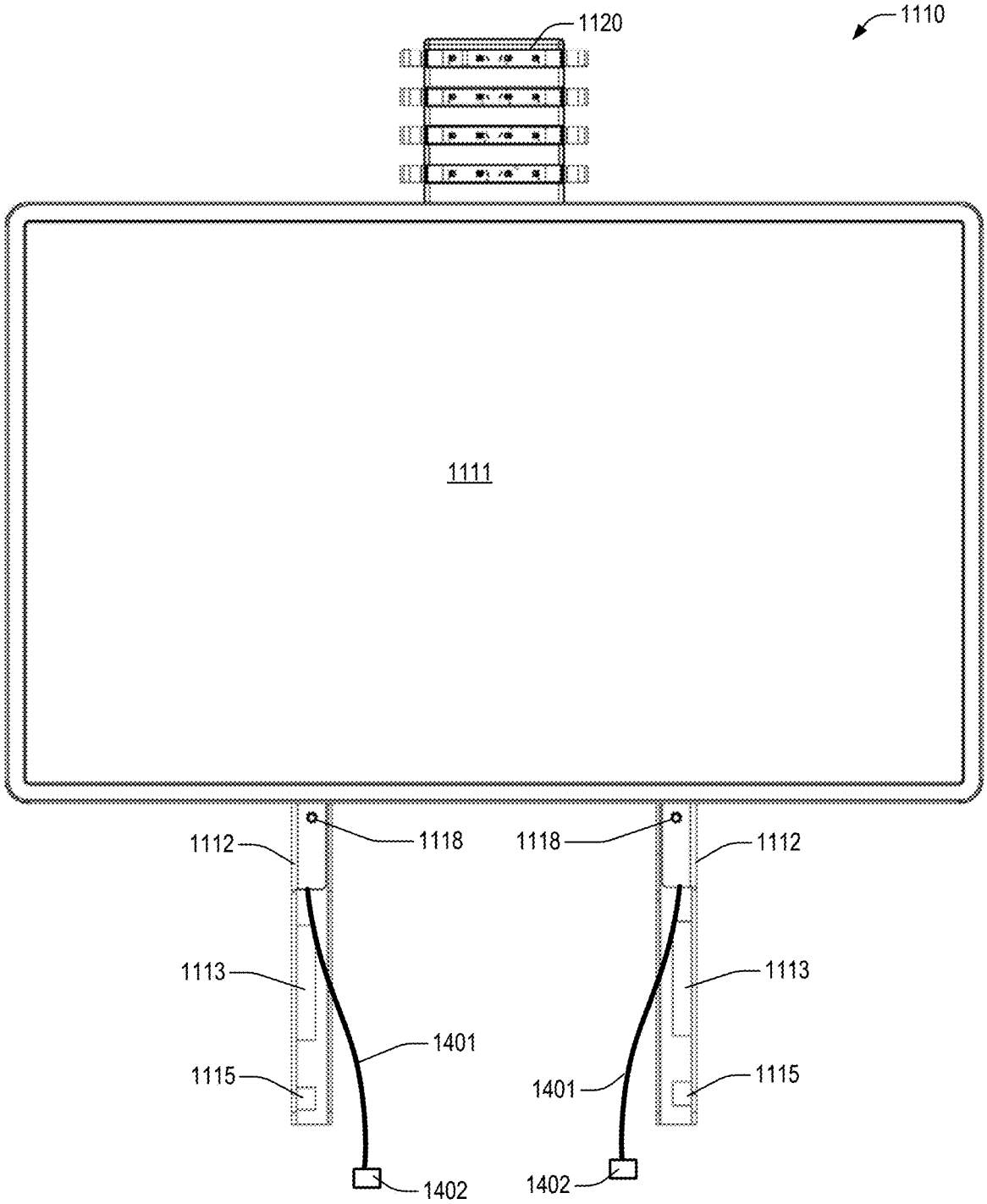
FIG. 12A illustrates a front elevation view of topper assembly 1110 in accordance with one embodiment.
Figure 12B:
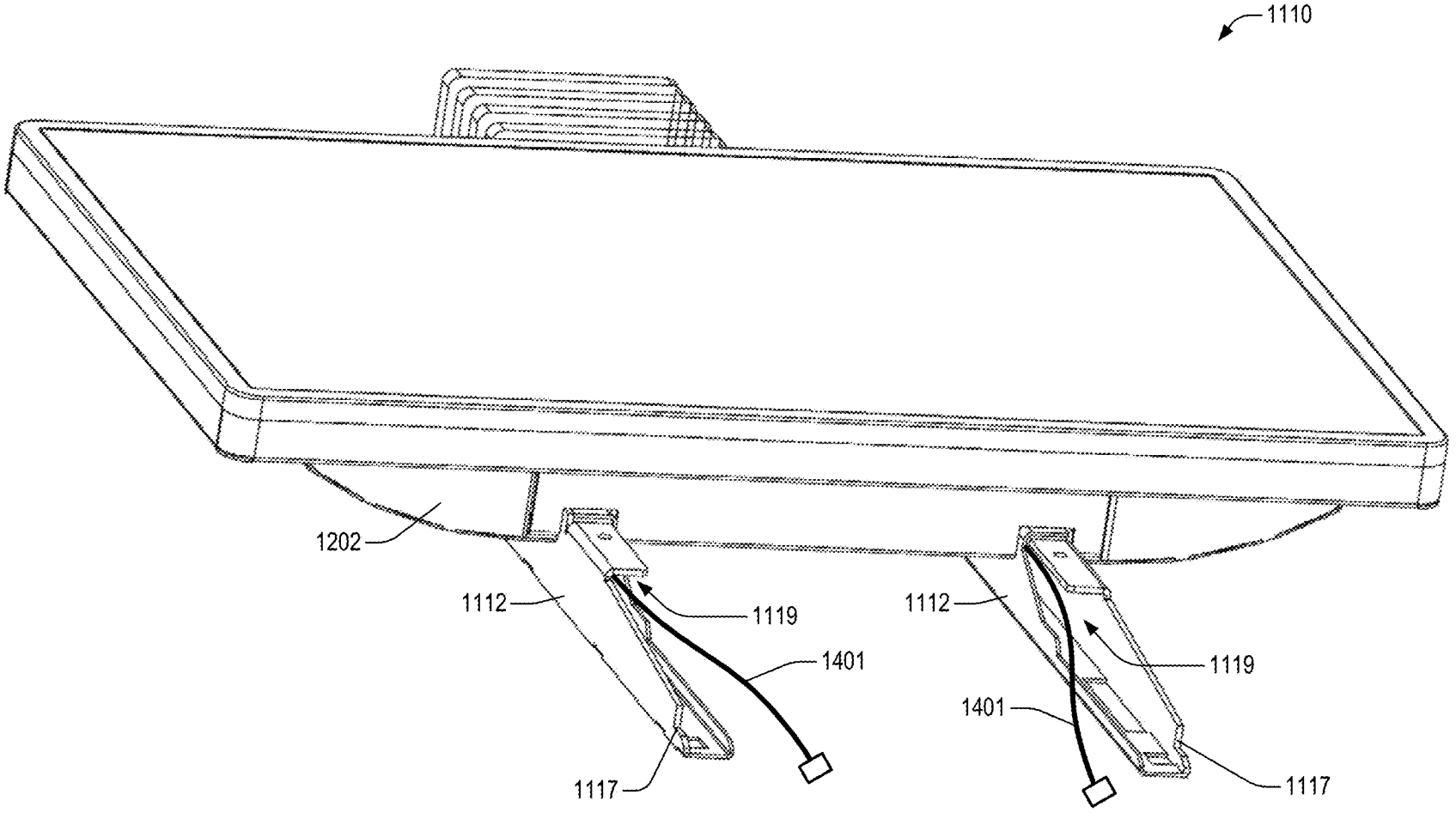
FIG. 12B illustrates a front perspective view of topper assembly 1110.
Figure 13:
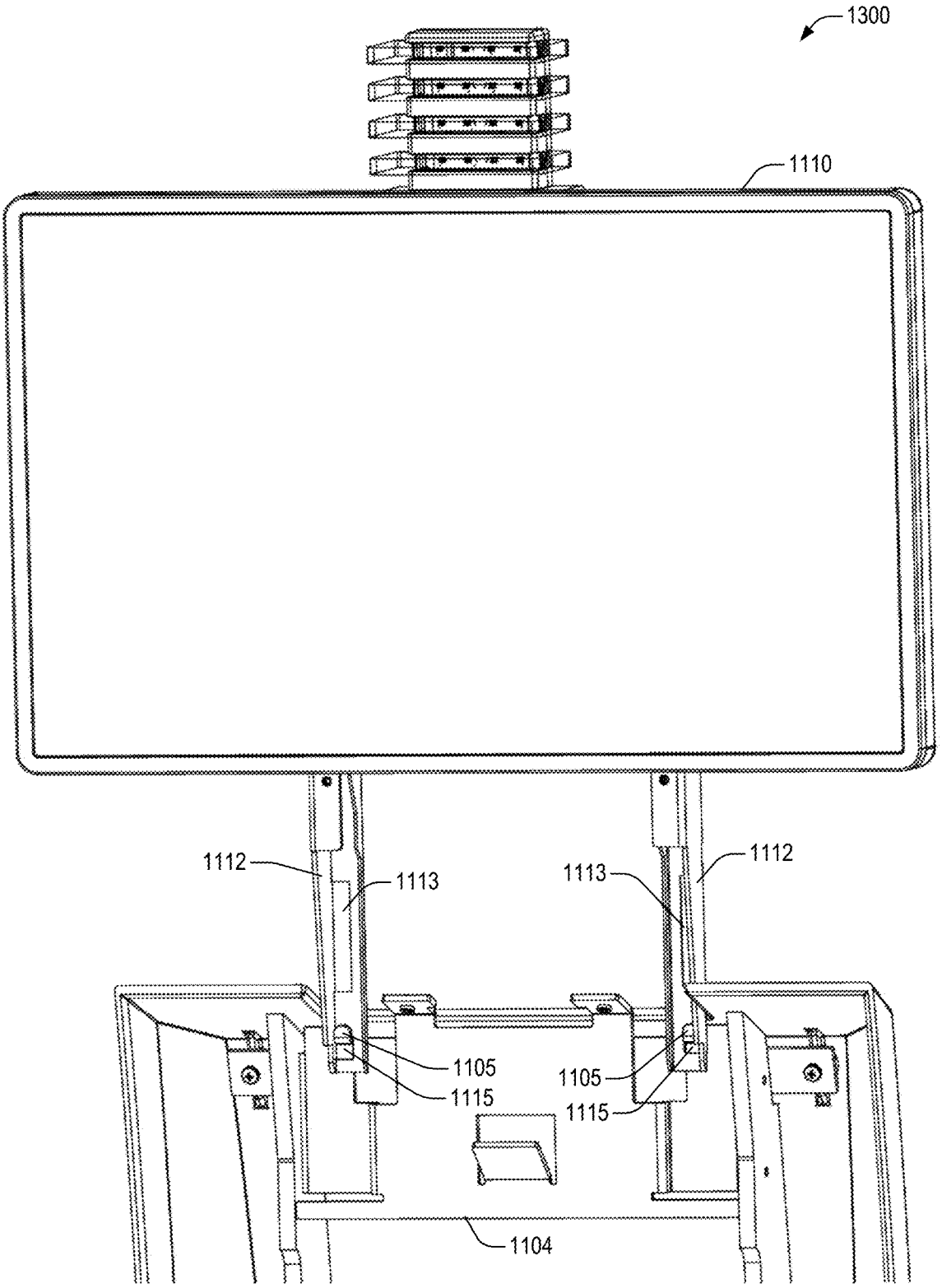
FIG. 13 illustrates an example embodiment showing the topper assembly 1110 configured in the first intermediate (hands free) service position.
Figure 17:
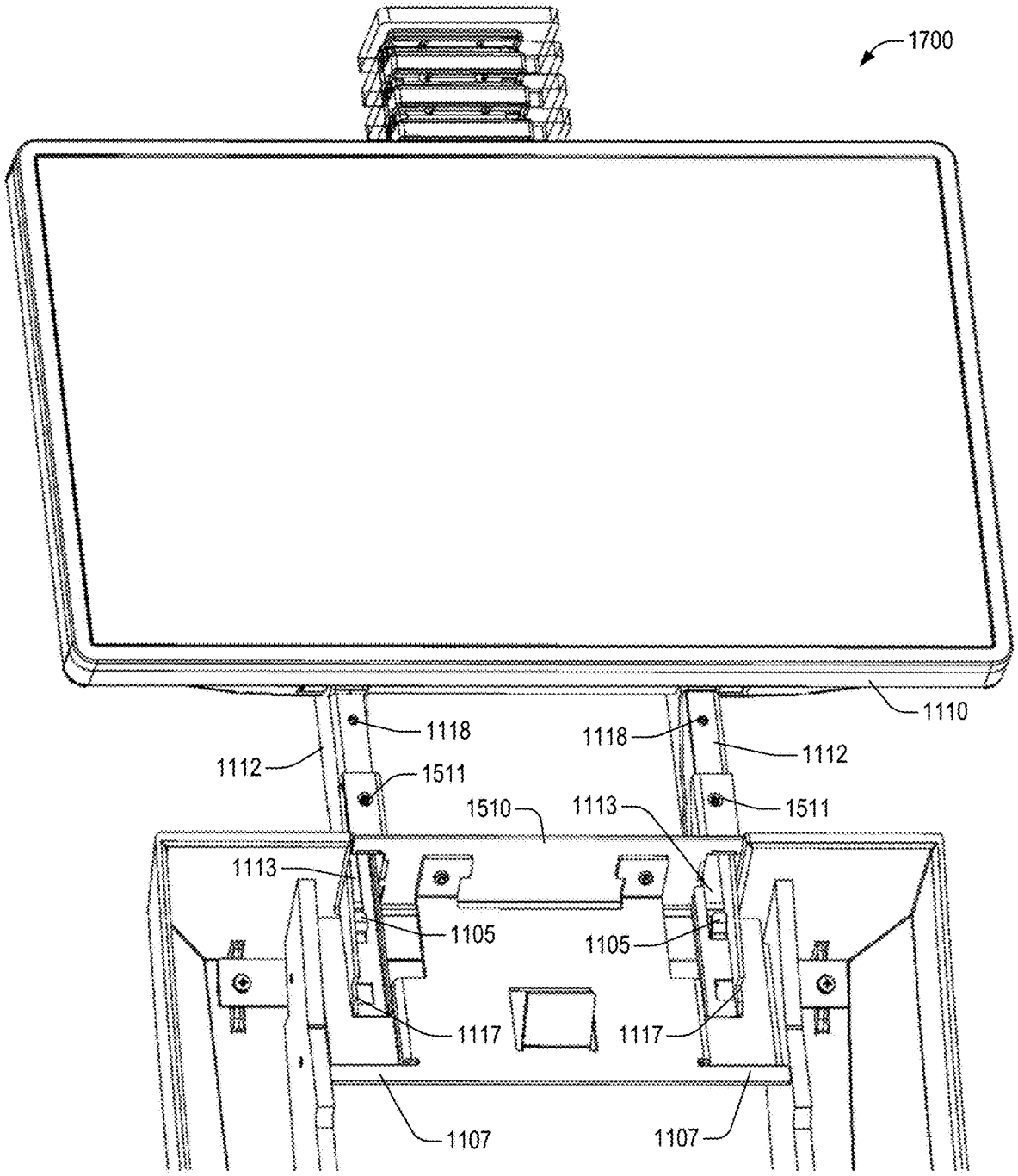
FIG. 17 illustrates an example embodiment showing the topper assembly 1110 configured in a second intermediate service position.

FIG. 12A illustrates a front elevation view of topper assembly 1110 in accordance with one embodiment. FIG. 12B illustrates a front perspective view of topper assembly 1110. As illustrated in the example embodiment of FIGS. 12A and 12B, the topper assembly support legs 1112 are designed to include various features for interfacing with portions of the gaming cabinet, including, but not limited to, one or more of the following (or combinations thereof):

- Mounting holes 1118. In at least one embodiment, mounting holes 1118 may be used for securing the topper assembly to the gaming cabinet via the use of one or more screws or fasteners.
- Slot portions 1115, which are designed to interface with the tab portions 1105 of mounting bracket 1104 in a manner which enables the topper assembly to be at least temporarily placed in a stationary intermediate service position during the installation process (e.g., as illustrated in FIG. 13), thereby freeing up both hands of the service technician, and enabling the service technician use both of his hands to attend to other tasks of the topper assembly installation process such as, for example, securing electrical connections between the topper assembly and the gaming cabinet.
- Elongated slot portions 1113, which are also designed to interface with the tab portions 1105 of mounting bracket 1104 in a manner which enables the topper assembly to be lowered from a secondary intermediate service position (e.g., as illustrated in FIG. 17) to a final installed position (e.g. as illustrated in FIG. 18).

Figure 18:
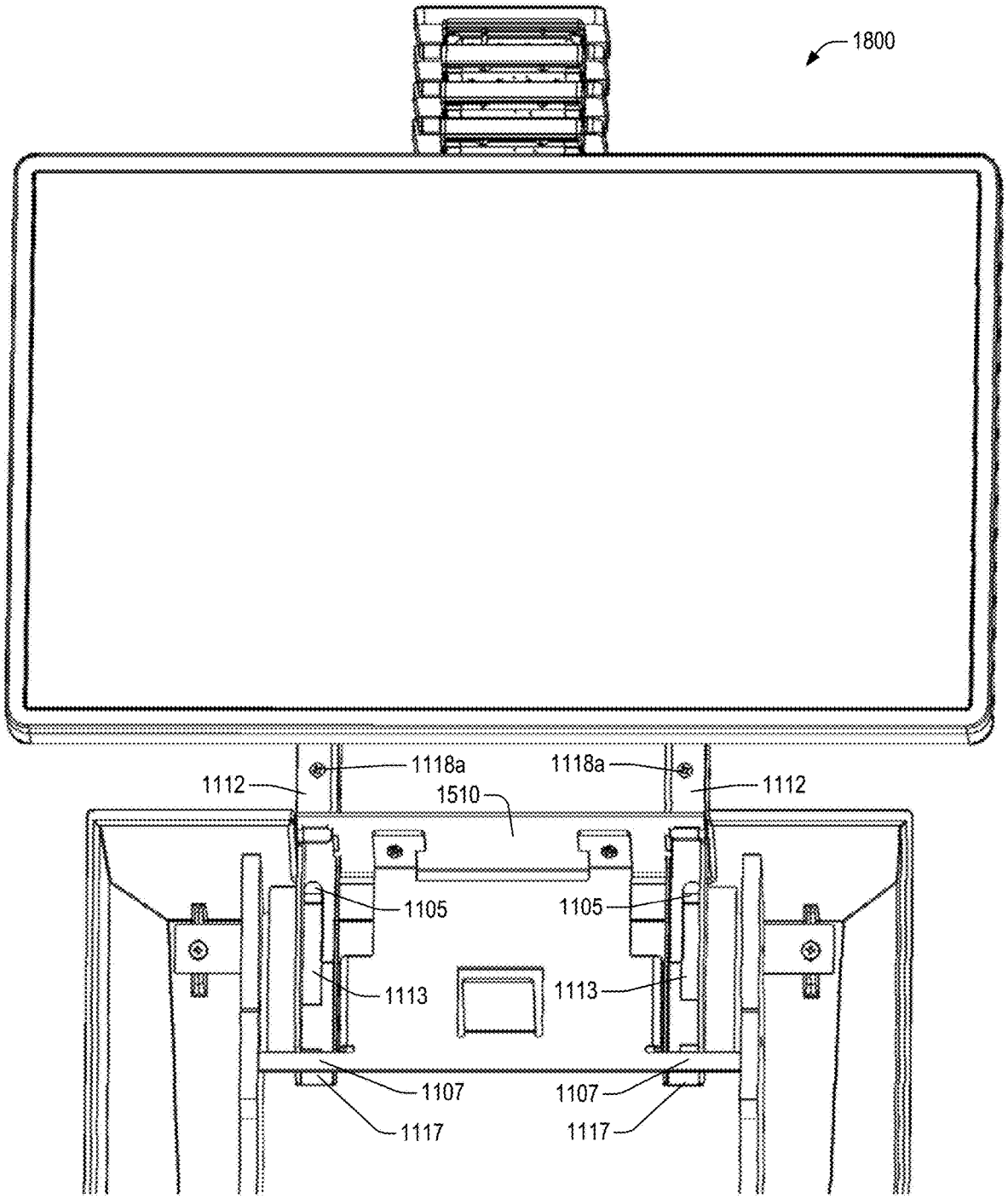
FIG. 18 illustrates an example embodiment showing the topper assembly 1110 configured in a final installed position.

Notched distal end portions 1117 (FIG. 12B) which are designed to interface with tab portions 1107 of the mounting bracket 1104 (e.g., as illustrated in FIG. 18) in a manner which helps secure the topper assembly in its final installed position.

Figure 14:
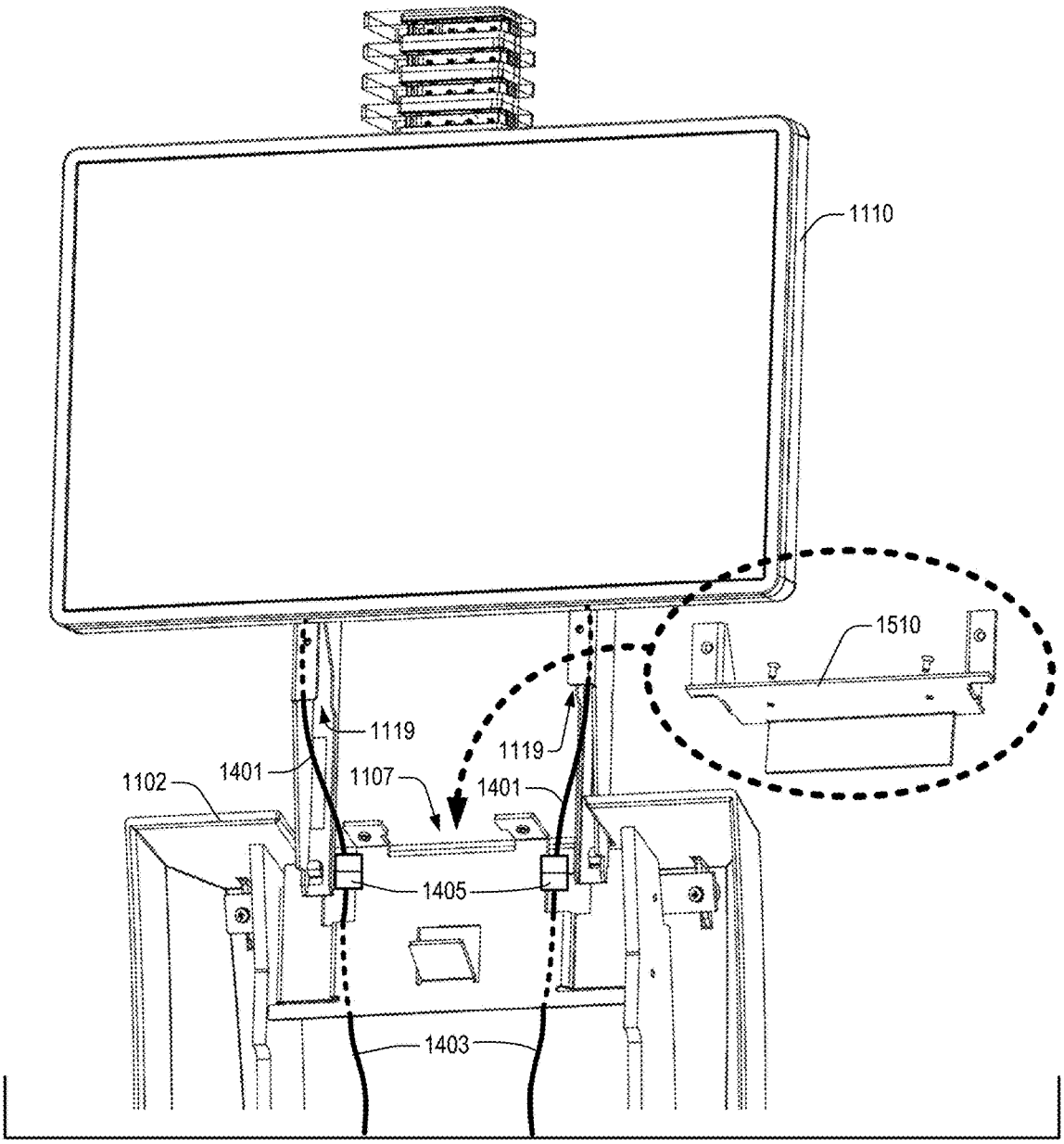
FIG. 14 illustrates a second example embodiment showing the topper assembly 1110 configured in the first intermediate (hands free) service position

Internal passages 1119 (FIG. 12B), formed by configuring the sides of the support legs in a manner which creates a hollow interior passage extending at least a portion of the length of each support leg and designed to enable electrical wiring harnesses 1401 to be fed from the body of the topper assembly 1202, through the internal passages 1119 of the support legs 1112, and out the lower portions of the support legs, as illustrated, for example, in FIGS. 12A, 12B, and 14.

In at least one embodiment, the support legs 1112 of topper assembly are designed to be inserted into the openings 1103 of the gaming cabinet, which are located at the top of the gaming cabinet. According to different embodiments, the support legs 1112 may be fabricated using one or more high-strength materials or alloys, such as, for example: steel, aluminum, magnesium, sheet metal, etc.

Figure 16:
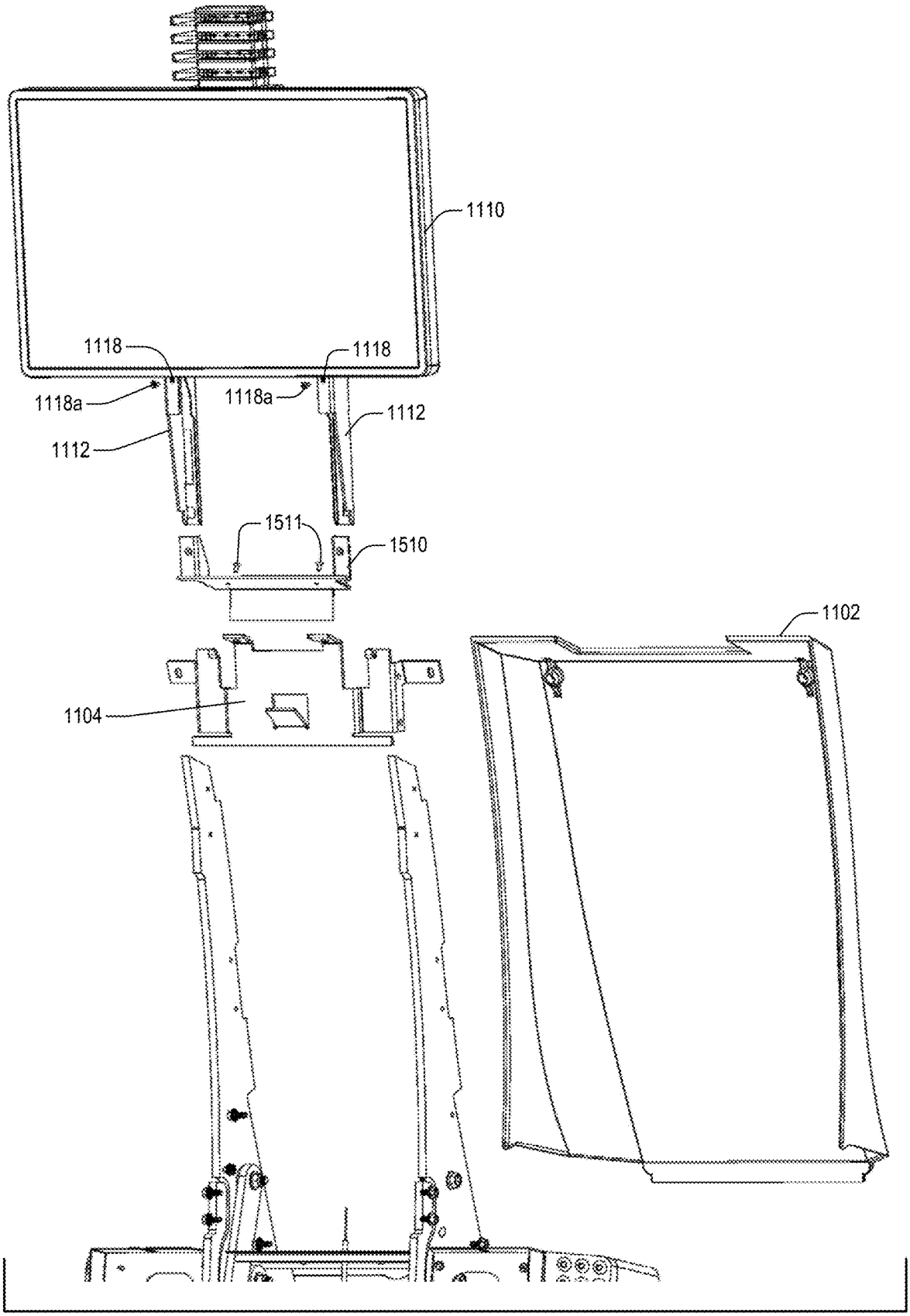
FIG. 16 shows an exploded view of various hardware components 1600 which may be used in at least one embodiment for installing (or removing) a topper assembly at a gaming machine

FIG. 16 shows an exploded view of various hardware components 1600 which may be used in at least one embodiment for installing (or removing) a topper assembly at a gaming machine such as, for example, gaming machine 200 of FIG. 2A. As illustrated in the example embodiment of FIG. 16, hardware components 1600 may include, but are not limited to, one or more of the following (or combinations thereof):

topper assembly 1110;
topper-compatible cover plate 1510;
mounting bracket 1104;
gaming cabinet housing 1102;
fasteners (e.g., screws) 1118*a*, 1511;
etc.

Figure 22:
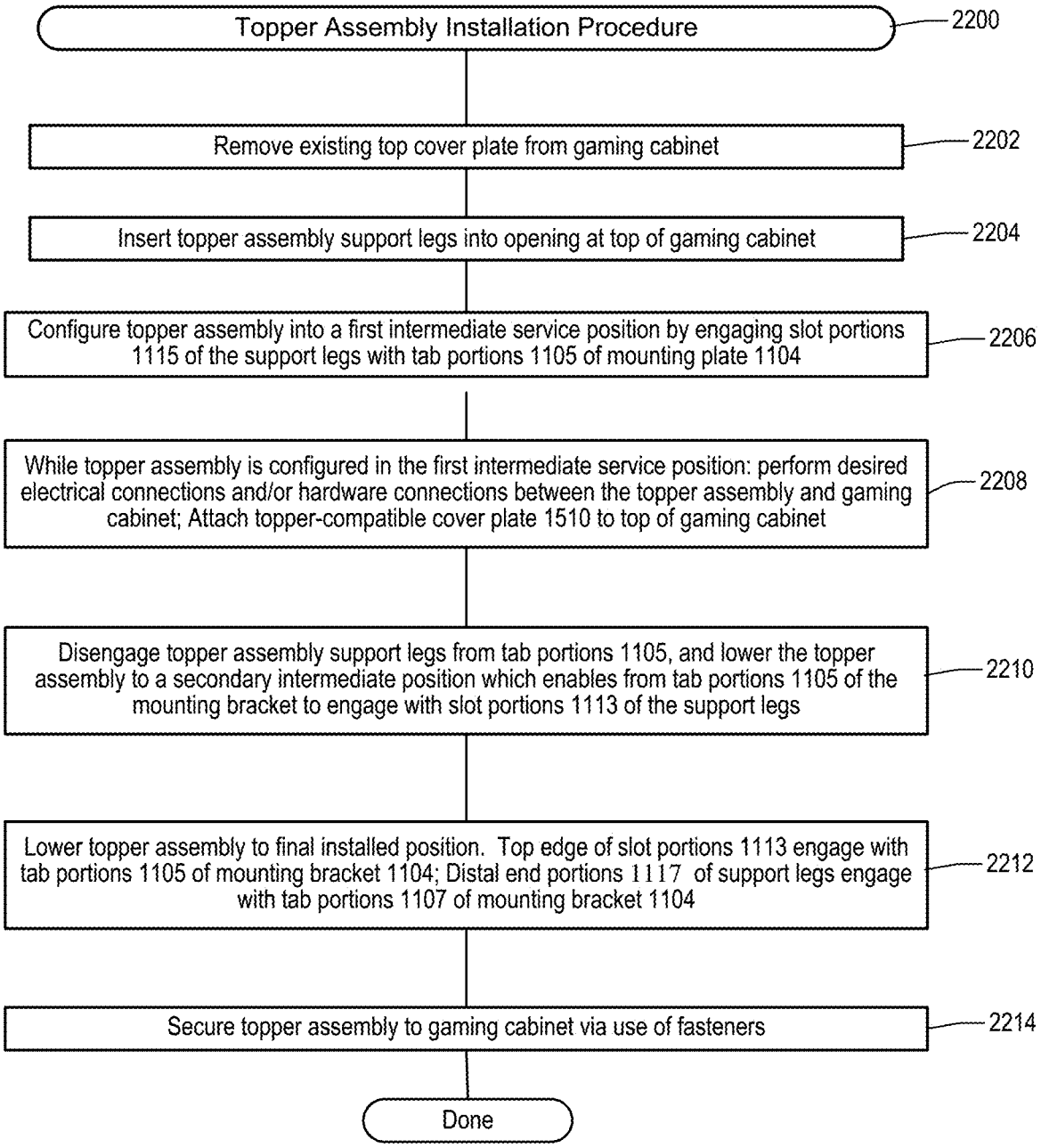
FIG. 22 shows an example embodiment of a Topper Assembly Installation Procedure 2200.

FIG. 22 shows an example embodiment of a Topper Assembly Installation Procedure 2200, which may be performed by a service technician for installing a topper assembly at a selected gaming cabinet or gaming machine. For purposes of illustration, an example walk-through of the Topper Assembly Installation Procedure 2200 will now be described with reference to FIGS. 11A-19 of the drawings.

Figure 21:
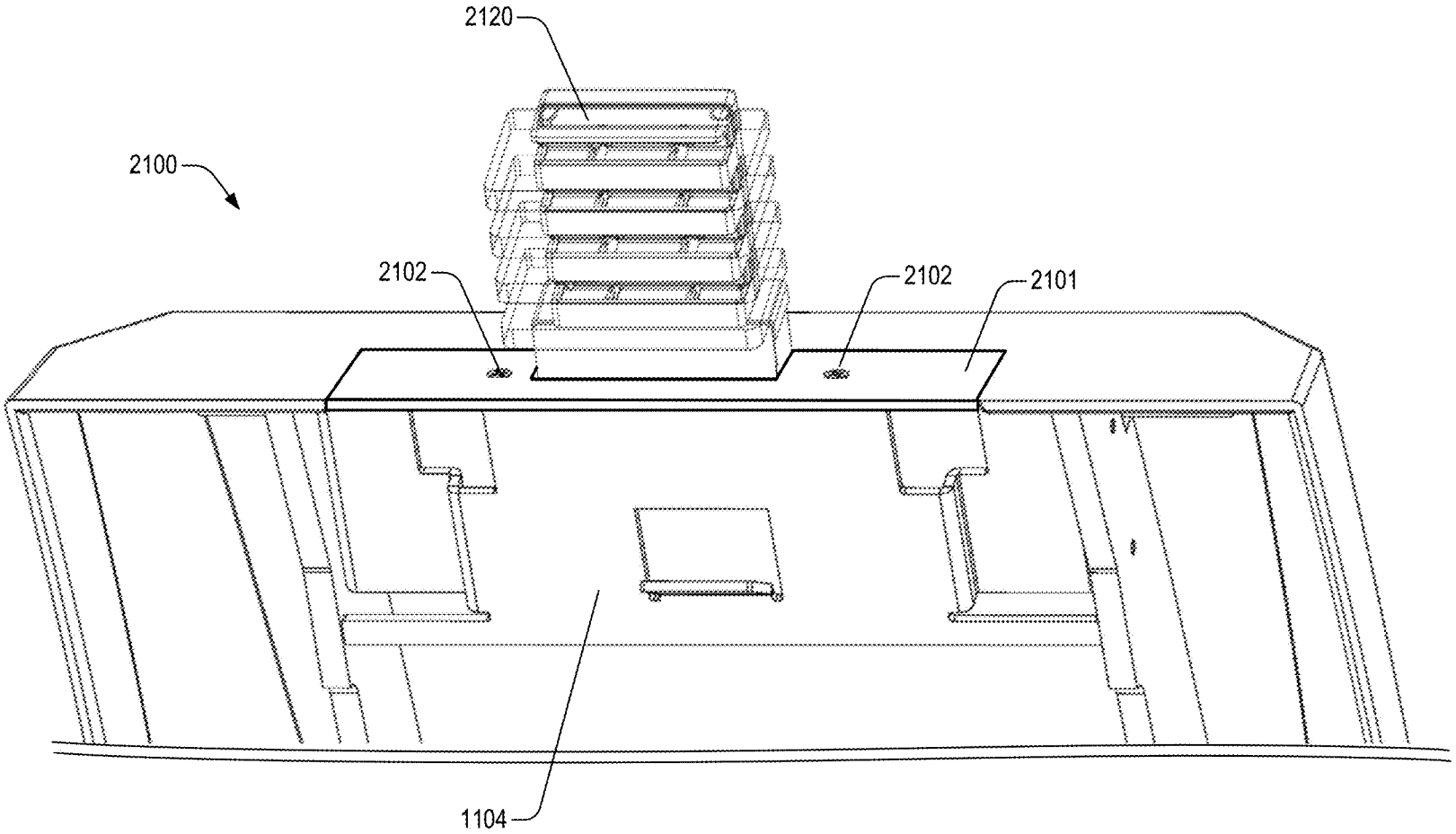
FIG. 21 illustrates a front perspective view of a top portion 2100 of a topperless gaming machine.

In the example walk-through which follows, it is assumed that the topper assembly of FIG. 12A is to be installed at a topperless gaming machine such as, for example, topperless gaming machine 2000 of FIG. 20. FIG. 20 illustrates a front perspective view a topperless gaming machine 2000 in accordance with one embodiment. FIG. 21 illustrates a front perspective view of a top portion 2100 of a topperless gaming machine. FIGS. 11A, 13, 14, and 17-19 show a sequence of configurations illustrating how the topper assembly 1110 may be installed and securely connected to the gaming cabinet.

Referring now to the Topper Assembly Installation Procedure 2200 of FIG. 22, as described at 2202, the existing top cover plate (e.g., 2101, FIG. 21) is removed from the gaming cabinet. In at least one embodiment, this may be performed by removing fasteners (e.g., screws) 2102, which are fastened to tab portions 1106 of mounting plate 1104 (FIG. 11B). Additionally, if a service light assembly (e.g., 2020) is attached to the gaming cabinet, the service light assembly is also removed.

After the top cover plate and service light assembly have been removed from the gaming cabinet, as shown as described at 2204, the topper assembly support legs are positioned for insertion into the opening at the top of the gaming cabinet. This is illustrated, for example, in FIG. 11A, which illustrates the topper assembly support legs 1112 being positioned for insertion into openings 1103 at the top of the gaming cabinet.

As described at 2206 of FIG. 22, the topper assembly is configured or positioned into a first stationary, intermediate service position by engaging slot portions 1115 of the support legs with tab portions 1105 of mounting plate 1104. An example of this is illustrated in FIG. 13.

FIG. 13 illustrates an example embodiment showing the topper assembly 1110 configured in the first, stationary, intermediate (hands free) service position. As illustrated in the example embodiment of FIG. 13, the slot portions 1115 of the support legs engage with tab portions 1005 of the mounting plate in a manner which enables the support legs to rest on the tab portions 1105 of the mounting plate, thereby enabling the topper assembly to rest in a first intermediate service position, and to remain in that position until subsequently moved by the service technician.

Additionally, as illustrated in the example embodiment of FIG. 13, topper assembly is able to be removably attached to the gaming cabinet and configured in the intermediate service position without requiring the use of any screws or fasteners and without requiring access to the interior of the gaming cabinet.

In at least one embodiment, while the topper assembly is positioned in this first, stationary intermediate service position, the entire weight of the topper assembly is supported by the slot portions 1115 of the support legs engaging with tab portions 1005 of the mounting plate. This enables both hands of the service technician to be freed up, thereby enabling the service technician to attend to other tasks of the installation process which may be facilitated using both hands. Accordingly, in at least one embodiment, the first intermediate service position may be referred to as a "hand free" intermediate service position.

For example, as described at 2208, while the topper assembly is resting in the hands free intermediate service position, the service technician is free to use both hands to facilitate the performance of various installation tasks, as desired, such as, for example, routing one or more electrical wiring harnesses from the topper assembly into the gaming cabinet, performing electrical connections and/or hardware connections between the topper assembly and gaming cabinet, etc. One example of this is illustrated in FIG. 14.

FIG. 14 illustrates a second example embodiment showing the topper assembly 1110 configured in the first intermediate (hands free) service position, thereby enabling the service technician to use both hands to facilitate the performance of various installation tasks, such as, for example: routing one or more electrical wiring harnesses (e.g., 1401) from the topper assembly into the gaming cabinet; connecting electrical wiring harnesses 1401 from the topper assembly to appropriate electrical wiring harnesses 1403 from the gaming cabinet; installing a topper compatible mounting plate 1510 at the top of the gaming machine cabinet; etc.

In at least one embodiment, at least a portion of the electrical wiring harnesses within the gaming cabinet (e.g., 1403) may be configured or designed to be accessible from the top opening 1107 of the gaming cabinet without the need for the main access door of the gaming cabinet to be opened. For example, as illustrated in FIG. 14, electrical wiring harnesses (e.g., 1403) within the gaming cabinet (e.g., which are designed to be connected to the topper assembly electrical wiring harnesses (e.g., 1401)) may be positioned within the interior of the gaming cabinet such that they are readily accessible to a service technician via the top opening of the gaming cabinet 1107. While the topper assembly is in the hands free intermediate service position (e.g., as illustrated in FIG. 14) the service technician may utilize both hands to: (i) route the electrical wiring harnesses (e.g., 1401) from the topper assembly into the top opening of the gaming cabinet; (ii) access electrical wiring harnesses 1403 from the top opening of the gaming cabinet without opening the main door of the gaming cabinet; and (iii) electrically couple wiring harnesses 1401 with wiring harnesses 1403 via their respective electrical interfaces 1405. Additionally, while the topper assembly is in the hands free intermediate service position, the service technician may utilize both hands to securely attach topper compatible cover plate 1510 to the top of the gaming cabinet.

Similarly, in a different embodiment where the topper assembly is to be removed from the gaming cabinet, the topper assembly may be positioned in the intermediate hands-free service position (e.g., as illustrated in FIG. 14) to enable the service technician to: detach the topper assembly electrical wiring harnesses from the gaming cabinet electrical wiring harnesses (without opening the main door of the gaming cabinet), remove cover plate 1510, and/or perform other tasks relating to the removal of the topper assembly from the gaming cabinet. Moreover, one of ordinary skill in the art may readily appreciate that, in at least one embodiment, a topper assembly may be removed from a gaming cabinet by reversing the steps described in the Topper Assembly Installation Procedure of FIG. 22.

It will be appreciated that the above-described design features also provide the added benefit of providing an improved security feature for the gaming cabinet since, for example, by designing the gaming cabinet in a manner which enables the electrical wiring harnesses 1403 to be accessible from the top opening of the gaming cabinet, it obviates a need for the main access door of the gaming cabinet to be opened during the installation or removal of the topper assembly to/from the gaming cabinet. It will be appreciated, however, that in other embodiments, the service technician may elect to open the main door of the gaming cabinet in order to access the interior components for facilitating the installation or removal of a topper assembly.

It is noted that at least some of the various electrical wiring harnesses (e.g., 1401, 1403) shown in FIGS. 12A, 12B, and 14 may also be included in the example embodiments of FIGS. 11A, 13, 16, 17, 18, and 21. However, for purposes of simplification, and in order to avoid clutter and confusion, such electrical wiring harnesses are not shown in FIGS. 11A, 13, 16, 17, 18, and 21.

Returning to FIG. 22, additionally as described at 2208, while the topper assembly is in the hands free intermediate service position, the service technician may utilize both hands to securely attach (e.g., 2210, FIG. 22) topper compatible cover plate 1510 to the top of the gaming cabinet.

Figure 15A:
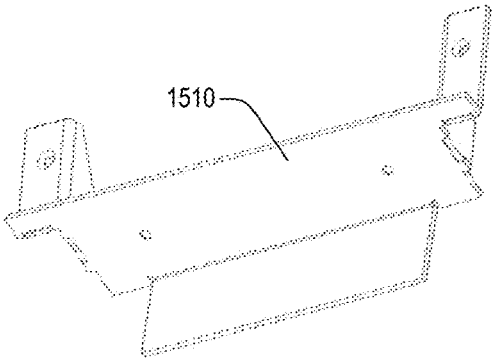
FIG. 15A illustrates a front perspective view of topper compatible cover plate 1510 in accordance with one embodiment.
Figure 15B:
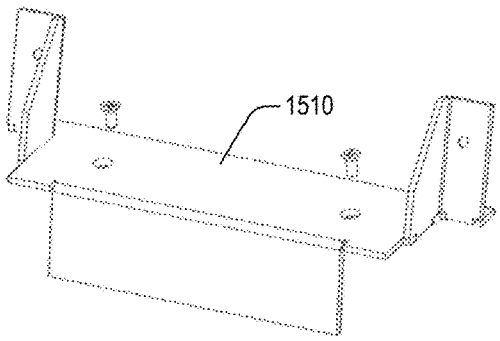
FIG. 15B illustrates a rear perspective view of topper compatible cover plate 1510.

FIG. 15A illustrates a front perspective view of topper compatible cover plate 1510 in accordance with one embodiment. FIG. 15B illustrates a rear perspective view of topper compatible cover plate 1510. In at least one embodiment, cover plate 1510 may be securely fastened to the gaming cabinet using screws or other types of fasteners which may be fastened to tab portions 1106 of mounting plate 1104 (FIG. 11B).

Returning to FIG. 22, as described at 2210, the topper assembly support legs are disengaged from tab portions 1105 (e.g., by the service technician raising the topper assembly and repositioning the support legs to disengage from tab portions 1105), and the topper assembly is then lowered to a secondary intermediate service position (see, e.g., FIG. 17) where tab portions 1105 of the mounting bracket to engage with slot portions 1113 of the support legs. An example of this is illustrated in FIG. 17.

FIG. 17 illustrates an example embodiment showing the topper assembly 1110 configured in a second intermediate service position.

In at least one embodiment, after slot portions 1113 of the support legs have been positioned to engage with the tab portions 1105 of the mounting bracket (e.g., as illustrated in FIG. 17), the support legs of topper assembly may be lowered into the interior of the gaming cabinet until tab portions 1105 engage with the top edges of slot portions 1113, as illustrated, for example, in FIG. 18. In at least one embodiment, this corresponds to the final installed position of the topper assembly.

FIG. 18 illustrates an example embodiment showing the topper assembly 1110 configured in a stationary, final installed position (e.g., as described at 2212, FIG. 22). As illustrated in the example embodiment of FIG. 18, the tab portions 1105 of mounting bracket 1104 engage with the top edges of slot portions 1113 of the support legs. In this way, the entire weight of the topper assembly is supported by mounting bracket 1104 via engagement of the tab portions 1105 with the top edges of slot portions 1113 of the topper assembly support legs.

It will be appreciated that one benefits of the elongated design of slots 1113 is that it can be used as a channel or guide (e.g., when engaged with tab portions 1105 of the mounting bracket) to help guide the movement of the topper assembly from the second intermediate service position (e.g., FIG. 17) into its final installed position (e.g., FIG. 18).

Additionally, as described at 2212 (FIG. 22), and illustrated in FIG. 18, distal end portions 1117 of support legs are positioned to engage with tab portions 1107 of mounting bracket 1104. In at least one embodiment, as illustrated in the example embodiment of FIG. 12B, the distal end portions 1117 of the topper assembly support legs may include notched regions which have been specifically designed to engage with tab portions 1107 of mounting bracket 1104. In at least one embodiment, the engagement of distal end portions 1117 of support legs with tab portions 1107 of mounting bracket 1104 (e.g., as illustrated in FIG. 18) provides additional lateral and structural support to the topper assembly without requiring the use of screws or fasteners, and without requiring a service technician to open the main door of the gaming cabinet in order to access the interior of the gaming cabinet to fasten the legs of the topper assembly to the gaming cabinet.

In at least one embodiment, when the topper assembly is positioned into final installed position, the mounting holes 1118 (FIG. 17) of the topper assembly support legs are aligned with mounting holes 1511 (FIG. 17) of cover plate 1510. Accordingly, as described at 2214 (FIG. 22), the topper assembly may be further secured to the gaming cabinet via the use of fasteners, for example, by using screws 1118*a* (FIG. 18) to securely attached the support legs 1112 of the topper assembly to the topper compatible cover plate 1510.

Figure 19:
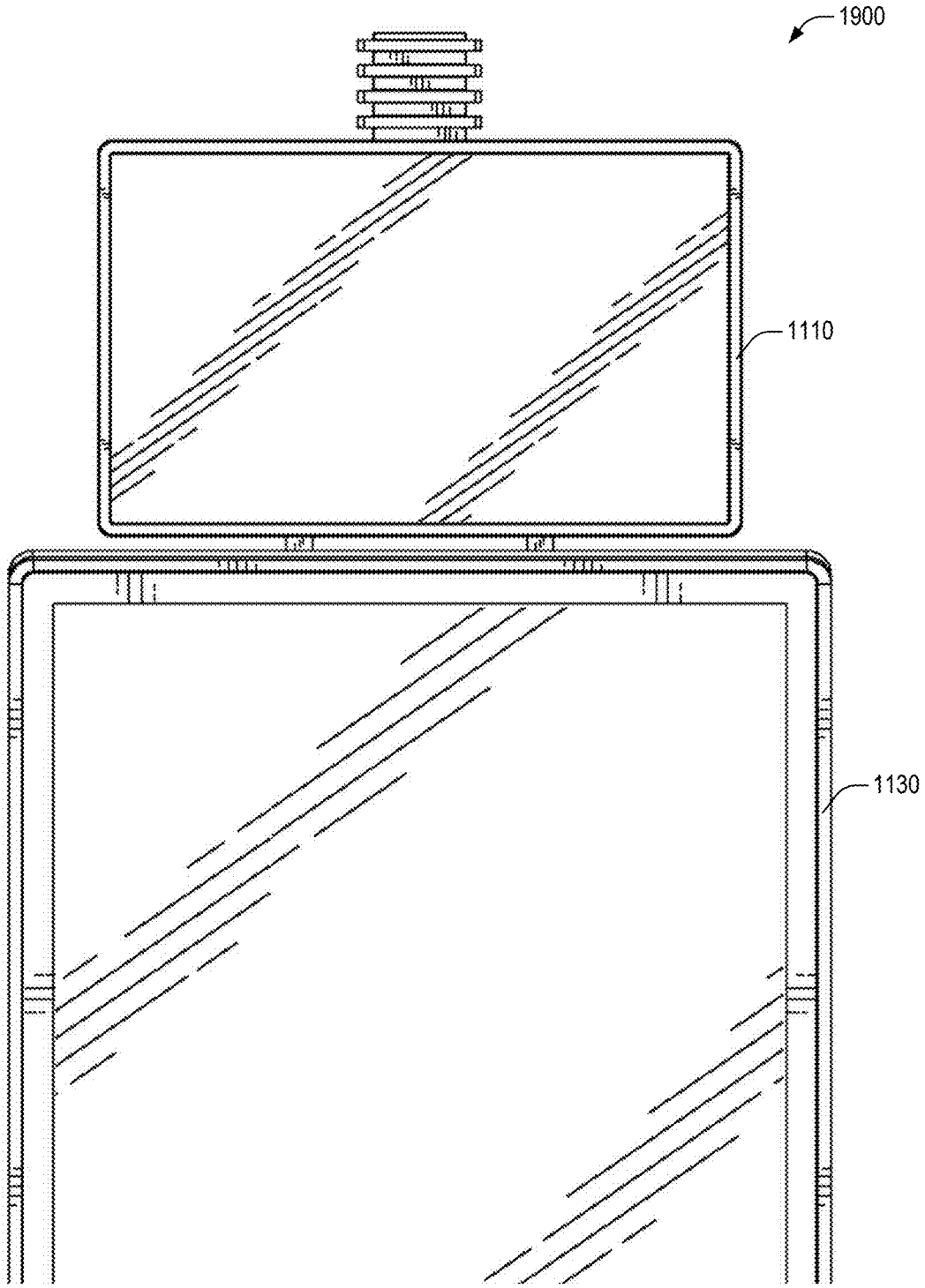
FIG. 19 illustrates an example embodiment showing an exterior portion of a gaming machine with topper assembly installed in its final installed position.

FIG. 19 illustrates an example embodiment showing an exterior portion of a gaming machine with topper assembly installed in its final installed position.

As discussed above, the gaming cabinet and topper assembly designs described herein provide a number of benefits and advantages with respect to the installation or removal of a topper assembly at the gaming cabinet. Examples of at least some of these benefits and advantages may include, but are not limited to, one or more of the following (or combinations thereof):

- Providing the ability for a topper assembly to be installed at or removed from a gaming cabinet in the field without requiring or needing access to any mounting screws inside the cabinet.
- Providing the ability for a topper assembly to be attached to the gaming cabinet and configured in an intermediate service position without requiring the use of any screws or fasteners.
- Providing the ability for a topper assembly to be attached to the gaming cabinet and configured in an intermediate service position while the main access door of the cabinet remains in a closed position.
- Providing the ability for a topper assembly to be installed at or removed from a gaming cabinet in the field without the need to open the main access door of the gaming cabinet.
- Providing the ability for a topper assembly to be installed at or removed from a gaming cabinet in the field while the main access door of the cabinet remains in a closed position.
- Providing a design for a regulatory compliant gaming cabinet and topper assembly in which the topper assembly is able to be positioned in an intermediate hands-free service position during installation of, or removal of, the topper assembly at/from the gaming cabinet.
- Providing the ability for topper assembly electrical wiring harnesses to be electrically connected to electrical wiring harnesses in the interior of the gaming cabinet while the main access door of the cabinet remains in a closed position.
- Providing the ability for electrical wiring harnesses within the interior of the gaming cabinet to be accesses from the exterior of the gaming cabinet while the main access door of the cabinet remains in a closed position.
- Providing a design for a regulatory compliant gaming cabinet and topper assembly in which the mounting or removal of the topper assembly to/from the gaming cabinet may be performed by a single person standing on a ladder overlooking the top portion of the cabinet while the main access door of the cabinet remains in a closed position.

In at least some alternate embodiments (not shown), the interfacing slot/tab features of the topper assembly support legs and mounting bracket may be swapped, exchanged or otherwise modified in a manner which provides substantially similar functionality to the features described herein. For example, in one embodiment (not shown), the mounting bracket may be designed to include slot portions (e.g., which may be similar in design to slot portions 1113 and 1115 of FIG. 12A), and the topper assembly support legs may be designed to include tab portions or other protruding members which are configured or designed to engage with the slot portions of the mounting bracket in a manner which provides functionality similar that described herein with respect to FIGS. 11A-18.

Figure 23:
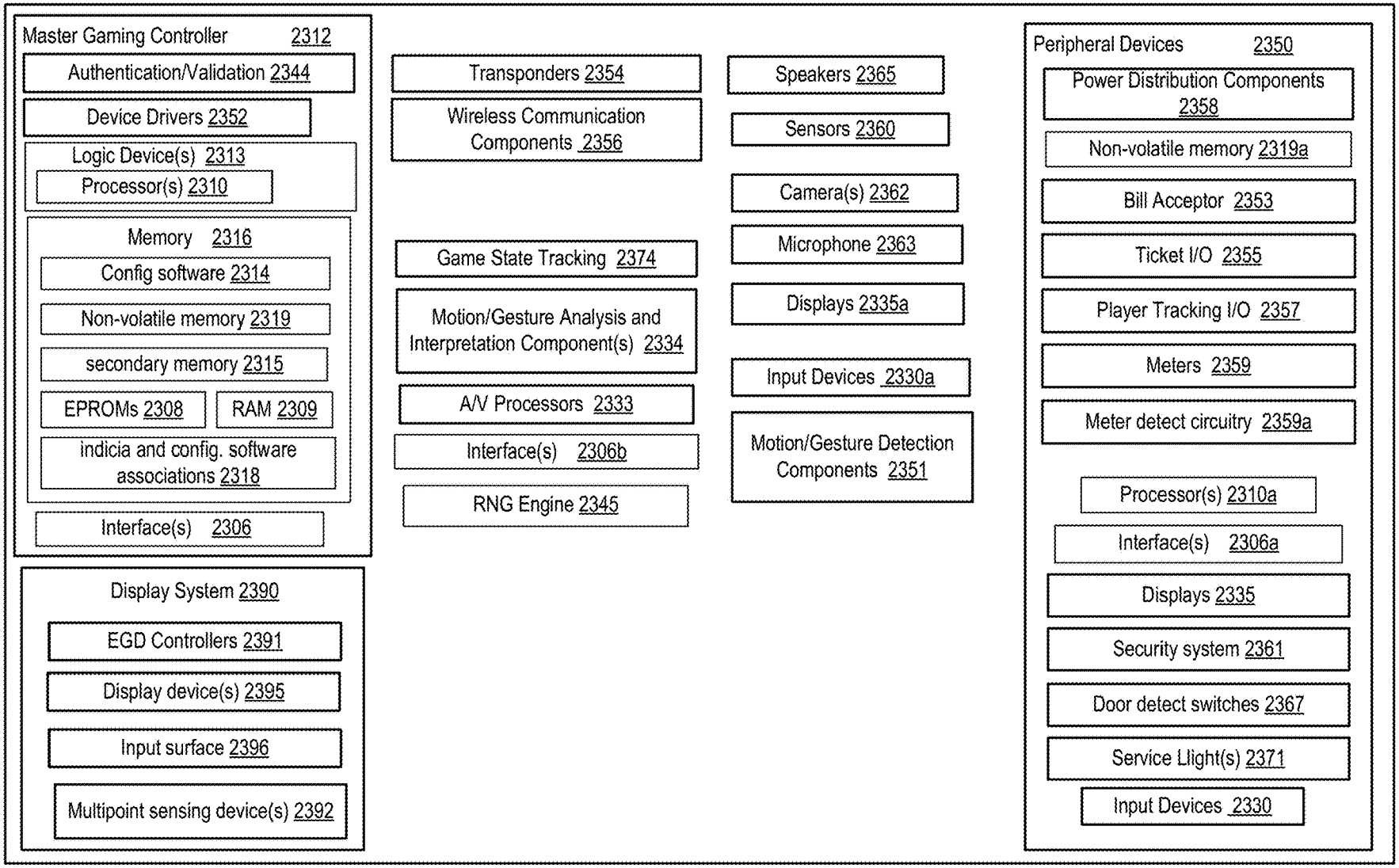
FIG. 23 provides a block diagram of an exemplary intelligent electronic gaming system according to one embodiment of the present disclosure.

Lastly, FIG. 23 provides a block diagram of an exemplary intelligent electronic gaming system according to one embodiment of the present disclosure. In some embodiments, gaming system 2300 may be implemented as a gaming server. In other embodiments, gaming system 2300 may be implemented as an EGM or electronic gaming terminal ("EGT"). Gaming system 2300 can be implemented on a single EGM, such as those shown and discussed in the foregoing examples, or can be implemented across multiple EGMs, EGTs, and potentially other devices and system components, such as a system server, as will be readily appreciated.

Gaming system 2300 can include at least one processor 2310, at least one interface 2306, and memory 2316. Additionally, gaming system 2300 can include at least one master gaming controller 2312, a multi-touch sensor and display system 2390, a plurality of peripheral device components 2350, and various other components, devices, systems such as, for example, one or more of the following (or combinations thereof):

- Transponders 2354;
- Wireless communication components 2356;
- Games state tracking components 2374;
- Audio/video processors 2333 which, for example, may include functionality for detecting, analyzing and/or managing various types of audio and/or video information relating to various activities at the gaming system;
- Various interfaces 2306*b* (e.g., for communicating with other devices, components, systems, etc.);
- RNG Engine 2345;
- Speakers 2365;
- Sensors 2360;
- One or more cameras 2362;
- One or more microphones 2363;
- Secondary display(s) 2335*a;*
- Input devices 2330*a;*
- Motion/gesture detection components 2351;
- Motion/gesture analysis and interpretation components 2334; and
- Accessibility components 2380, among other possible components.

In at least one embodiment, master gaming controller 2312 may include one or more of the following (or combinations thereof):

- Authentication/validation components 2344;
- Device drivers 2342;
- Logic devices 2313, which may include one or more processors 2310;
- Memory 2316, which may include one or more of the following (or combinations thereof): configuration software 2314, non-volatile memory 2319, secondary memory 2315, EPROMS 2308, RAM 2309, associations 2318 between indicia and configuration software; and
- Interfaces 2306, among other possible components.

In at least one embodiment, display system 2390 may include one or more of the following (or combinations thereof):

- Electronic Gaming Display ("EGD") controllers 2391;
- Multipoint sensing device(s) (e.g., multi-touch surface sensors/components) 2392;
- Display device(s) 2395; and
- Input/touch surface 2396, among other possible components.

According to various embodiments, display device(s) 2395 may include one or more display screens utilizing various types of display technologies such as, for example, one or more of the following (or combinations thereof): LCDs (Liquid Crystal Display), Plasma, OLEDs (Organic Light Emitting Display), TOLED (Transparent Organic Light Emitting Display), Flexible (F)OLEDs, Active matrix (AM) OLED, Passive matrix (PM) OLED, Phosphorescent (PH) OLEDs, SEDs (surface-conduction electron-emitter display), EPD (ElectroPhoretic display), FEDs (Field Emission Displays) and/or other suitable display technology.

In at least one embodiment, Peripheral Devices 2350 may include one or more of the following (or combinations thereof):

Power distribution components 2358;
Non-volatile memory 2319*a* (and/or other types of memory);
Bill acceptor 2353;
Ticket I/O 2355;
Player tracking I/O 2357;
Meters 2359 (e.g., hard and/or soft meters);
Meter detect circuitry 2359*a;*
Processor(s) 2310*a;*
Interface(s) 2306*a;*
Display(s) 2335;
Independent security system 2361;
Door detect switches 2367;
Service Light component(s) 2371; and
Input devices 2330, among other possible components.

In one implementation, processor 2310 and master gaming controller 2312 can be included in a logic device 2313 enclosed in a logic device housing. The processor 2310 may include any conventional processor or logic device configured to execute software allowing various configuration and reconfiguration tasks such as, for example: a) communicating with a remote source via communication interface 2306, such as a server that stores authentication information or games; b) converting signals read by an interface to a format corresponding to that used by software or memory in the gaming system; c) accessing memory to configure or reconfigure game parameters in the memory according to indicia read from the device; d) communicating with interfaces, various peripheral devices and/or I/O devices; e) operating peripheral devices such as, for example, card readers, paper ticket readers, etc.; f) operating various I/O devices such as, for example, displays 2335, input devices 2330; etc. For instance, the processor 2310 may send messages including game play information to the displays 2335 to inform players of cards dealt, wagering information, and/or other desired information.

In at least one implementation, the gaming system may include card readers such as used with credit cards, or other identification code reading devices to allow or require player identification in connection with play of the card game and associated recording of game action. Such a player identification interface can be implemented in the form of a variety of magnetic card readers commercially available for reading a player-specific identification information. The player-specific information can be provided on specially constructed magnetic cards issued by a casino, or magnetically coded credit cards or debit cards frequently used with national credit organizations such as VISA, MASTERCARD, AMERICAN EXPRESS, or banks and other institutions.

The gaming system may include other types of participant identification mechanisms which may use a fingerprint image, eye blood vessel image reader, or other suitable biological information to confirm identity of the player. Still further it is possible to provide such participant identification information by having the dealer manually code in the information in response to the player indicating his or her code name or real name. Such additional identification could also be used to confirm credit use of a smart card, transponder, and/or player's personal player input device ("UID").

The gaming system 2300 also includes memory 2316 which may include, for example, volatile memory (e.g., RAM 2309), non-volatile memory 2319 (e.g., disk memory, FLASH memory, EPROMs, etc.), unalterable memory (e.g., EPROMs 2308), etc. The memory may be configured or designed to store, for example: 1) configuration software 2314 such as all the parameters and settings for a game playable on the gaming system; 2) associations 2318 between configuration indicia read from a device with one or more parameters and settings; 3) communication protocols allowing the processor 2310 to communicate with peripheral devices and I/O devices 2350; 5) a secondary memory storage device 2315 such as a non-volatile memory device, configured to store gaming software related information (the gaming software related information and memory may be used to store various audio files and games not currently being used and invoked in a configuration or reconfiguration); 5) communication transport protocols (such as, for example, TCP/IP, USB, Firewire, IEEE1394, Bluetooth, IEEE 802.11x (IEEE 802.11 standards), hiperlan/2, HomeRF, etc.) for allowing the gaming system to communicate with local and non-local devices using such protocols; etc. In one implementation, the master gaming controller 2312 communicates using a serial communication protocol. A few examples of serial communication protocols that may be used to communicate with the master gaming controller include but are not limited to USB, RS-232 and Netplex.

A plurality of device drivers 2342 may be stored in memory 2316. Examples of different types of device drivers may include device drivers for gaming system components, device drivers for gaming system components, etc. Typically, the device drivers 2342 utilize a communication protocol of some type that enables communication with a particular physical device. The device driver abstracts the hardware implementation of a device. For example, a device drive may be written for each type of card reader that may be potentially connected to the gaming system. Examples of communication protocols used to implement the device drivers include Netplex, USB, Serial, Ethernet 575, Firewire, 110 debouncer, direct memory map, serial, PCI, parallel, RF, Bluetooth™, near-field communications (e.g., using near-field magnetics), 802.11 (WiFi), etc. According to a specific embodiment, when one type of a particular device is exchanged for another type of the particular device, a new device driver may be loaded from the memory 2316 by the processor 2310 to allow communication with the device. For instance, one type of card reader in gaming system 2300 may be replaced with a second type of card reader where device drivers for both card readers are stored in the memory 2316.

In some embodiments, the software units stored in the memory 2316 may be upgraded as needed. For instance, when the memory 2316 is a hard drive, new games, game options, various new parameters, new settings for existing parameters, new settings for new parameters, device drivers, and new communication protocols may be uploaded to the memory from the master gaming controller 2312 or from some other external device. As another example, when the memory 2316 includes a CD/DVD drive including a CD/DVD designed or configured to store game options, parameters, and settings, the software stored in the memory may be upgraded by replacing a first CD/DVD with a second CD/DVD. In yet another example, when the memory 2316 uses one or more flash memory 2319 or EPROM 2308 units designed or configured to store games, game options, parameters, settings, the software stored in the flash and/or EPROM memory units may be upgraded by replacing one or more memory units with new memory units which include the upgraded software. In another embodiment, one or more of the memory devices, such as the hard-drive, may be employed in a game software download process from a remote software server.

In some embodiments, the gaming system 2300 may also include various authentication and/or validation components 2344 which may be used for authenticating/validating specified gaming system components such as, for example, hardware components, software components, firmware components, information stored in the gaming system memory 2316, and the like.

Sensors 2360 may include, for example, optical sensors, pressure sensors, RF sensors, Infrared sensors, motion sensors, audio sensors, image sensors, thermal sensors, biometric sensors, etc. As mentioned previously, such sensors may be used for a variety of functions such as, for example: detecting the presence and/or monetary amount of gaming chips which have been placed within a player's wagering zone; detecting (e.g., in real time) the presence and/or monetary amount of gaming chips which are within the player's personal space; and the like.

In one implementation, at least a portion of the sensors 2360 and/or input devices 2330 may be implemented in the form of touch keys selected from a wide variety of commercially available touch keys used to provide electrical control signals. Alternatively, some of the touch keys may be implemented in another form which are touch sensors such as those provided by a touchscreen display. For example, in at least one implementation, the gaming system player may include input functionality for enabling players to provide their game play decisions/instructions (and/or other input) to the dealer using the touch keys and/or other player control sensors/buttons. Additionally, such input functionality may also be used for allowing players to provide input to other devices in the casino gaming network (such as, for example, player tracking systems, side wagering systems, etc.).

Wireless communication components 2356 may include one or more communication interfaces having different architectures and utilizing a variety of protocols such as, for example, 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams or analog signals representing various types of information.

An example of a near-field communication protocol is the ECMA-340 "Near Field Communication—Interface and Protocol (NFCIP-1)", published by ECMA International (www.ecma-international.org), herein incorporated by reference in its entirety for all purposes. It will be appreciated that other types of Near Field Communication protocols may be used including, for example, near field magnetic communication protocols, near field RF communication protocols, and/or other wireless protocols which provide the ability to control with relative precision (e.g., on the order of centimeters, inches, feet, meters, etc.) the allowable radius of communication between at least 5 devices using such wireless communication protocols.

Power distribution components 2358 may include, for example, components or devices which are operable for providing wireless power to other devices. For example, in one implementation, the power distribution components 2358 may include a magnetic induction system which is adapted to provide wireless power to one or more portable UIDs at the gaming system. In one implementation, a UID docking region may include a power distribution component which is able to recharge a UID placed within the UID docking region without requiring metal-to-metal contact.

In at least one embodiment, motion/gesture detection component(s) 2351 may be configured or designed to detect player (e.g., player, dealer, and/or other persons) movements and/or gestures and/or other input data from the player. In some embodiments, each gaming system may have its own respective motion/gesture detection component(s). In other embodiments, motion/gesture detection component(s) 2351 may be implemented as a separate sub-system of the gaming system which is not associated with any one specific gaming system or device.

One or more cameras (e.g., 2362) may be used to monitor, stream and/or record image content and/or video content relating to persons or objects within each camera's view. For example, in at least one embodiment where the gaming system is implemented as an EGM or EGT, camera 2362 may be used to generate a live, real-time video feed of a player (or other person) who is currently interacting with the EGM or EGT. In some embodiments, camera 2362 may be used to verify a user's identity (e.g., by authenticating detected facial features), and/or may be used to monitor or track facial expressions and/or eye movements of a user who is interacting with the gaming system, such as to open an access door.

The present application herein incorporates by reference, in its entirety and for all purposes, U.S. patent application Ser. No. 15/718,250, titled "MOUNTING CONFIGURATION AND METHOD FOR A TOPPER DISPLAY OF A GAMING MACHINE" by LEWIS et al., filed on 28 Sep. 2017.

The present application herein incorporates by reference, in its entirety and for all purposes, U.S. patent application Ser. No. 15/703,645, titled "GAMING MACHINE HAVING DOOR WITH EXTENDED OPENING AND CLOSING CONTROL" by HOHMAN et al., filed on 13 Sep. 2017.

The present application herein incorporates by reference, in its entirety and for all purposes, U.S. patent application Ser. No. 16/103,488, titled "GAMING MACHINE DISPLAY MOUNTING AND ALIGNMENT CONFIGURATION AND METHOD" by AMBRECHT et al., filed on 14 Aug. 2018.

The present application herein incorporates by reference, in its entirety and for all purposes, U.S. patent application Ser. No. 16/044,999, titled "COMPONENT MOUNTING CONFIGURATIONS FOR A GAMING MACHINE CABINET" by BRANDAU et al., filed on 25 Jul. 2018.

The various aspects, embodiments, implementations or features of the described embodiments can be used separately or in any combination. Various aspects of the described embodiments can be implemented by software, hardware or a combination of hardware and software. Computer readable medium can be any data storage device that can store data which can thereafter be read by a computer system. Examples of computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A gaming machine, comprising:

a gaming machine cabinet having an entry that provides access to an interior of the gaming machine cabinet, wherein the gaming machine has a plurality of internal components;

a main door assembly movably coupled to the gaming machine cabinet, wherein the main door assembly moves from a closed position that prevents access to the interior of the gaming machine cabinet through the entry to an open position that allows access to the interior of the gaming machine cabinet through the entry;

a display screen located on the main door assembly;

a main door support assembly coupled to the main door assembly and the gaming machine cabinet, the main door support assembly including multiple flat identical components arranged into parallel planes forming a four-bar linkage and a stabilizing strut between at least two of the flat identical components, the stabilizing strut defining a longitudinal axis that is orthogonal to the parallel planes, wherein the main door support assembly facilitates an opening movement of the main door assembly, and wherein the opening movement includes the main door assembly moving outward from the closed position and then upward to arrive at the open position;

one or more electrical cables coupling the display screen to one or more internal components of the gaming machine, wherein the stabilizing strut provides a routing path for the one or more electrical cables when the main door assembly moves between the closed position and the open position;

a topper supported by the gaming machine cabinet, wherein the topper is located directly above and next to the display screen when the main door assembly is at the closed position and the display screen is located directly in front of the topper when the main door assembly is at the open position;

one or more topper support legs coupled to and extending away from the topper; and one or more mounting brackets coupled to the gaming machine cabinet, each mounting bracket including one or more tabs, wherein the one or more topper support legs interact with the one or more mounting brackets to facilitate a final installed position of the topper and a different intermediate service position of the topper that permits servicing of the topper while the topper is still supported by the gaming machine cabinet by way of the one or more mounting bracket tabs.

2. The gaming machine of claim 1, wherein the gaming machine is an upright gaming machine.

3. A gaming machine, comprising:

a cabinet having an entry that provides access to an interior of the cabinet;

a main door assembly movably coupled to the cabinet, wherein the main door assembly moves from a closed position that prevents access to the interior of the cabinet through the entry to an open position that allows access to the interior of the cabinet through the entry;

a display screen located on the main door assembly; and a main door support assembly coupled to the main door assembly and the cabinet, the main door support assembly including a four-bar linkage that facilitates an opening movement of the main door assembly, wherein the opening movement includes the main door assembly moving outward from the closed position and then upward to arrive at the open position.

4. The gaming machine of claim 3, wherein the display screen remains in substantially the same vertical orientation throughout the opening movement.

5. The gaming machine of claim 3, further comprising:

a topper supported by the cabinet, the topper being located directly above and next to the display screen when the main door assembly is at the closed position;

one or more topper support legs coupled to and extending away from the topper; and one or more mounting brackets coupled to the cabinet, wherein the one or more topper support legs interact with the one or more mounting brackets to facilitate a final installed position of the topper and a different intermediate service position of the topper that permits servicing of the topper while the topper is still supported by the cabinet.

6. The gaming machine of claim 5, wherein each mounting bracket includes one or more tabs that support the one or more topper support legs when the topper is in the intermediate service position.

7. The gaming machine of claim 5, wherein the display screen is directly in front of the topper when the main door assembly is at the open position.

8. The gaming machine of claim 5, wherein the opening movement of the main door assembly is possible while the topper remains in the final installed position.

9. The gaming machine of claim 5, wherein the distance between the bottom of the topper and the top of the display screen is less than about 0.5 cm when the topper is in the final installed position and the main door assembly is in the closed position.

10. The gaming machine of claim 3, wherein the ground link of the four-bar linkage is coupled to the cabinet and the output link of the four-bar linkage is coupled to the main door assembly.

11. The gaming machine of claim 3, wherein the main door support assembly includes multiple flat identical components arranged into parallel planes.

12. The gaming machine of claim 11, wherein the main door support assembly further includes a stabilizing strut located between at least two of the multiple flat identical components, the stabilizing strut defining a longitudinal axis that is orthogonal to the parallel planes.

13. The gaming machine of claim 12, further including:

one or more electrical cables coupling the display screen to one or more components in the interior of the cabinet, wherein the stabilizing strut provides a routing path for the one or more electrical cables when the main door assembly moves between the closed position and the open position.

14. A modular gaming machine comprising:

a gaming cabinet;

a first topper assembly removably attachable to the gaming cabinet;

the gaming cabinet including a main door assembly movably attached to the gaming cabinet, the main door assembly being movable to a closed position which prevents access to an interior of the gaming cabinet, the main door assembly being further movable to an open position which enables access to the interior of the gaming cabinet;

the gaming cabinet further including a first mounting bracket coupled to the gaming cabinet and disposed at the interior of the gaming cabinet;

the first topper assembly including a topper body and at least one support leg attached to the topper body and extending away from the topper body;

the gaming cabinet including a first opening deployed at a top portion of the gaming cabinet, the first opening having a size and shape which accommodates passage of the at least one support leg through the first opening;

wherein the first topper assembly is removably attachable to the gaming cabinet and configurable in a stationary, intermediate service position via engagement of at least one of the at least one support leg with the first mounting bracket; and wherein the first topper assembly is further configurable in a stationary, final installed position via engagement of the at least one support leg with the first mounting bracket.

15. The gaming machine of claim 14:

wherein the intermediate service position is different from the final installed position.

16. The gaming machine of claim 14:

wherein the at least one support leg is removably attachable to the first mounting bracket in accordance with a first attachment configuration and without use of fasteners; and wherein the attachment of the at least one support leg to the first mounting bracket in accordance with the first attachment configuration results in the first topper assembly being configured in the intermediate service position.

17. The gaming machine of claim 14:

wherein the at least one support leg is removably attachable to the first mounting bracket in accordance with a first attachment configuration and without use of fasteners;

wherein the attachment of the at least one support leg to the first mounting bracket in accordance with the first attachment configuration results in the first topper assembly being configured in the intermediate service position;

wherein the at least one support leg is removably attachable to the first mounting bracket in accordance with a second attachment configuration; and wherein the attachment of the at least one support leg to the first mounting bracket in accordance with the second attachment configuration results in the first topper assembly being configured in the final installed position.

18. The gaming machine of claim 14:

wherein the first topper assembly is removably attachable to the gaming cabinet and configurable in the stationary, intermediate service position while the main door assembly configured is in the closed position.

19. The gaming machine of claim 14:

wherein the first topper assembly is removably attachable to the gaming cabinet and configurable in the intermediate service position while the main door assembly is configured in the closed position; and wherein the first topper assembly is removably attachable to the gaming cabinet and configurable in the final installed position while the main door assembly is configured in the closed position.

20. The gaming machine of claim 14:

wherein an interior region of the gaming machine is accessible via the first opening while the first topper assembly is configured in the intermediate service position; and wherein the interior region of the gaming machine is not accessible via the first opening while the first topper assembly is configured in the final installed position.

21. The gaming machine of claim 14:

wherein the gaming cabinet further includes a first set of electrical wiring harnesses disposed within the interior of the gaming cabinet; and wherein the first set of electrical wiring harnesses are positioned within the interior of the gaming cabinet in a manner which enables the first set of electrical wiring harnesses to be physically accessed from an exterior of the gaming cabinet while the main door assembly is configured in the closed position.

22. The gaming machine of claim 14:

wherein the gaming cabinet further includes a first set of electrical wiring harnesses disposed within the interior of the gaming cabinet;

wherein the topper assembly further includes a second set of electrical wiring harnesses electrically coupled to at least one electrical component of the topper assembly;

wherein the first set of electrical wiring harnesses are positioned within the interior of the gaming cabinet in a manner which enables the first set of electrical wiring harnesses to be physically accessed from an exterior of the gaming cabinet; and wherein the second set of electrical wiring harnesses are electrically couplable to the first set of electrical wiring harnesses while the main door assembly is configured in the closed position.

23. The gaming machine of claim 14:

wherein the at least one support leg has an elongated shape, the at least one support leg having a first elongated slot disposed therein, the at least one support leg further having a second slot disposed therein;

wherein the first mounting bracket includes a bracket body and a first set of tab members extending outward from the bracket body;

wherein the first topper assembly is configurable in the intermediate support position via engagement of a first tab member of the first set of tab members with the first elongated slot of the at least one support leg; and wherein the first topper assembly is configurable in the final installed configuration via engagement of the first tab member with the second slot of the at least one support leg.

24. The gaming machine of claim 14:

wherein the first mounting bracket includes a bracket body and a first set of tab members extending outward from the bracket body; and wherein the first set of tab members support the at least one support leg of the topper assembly while the topper assembly is configured in the intermediate service position.

25. The gaming machine of claim 14:

wherein the at least one support leg includes a distal end portion;

wherein the at least one support leg further includes a first elongated slot disposed therein;

wherein the at least one support leg further includes a second slot disposed therein;

wherein the first mounting bracket includes a bracket body;

wherein the first mounting bracket further includes a first set of tab members extending outward from the bracket body;

wherein the first mounting bracket further includes a second set of tab members extending outward from the bracket body;

wherein the first topper assembly is configurable in the intermediate support position via engagement of a first tab member of the first set of tab members with the first elongated slot of the at least one support leg; and wherein the first topper assembly is configurable in the final installed configuration via engagement of the first tab member with the second slot of the at least one support leg and via engagement of a second tab of the second set of tab members with the distal end portion of the at least one support leg.

* * * * *